US011396111B2

(12) United States Patent
Zhao et al.

(10) Patent No.: US 11,396,111 B2
(45) Date of Patent: Jul. 26, 2022

(54) THICKNESS PLANER

(71) Applicant: MAKITA CORPORATION, Anjo (JP)

(72) Inventors: Zuoxiu Zhao, Jiangsu (CN); Shixuan Peng, Jiangsu (CN); Pengsheng Wang, Jiangsu (CN); Xiongfei Wen, Jiangsu (CN)

(73) Assignee: MAKITA CORPORATION, Anjo (JP)

( * ) Notice: Subject to any disclaimer, the term of this patent is extended or adjusted under 35 U.S.C. 154(b) by 208 days.

(21) Appl. No.: 16/929,760

(22) Filed: Jul. 15, 2020

(65) Prior Publication Data

US 2021/0016464 A1 Jan. 21, 2021

(30) Foreign Application Priority Data

Jul. 15, 2019 (CN) ..... 201910633943.0

(51) Int. Cl.

| | |
|---|---|
| ***B27C 1/10*** | (2006.01) |
| ***B27C 1/04*** | (2006.01) |
| ***B27C 1/12*** | (2006.01) |
| *B27C 1/14* | (2006.01) |

(52) U.S. Cl.

CPC ..... *B27C 1/10* (2013.01); *B27C 1/04* (2013.01); *B27C 1/12* (2013.01); *B27C 1/14* (2013.01)

(58) Field of Classification Search

CPC .... B27C 1/02; B27C 1/04; B27C 1/06; B27C 1/14

See application file for complete search history.

(56) References Cited

U.S. PATENT DOCUMENTS

| | | | | |
|---|---|---|---|---|
| 6,585,017 | B1 * | 7/2003 | Campbell | B27C 1/04 144/130 |
| 6,666,242 | B1 * | 12/2003 | Liao | B23Q 5/54 144/382 |
| 7,726,366 | B2 * | 6/2010 | Liu | B27C 1/02 451/65 |
| 2009/0000696 | A1 | 1/2009 | Grossman et al. | |
| 2017/0144325 | A1 | 5/2017 | Staeubli et al. | |

(Continued)

FOREIGN PATENT DOCUMENTS

| | | |
|---|---|---|
| CN | 101327601 A | 12/2008 |
| CN | 104959668 A | 10/2015 |

(Continued)

OTHER PUBLICATIONS

Doresoom Tool Reviews, Makita New Tool Patents 2021—Crazy New Tools We Could See This Year!, Apr. 10, 2021, https://www.youtube.com/watch?v=GkONHaM5JOs, 0:40-1:22 (Year: 2021).*

(Continued)

*Primary Examiner* — Matthew Katcoff
(74) *Attorney, Agent, or Firm* — Oliff PLC

(57) ABSTRACT

A thickness planer includes a motor, a planing part, a placing part, a feeding part, and a battery pack mounting unit. The planing part is configured to be driven by the motor and plane a workpiece. A workpiece is placeable on the placing part. The feeding part is configured to feed the workpiece placed on the placing part to the planing part. A battery pack for supplying power to the motor is attachable to the battery pack mounting unit.

20 Claims, 34 Drawing Sheets

(56) References Cited

U.S. PATENT DOCUMENTS

| | | | |
|---|---|---|---|
| 2017/0361488 | A1 | 12/2017 | Wierzchon |
| 2018/0161891 | A1 | 6/2018 | Nishikawa |

FOREIGN PATENT DOCUMENTS

| | | | |
|---|---|---|---|
| CN | 204867596 | U | 12/2015 |
| CN | 106457597 | A | 2/2017 |
| CN | 107635734 | A | 1/2018 |
| CN | 207432379 | U | 6/2018 |
| JP | H04-165917 | A | 6/1992 |
| JP | H11-198104 | A | 7/1999 |
| JP | 4165917 | B2 | 10/2008 |

OTHER PUBLICATIONS

Apr. 18, 2022 Office Action issued in Chinese Patent Application No. 201910633943.0.

* cited by examiner

THICKNESS PLANER

CROSS-REFERENCE TO RELATED APPLICATION

The present application claims priority to Chinese patent application No. 2019 1063 3943.0 filed on Jul. 15, 2019, the contents of which are fully incorporated herein by reference.

TECHNICAL FIELD

The present invention relates to a thickness planer.

BACKGROUND ART

Japanese Patent No. 4165917 discloses a thickness planer which is driven by power being supplied from an external power source.

SUMMARY

According to one aspect of the present invention, a thickness planer is provided. The thickness planer has a motor, a planing part that is configured to be driven by the motor and plane a workpiece, a placing part on which the workpiece is placeable, a feeding part that is configured to feed the workpiece placed on the placing part to the planing part. and a battery pack mounting unit to which a battery pack for supplying power to the motor is attachable.

DETAILED DESCRIPTION OF THE EMBODIMENTS

First Embodiment

Figure 1:
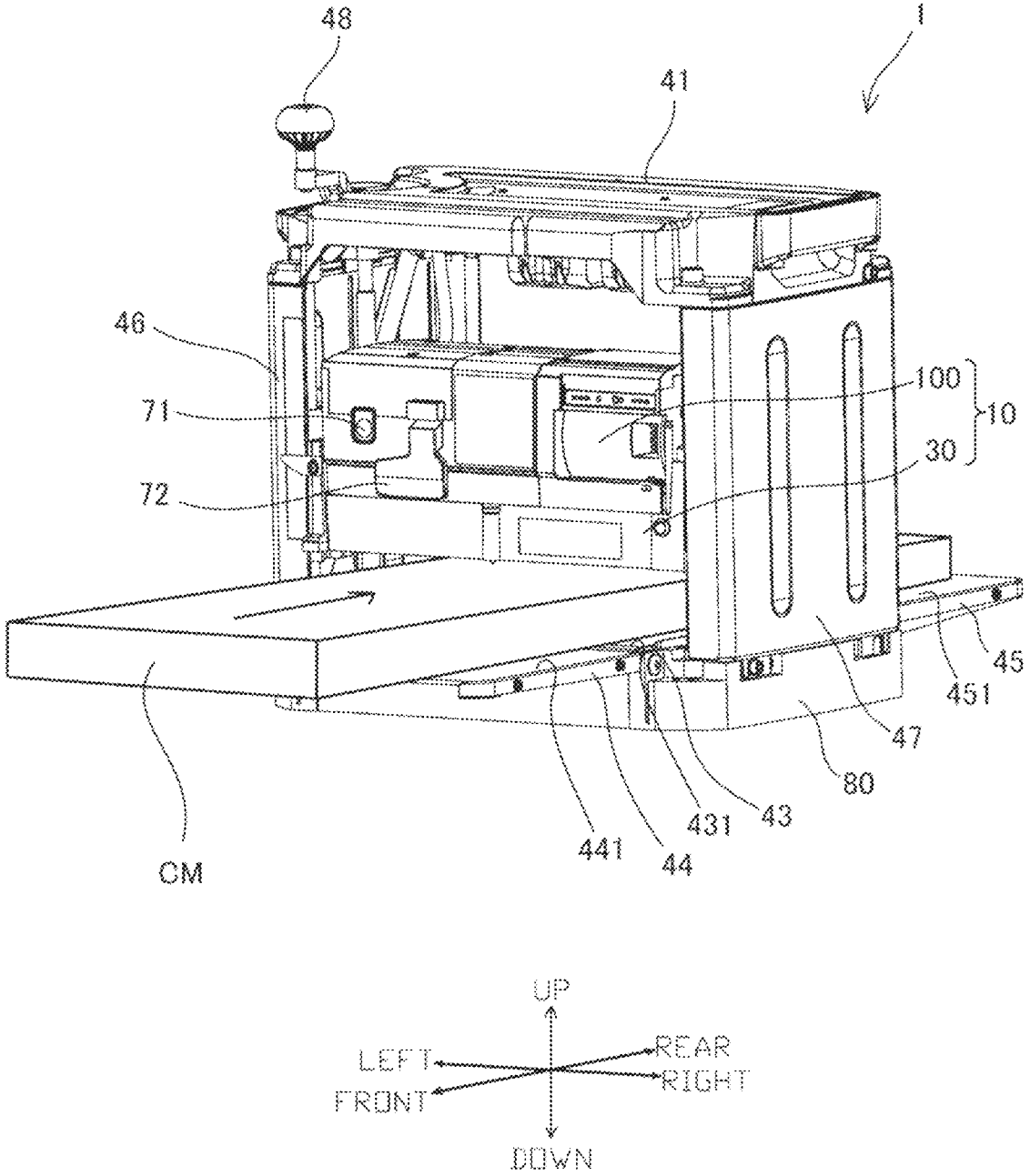
FIG. 1 is a front perspective view of a thickness planer.

The structure of a thickness planer 1 is briefly described as an embodiment of the present disclosure with reference to FIGS. 1 to 5.

The thickness planer 1 is configured to feed a workpiece (material to be planed) CM placed on a placing surface 431 of a table 43 to a cutting area (planing area) CA and plane an upper surface of the workpiece CM passing through the cutting area CA. In this embodiment, the thickness planer 1 feeds the workpiece CM placed on the table 43 in a feeding direction shown by an arrow in FIG. 1.

In the following description, for convenience sake, the feeding direction is defined as a front-rear direction, and in the front-rear direction, the side of the thickness planer 1 to which the workpiece CM is fed is defined as a rear side and the opposite side is defined as a front side. Specifically, the workpiece CM is fed from the front side to the rear side of the thickness planer 1. Further, a direction perpendicular to the placing surface 431 of the table 43 on which the workpiece CM is placed is defined as a vertical direction. In the vertical direction, a direction from the table 43 toward the workpiece CM is defined as an upper direction and the opposite direction is defined as a lower direction. Further, a direction perpendicular to the front-rear direction and the vertical direction is defined as a left-right direction. In the left-right direction, a left and right sides in the feeding direction are respectively defined as a left side and a right side.

As shown in the drawings, the thickness planer 1 has a body unit 10 having a cutting (planing) function. A top cover 41 is arranged above the body unit 10 and a base 80 is arranged below the body unit 10. The table 43 is arranged on an upper side of the base 80. Further, a left side cover 46 and a right side cover 47 are arranged on left and right sides of the body unit 10, respectively.

A lifting handle 48 is provided on the top cover 41 and configured to be rotatable around a rotation axis extending in the vertical direction. The body unit 10 is configured to be raised and lowered in the vertical direction with respect to the table 43 by user's operation of turning the lifting handle 48. The vertical length of the cutting area CA which is surrounded by the body unit 10, the table 43, the left side cover 46 and the right side cover 47 can be adjusted by raising and lowering the body unit 10. The thickness planer 1 is configured to be capable of planing the workpiece CM of different thicknesses by adjusting the vertical length of the cutting area CA according to the thickness (vertical length) of the workpiece CM.

A front auxiliary table 44 is pivotally supported around a pivot axis extending in the left-right direction on a front end of the table 43. Further, a rear auxiliary table 45 is pivotally supported around a pivot axis extending in the left-right direction on a rear end of the table 43. The front auxiliary table 44 and the rear auxiliary table 45 have respectively a placing surface 441 and a placing surface 451 on which the workpiece CM can be placed. The placing surfaces 441, 431, 451 are configured to be flush with each other when the front and rear auxiliary tables 44, 45 are placed in a horizontal state (unfolded or open state). When turned upward around the pivot axis, the front and rear auxiliary tables 44, 45 are folded (closed) upward from the front and rear ends of the table 43.

Figure 2:
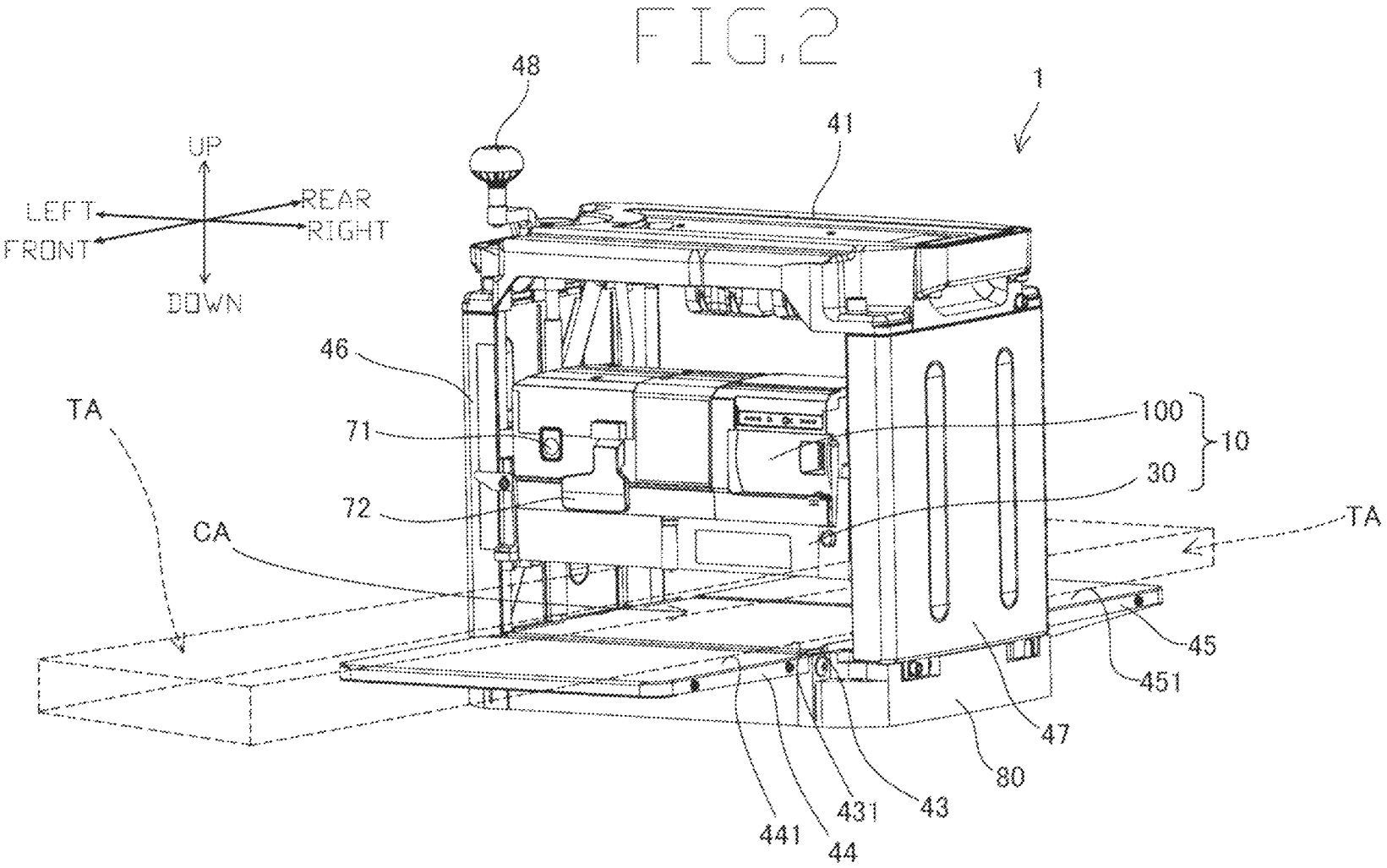
FIG. 2 is a perspective view for showing a feeding area of the thickness planer.
Figure 3:
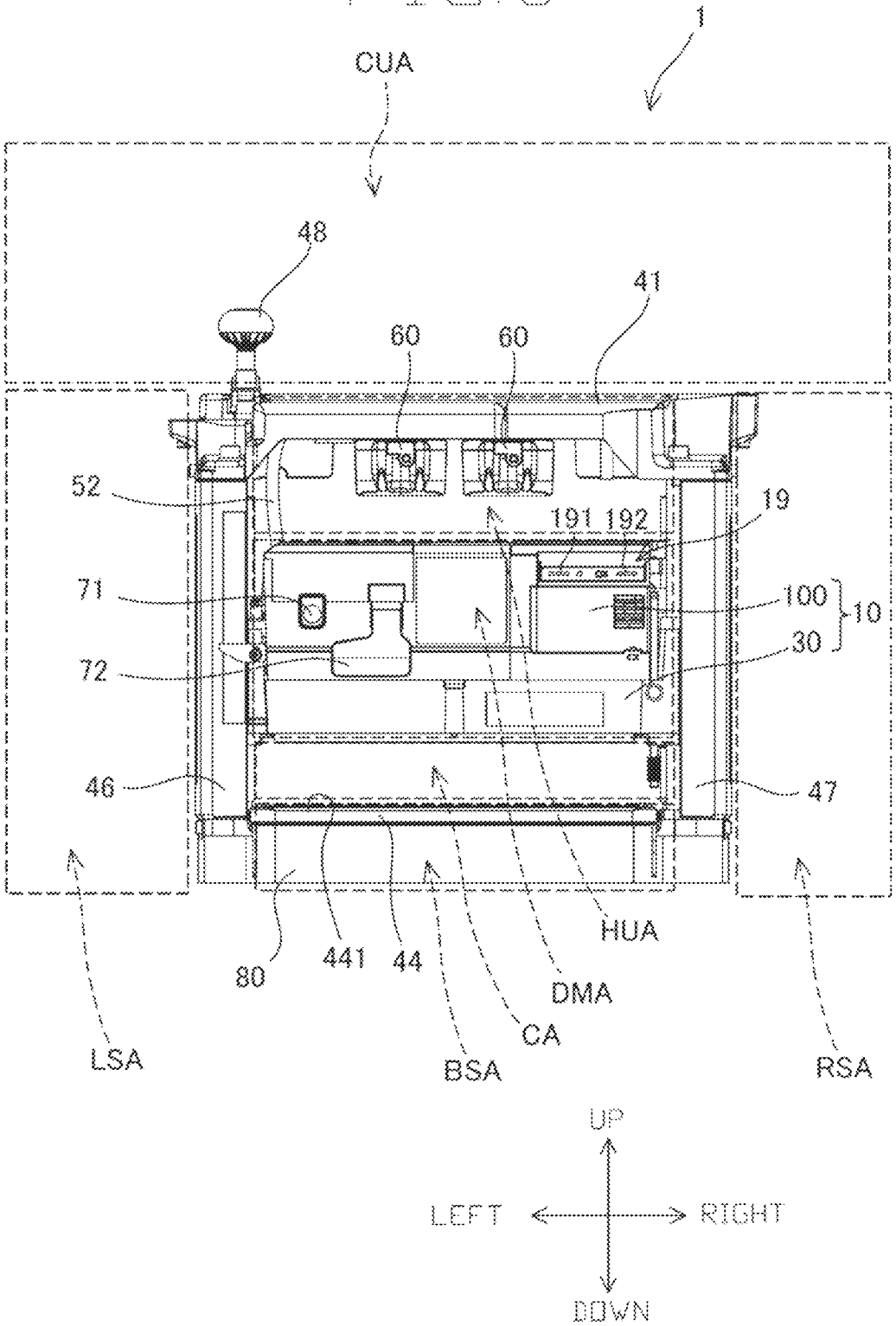
FIG. 3 is a front view of the thickness planer.

As described above, an area which is surrounded by the body unit 10, the table 43, the left side cover 46 and the right side cover 47 is defined as the cutting area (planing area) CA. Further, as shown in FIG. 2, an area through which the workpiece CM passes while being fed is defined as a feeding area TA. Furthermore, as shown in FIG. 3, an area above the top cover 41 including the lifting handle 48 is defined as a cover upper area CUA. An area above an upper end of a main housing 100 is defined as a housing upper area HUA. An area extending from a lower end of a main frame 30 of the body unit 10 to the upper end of the main housing 100 is defined as a driving mechanism arrangement area DMA. An area below the placing surface 431 of the table 43 is defined as a base area BSA. An area extending on the left side of the left side cover 46 is defined as a left side area LSA. An area extending on the right side of the right side cover 47 is defined as a right side area RSA.

In this embodiment, a battery pack mounting unit 50 is mounted in an area above the main housing 100 and below the top cover 41. In other words, the battery pack mounting unit 50 is mounted in the housing upper area HUA. Specifically, the battery pack mounting unit 50 is fastened to a lower surface of the top cover 41 by a plurality of screw parts. The battery pack mounting unit 50 is configured to be mounted such that two battery packs 60 is removably attached thereto. The battery packs 60 are attached and detached by being slid with respect to the battery pack mounting unit 50.

Figure 4:
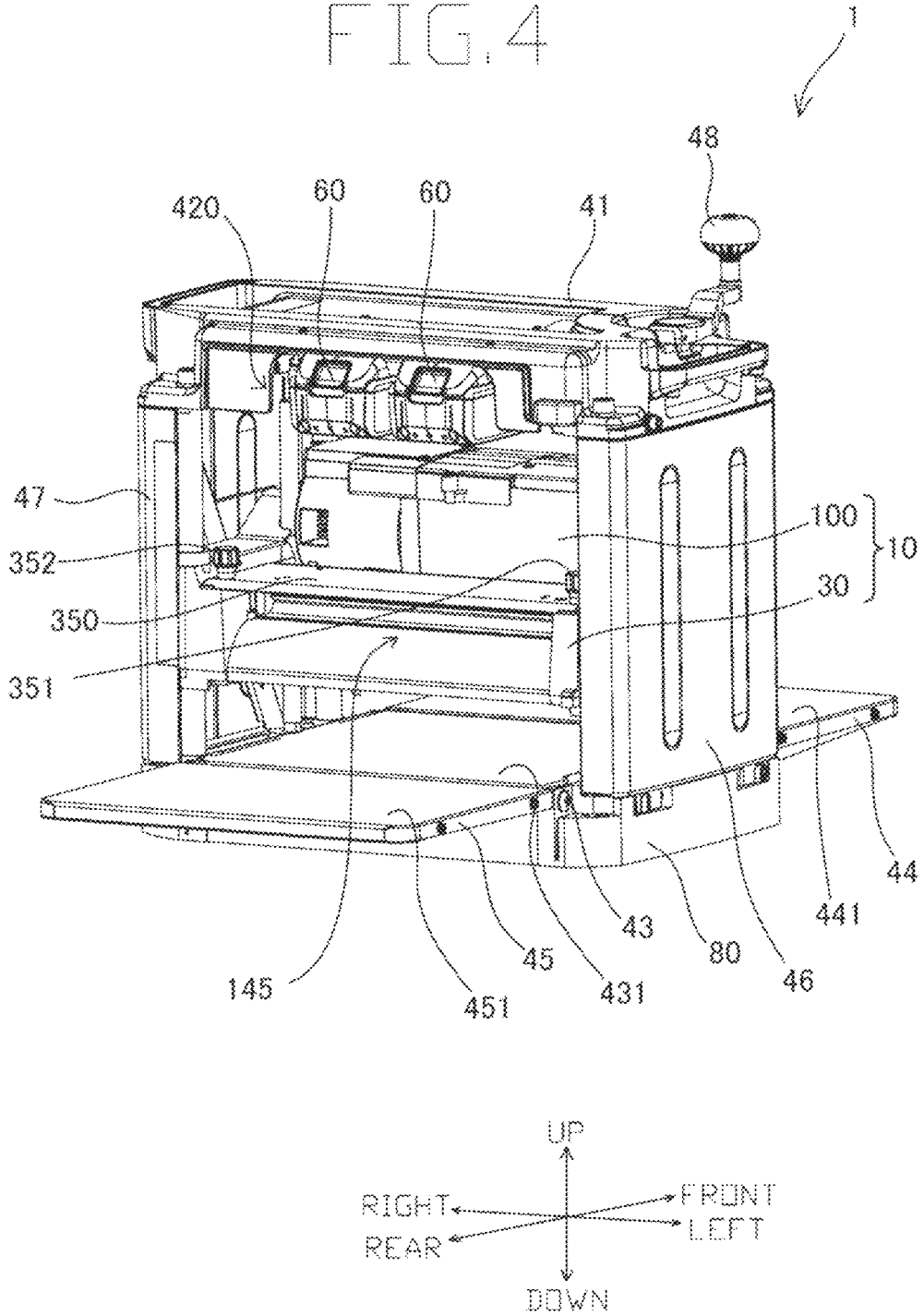
FIG. 4 is a rear perspective view of the thickness planer.
Figure 5:
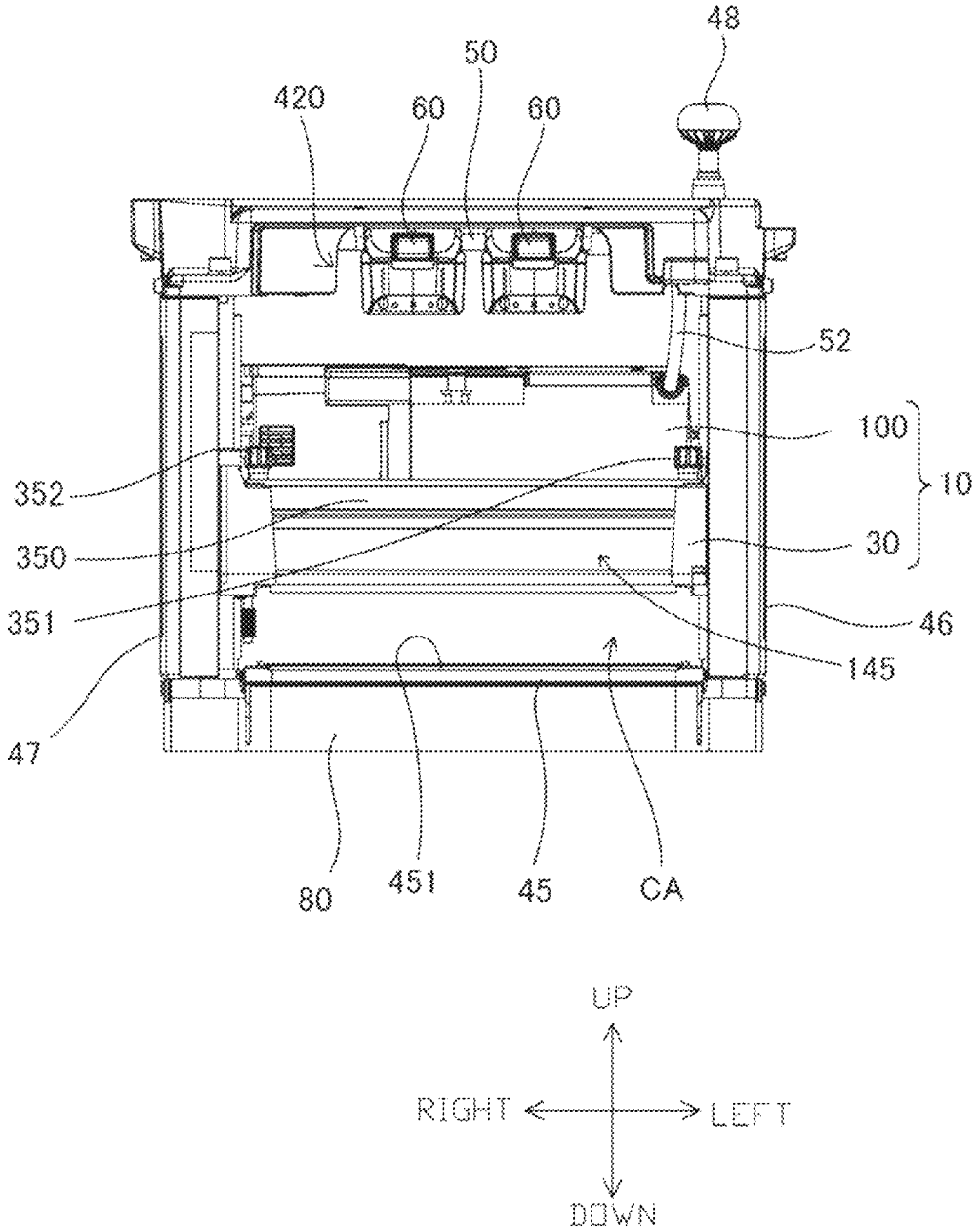
FIG. 5 is a rear view of the thickness planer.

As shown in FIGS. 4 and 5, the battery packs 60 are attached and detached by being slid in the front-rear direction with respect to the battery pack mounting unit 50 from the rear of the thickness planer 1. An arch-shaped escape part 420 is formed in a rear part of the top cover 41 and facilitates user's operation of attaching and detaching the battery pack 60.

The battery pack mounting unit 50 and the body unit 10 are electrically connected to each other by an electric cord 52. The thickness planer 1 in this embodiment has the rated voltage of 36 volts. The battery packs 60 each having a nominal voltage of 18 volts are electrically connected in series and attached to the battery pack mounting unit 50. The thickness planer 1 is driven by power supply from the battery packs 60 attached to the battery pack mounting unit 50. The battery pack mounting unit 50 and the battery pack 60 will be described below in detail.

As shown in FIG. 3, the body unit 10 includes the main housing 100 and the main frame 30. On the main housing 100, a residual capacity display part 19 is provided to display a battery residual capacity of each of the battery packs 60 attached to the battery pack mounting unit 50. The residual capacity display part 19 is provided with two residual capacity gauges 191 and 192. The residual capacity gauges 191 and 192 respectively display battery residual capacities of the two battery packs 60 attached to the battery pack mounting unit 50. The residual capacity gauge 191 has three LED lamps arranged in a row in the left-right direction. When the battery pack 60 associated with the residual capacity gauge 191 is fully charged, all of the three LED lamps illuminate. The three LED lamps are sequentially turned off as the battery residual capacity of the battery pack 60 decreases. The structure of the residual capacity gauge 192 has the same structure as the residual capacity gauge 191 and is not therefore described here.

Further, a main switch 71 and a lever switch 72 are provided on the main housing 100. When the main switch 71 is turned on, power is supplied up to the lever switch 72 in an electrical circuit from the battery packs 60 attached to the battery pack mounting unit 50 to a motor 15 described below. When the lever switch 72 is turned on while the main switch 71 is kept on, power is supplied to the motor 15 and the motor 15 starts rotating. Thus, the thickness planer 1 comes into a driven state ready for planing the workpiece CM.

The main switch 71 is a push-button alternate switch. Once pressed in the off state, the main switch 71 is turned on and kept in the on state, while once pressed in the on state, the main switch 71 is turned off and kept in the off state.

The lever switch 72 is pivotally supported around a pivot axis extending in the left-right direction by the main housing 100. When the lever switch 72 in the off state is turned upward by a prescribed angle around the pivot axis, the lever switch 72 is turned on and kept in the on state, while, when the lever switch 72 in the on state is turned downward around the pivot axis and returned to an initial position, the lever switch 72 is turned off and kept in the off state. In the thickness planer 1 shown in FIGS. 1 to 5, the lever switch 72 is in the off state. In the thickness planer 1 of this embodiment, the main switch 71 and the lever switch 72 are arranged adjacent to each other so as to provide ease of operation for a user.

When the workpiece CM is fed to the cutting area CA while the main switch 71 and the lever switch 72 are in the on state and the thickness planer 1 is driven, the thickness planer 1 planes the workpiece CM. Shavings generated when the thickness planer 1 planes the workpiece CM are discharged from a chip discharge port 145 provided in a rear part of the body unit 10. An air is jetted from the chip discharge port 145 and blows off the shavings discharged from the chip discharge port 145, thereby preventing the shavings from being accumulated in the vicinity of the chip discharge port 145. Further, a plate-like chip cover 350 is fastened to the main frame 30 above the chip discharge port 145 by screw parts 351, 352. The chip cover 350 prevents the scattering of the shavings discharged from the chip discharge port 145.

The detailed structure of the thickness planer 1 is now described with reference to FIGS. 6 to 10.

Figure 6:
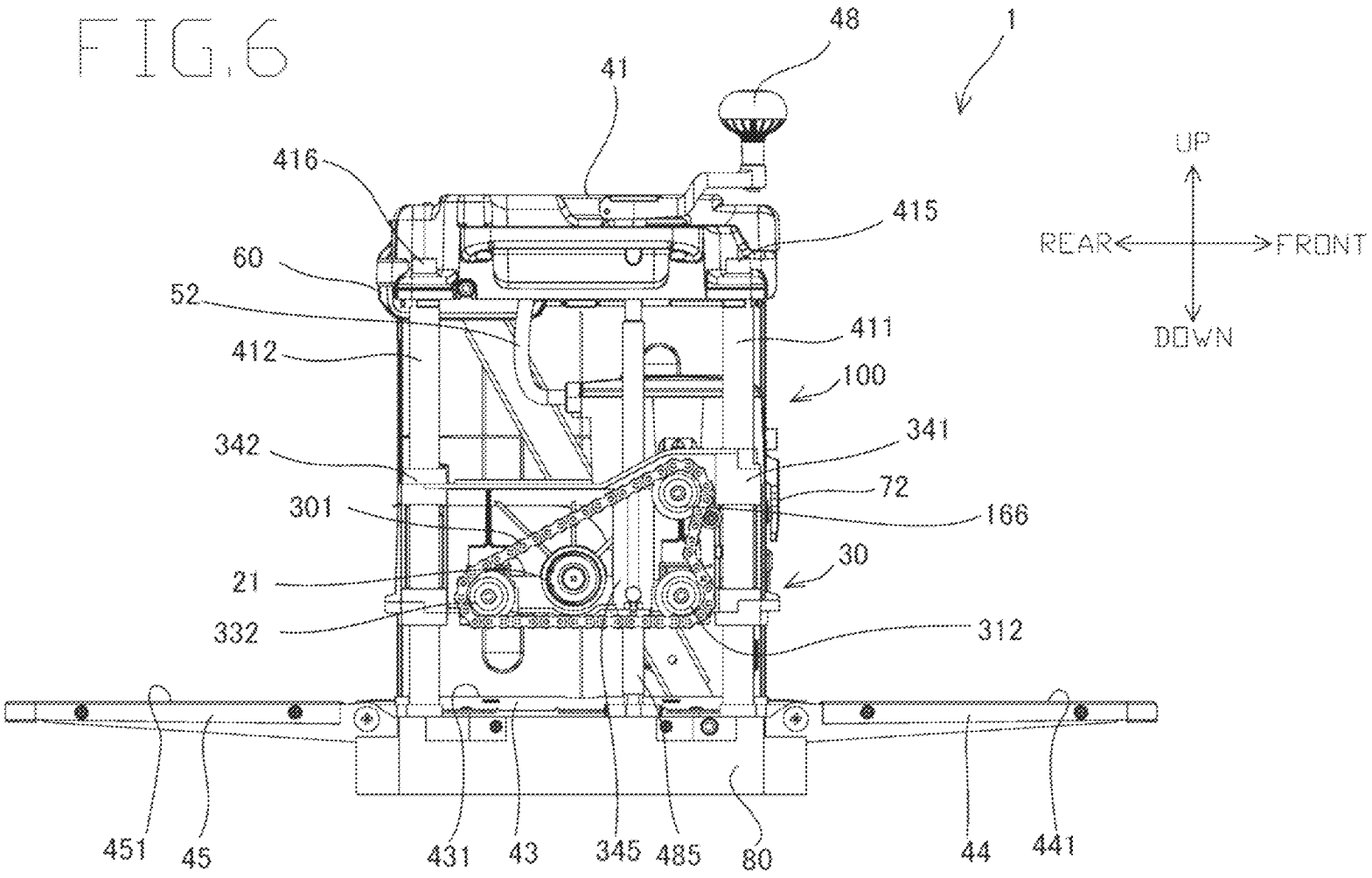
FIG. 6 is a left side view of the thickness planer with a left side cover removed.
Figure 7:
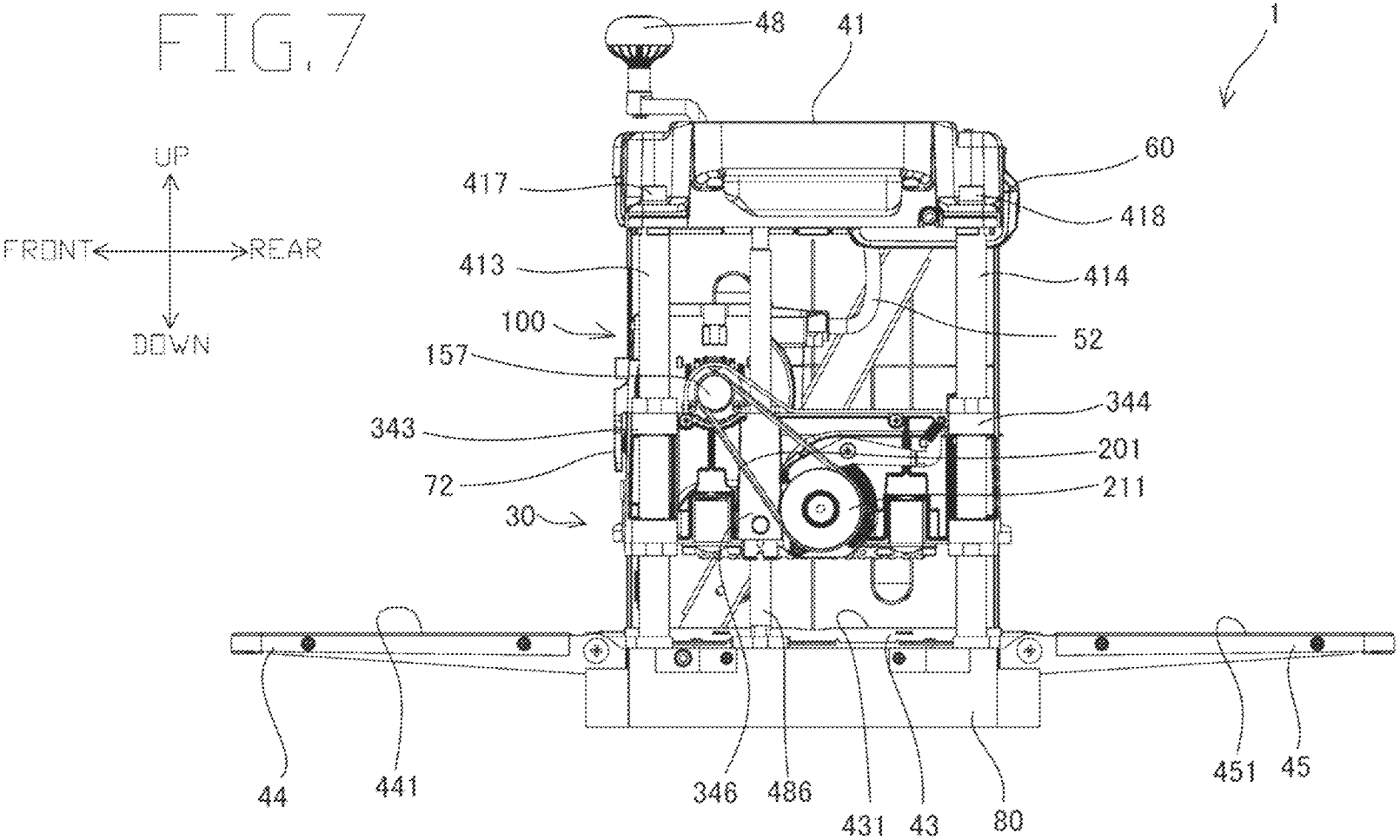
FIG. 7 is a right side view of the thickness planer with a right side cover removed.
Figure 8:
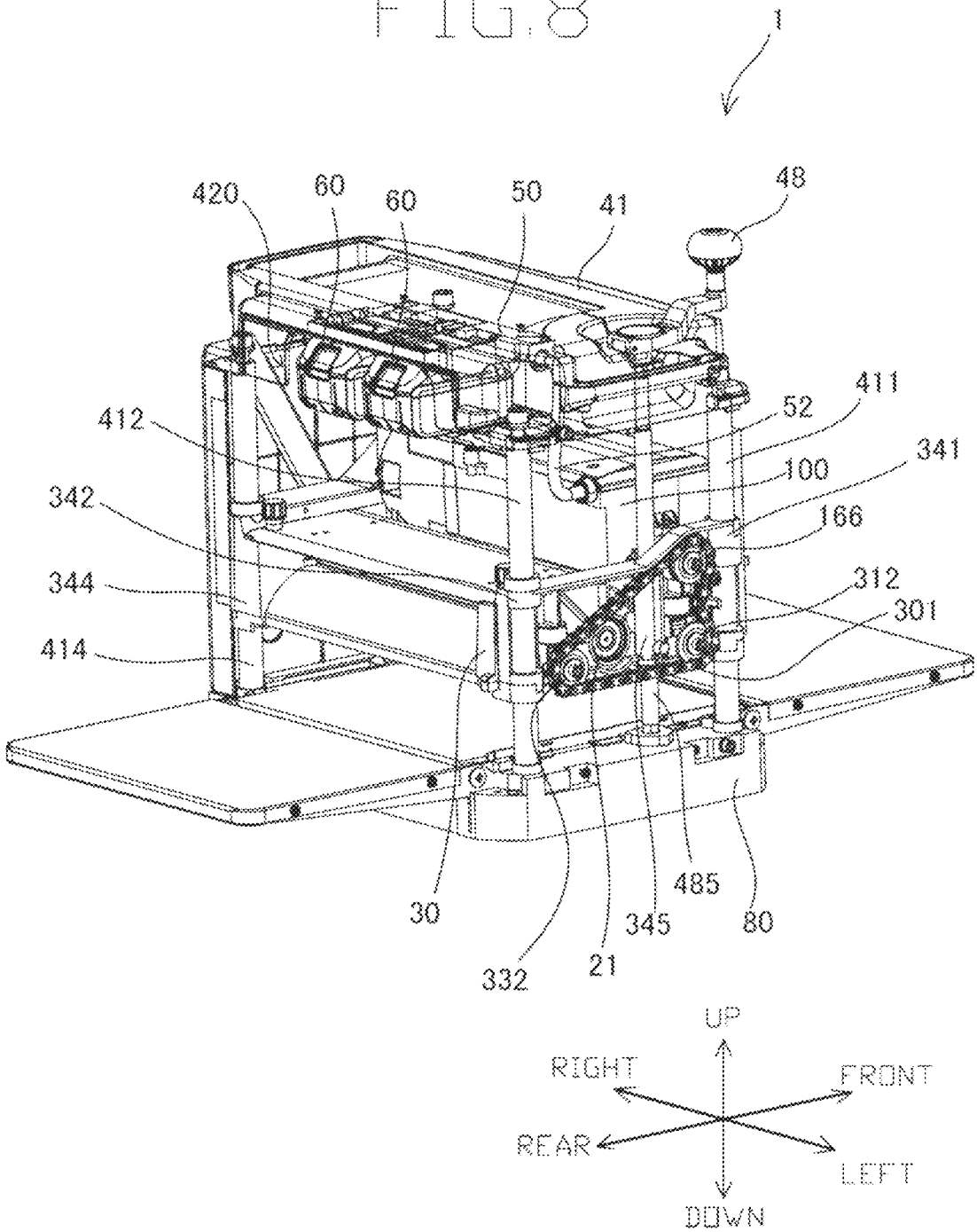
FIG. 8 shows the arrangement position of a battery pack mounting unit.

As shown in FIGS. 6 to 8, columns 411, 412, 413, 414 are erected vertically to the placing surface 431 in four corners of the base 80. Upper ends of the columns 411, 412, 413, 414 are fastened to the top cover 41 by screw parts 415, 416, 417, 418, respectively. Further, sliding parts 341, 342, 343, 344 are respectively provided on four corners of the main frame 30 and slidable in the vertical direction with respect to the columns 411, 412, 413, 414. The sliding parts 341, 342, 343, 344 have respective through holes through which the columns 411, 412, 413, 414 are respectively slidably inserted.

On left and right end parts of the base 80, lifting screw shafts 485, 486 are erected vertically to the placing surface 431 so as to be rotatable via respective bearing members provided on the placing surface 431. Lower end parts of the lifting screw shafts 485, 486 both protrude downward from the base 80. A space (lower side area) is formed on the lower side of the base 80. The lifting shaft (not shown) which is a rotation axis extending in the left-right direction is arranged in the lower side area of the base 80. The lifting shaft connects the lower end parts of the lifting screw shafts 485, 486. The lifting shaft is provided to synchronize rotation of the lifting screw shaft 485 and rotation of the lifting screw shaft 486. The lifting shaft converts rotation of the lifting screw shaft 485 around a rotation axis extending in the vertical direction into rotation around a rotation axis extending in the left-right direction and further converts this rotation into rotation around a rotation axis extending in the vertical direction, thereby rotating the lifting screw shaft 486.

Lifting screw hole parts 345, 346 are provided in left and right end parts of the main frame 30. The lifting screw hole parts 345, 346 have respective through holes extending therethrough in the vertical direction and the lifting screw shafts 485, 486 are rotatably threadedly engaged with the through holes, respectively. As shown in FIG. 8, an upper end part of the lifting screw shaft 485 extends through the top cover 41 and is connected to the lifting handle 48. When the lifting handle 48 is turned by a user, the lifting screw shaft 485 rotates together with the lifting handle 48. Further, the lifting screw shaft 486 rotates in synchronization with the rotation of the lifting screw shaft 485. When the lifting screw shafts 485, 486 are rotated, the lifting screw hole parts 345, 346 receive force in an upward or downward direction from the lifting screw shafts 485, 486 and thus the main frame 30 slides upward or downward. By upward or downward slide of the main frame 30, the body unit 10 slides upward or downward, so that the length of the cutting area CA in the vertical direction is changed. In this manner, the length of the cutting area CA in the vertical direction is changed by user's operation of rotating the lifting handle 48.

Next, the body unit 10 is described in detail.

Figure 9:
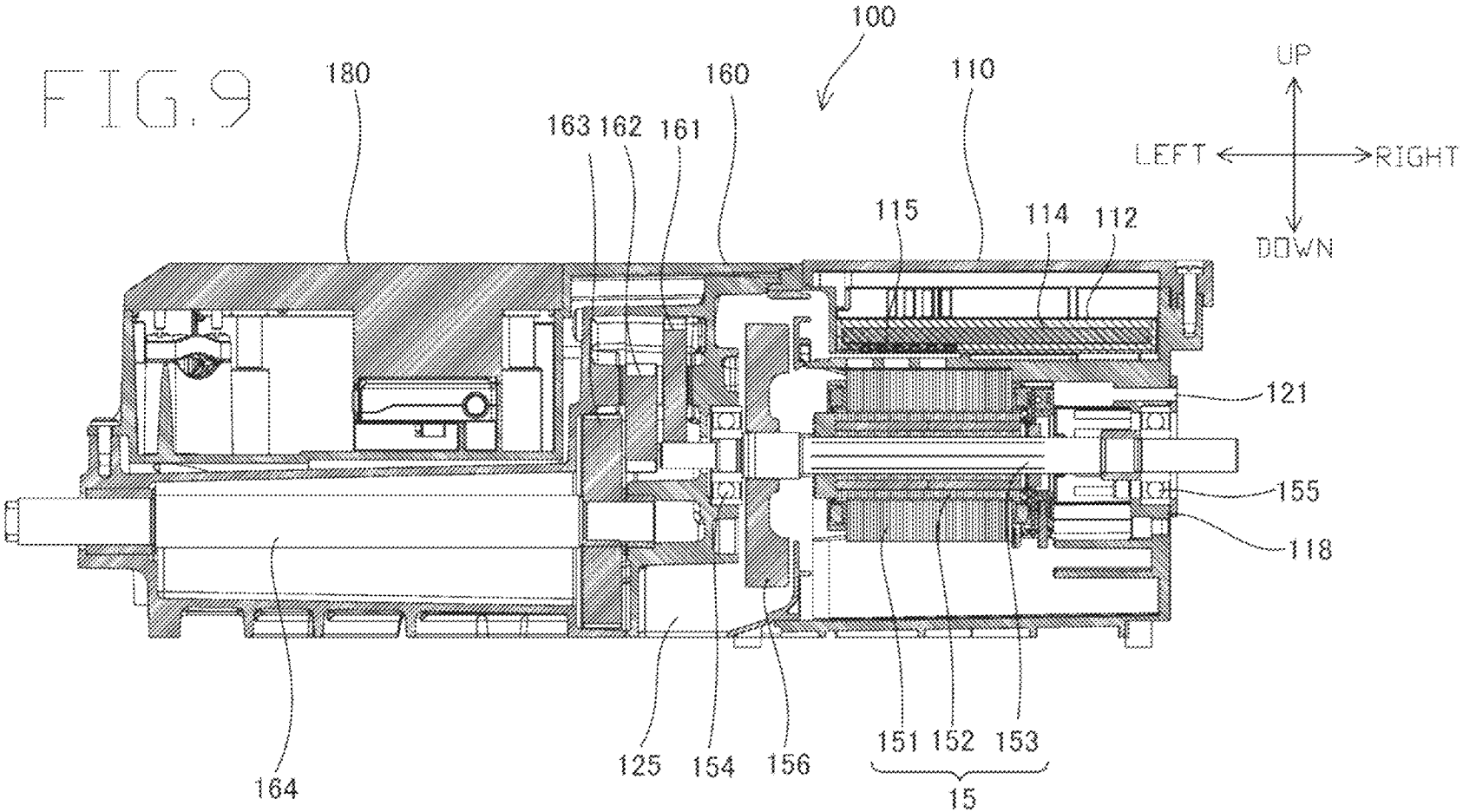
FIG. 9 shows the internal structure of a main housing.

As shown in FIG. 9, the main housing 10 has a first housing 110, a second housing 160 and a third housing 180. The motor 15 and a controller 112 are housed in the first housing 110. The controller 112 has a control board 114 for controlling driving of the motor 15. The control board 114 has a transistor 115 for switching the current flowing to the motor 15. In this embodiment, an FET (Field Effect Transistor) is adopted as the transistor 115. The control board 114 controls driving of the motor 15 by PWM (Pulse Width Modulation) control using the transistor 115.

The motor 15 is disposed below the controller 112. In this embodiment, a brushless motor having a stator 151, a rotor 152 and a motor shaft 153 extending from the rotor 152 is adopted as the motor 15. The motor shaft 153 extending in the left-right direction is rotatably supported at its left and right end parts by bearings 154, 155. In this embodiment, when the motor 15 and the bearing 155 are assembled into the first housing 110, the motor shaft 153 is inserted into the first housing 110 from the outside of a right end wall part 118 of the first housing 110. After the motor shaft 153 is inserted into the first housing 110, the bearing 155 is mounted to the first housing 110 from the outside of the right end wall part 118 so as to journal the motor shaft 153.

A fan 156 is provided onto the motor shaft 153 between the bearing 154 and the rotor 152. The fan 156 rotates together with the motor shaft 153 around a rotation axis of the motor shaft 153. The main housing 100 has an intake port 121 and an outlet port 125. Further, an air flow passage is formed in the main housing 100 to provide communication between the intake port 121 and the outlet port 125. The fan 156 generates flow of air from the intake port 121 to the outlet port 125 through the air flow passage. The air flowing through the air flow passage cools the motor 15 and the controller 112.

Figure 10:
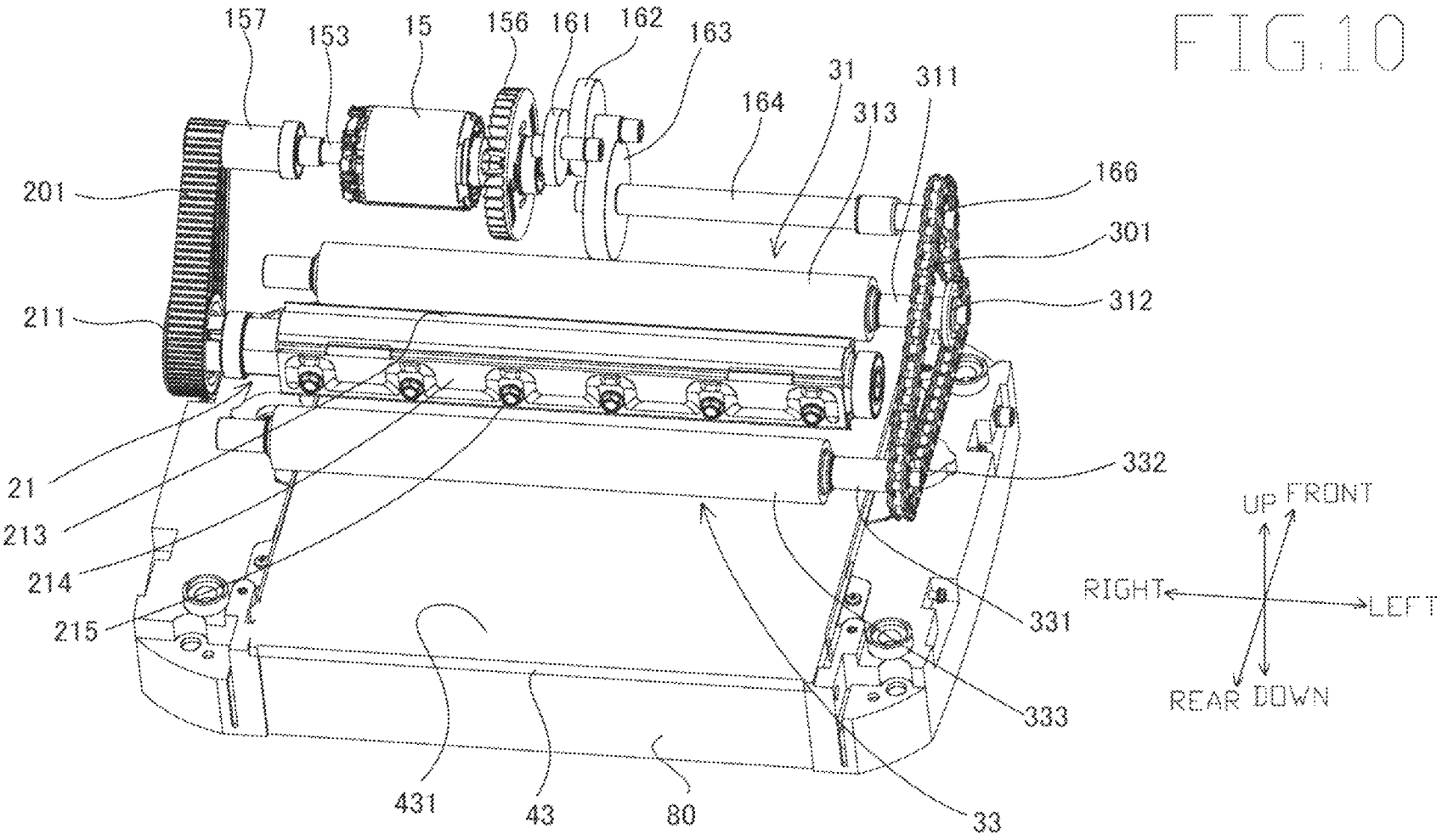
FIG. 10 is an explanatory drawing showing a driving mechanism of the thickness planer.

Gears 161, 162, 163 are housed in the second housing 160. Each of the three gears 161, 162, 163 is configured to be rotatable around a rotation axis parallel to the rotation axis of the motor shaft 153. A left end part of the motor shaft 153 protrudes into the second housing 160 and the gear 161 is engaged with this protruding part. The gear 161 engages with the gear 162 and the gear 162 engages with the gear 163. A drive shaft 164 is housed in the third housing 180 and a right end part of the drive shaft 164 is integrally connected to the gear 163. The drive shaft 164 is configured to be rotatable around a rotation axis parallel to the rotation axis of the motor shaft 153. The drive shaft 164 rotates together with the gear 163. Rotational power (speed) of the motor 15 is appropriately changed via the gears 161, 162, 163 and then transmitted to the drive shaft 164. As shown in FIG. 10, a gear 166 is connected to a left end part of the drive shaft 164 and rotates together with the drive shaft 164. A chain 301 is looped over the gear 166. Feed rollers 31, 33 are housed in the main frame 30. The chain 301 is looped over a gear 312 of the feed roller 31 and a gear 332 of the feed roller 33. Rotational power of the drive shaft 164 is transmitted to the feed roller 31 via the gear 166, the chain 301 and the gear 312 and also transmitted to the feed roller 33 via the gear 166, the chain 301 and the gear 332.

As shown in FIG. 10, a cutter head 21 for planing the workpiece CM and the feed rollers 31, 33 for feeding the workpiece CM are disposed in the main frame 30. The feed roller 31 is disposed in front of the cutter head 21 and the feed roller 33 is disposed behind the cutter head 21. The feed roller 31 has a shaft 311, a gear 312 and a roller part 313. The shaft 311 is configured to be rotatable around a rotation axis extending in the left-right direction. The gear 312 is integrally connected to a left end part of the shaft 311. The roller part 313 is provided peripherally around the rotation axis of the shaft 311 and comes into contact with the workpiece CM when feeding the workpiece CM. The feed roller 33 has a shaft 331, a gear 332 and a roller part 333. The shaft 331 is configured to be rotatable around a rotation axis extending in the left-right direction. The roller part 333 is provided peripherally around the rotation axis of the shaft 331 and comes into contact with the workpiece CM when feeding the workpiece CM. The roller parts 313, 333 are configured to transmit rotating forces of the feed rollers 31, 33 as driving force to the workpiece CM.

As shown in FIG. 10, a pulley 157 is connected to a right end part of the motor shaft 153 so as to rotate together with the motor shaft 153. A belt 201 is looped over the pulley 157. The belt 201 is looped over a pulley 211 of the cutter head 21. The rotating power (speed) of the motor 15 is appropriately changed via the pulley 157, the belt 201 and the pulley 211 and is transmitted to the cutter head 21.

The cutter head 21 is configured to be rotatable around a rotation axis extending in the left-right direction. Plane blades 213, 214 are provided extending in parallel to the rotation axis on a periphery of the cutter head 21. The plane blades 213, 214 are fastened to the cutter head 21 by a plurality of screw parts 215 in symmetrical positions with respect to the rotation axis of the cutter head 21. A pulley 211 is connected to a right end part of the cutter head 21 so as to rotate together with the cutter head 21. As described above, the cutter head 21 is rotated by the rotational power of the motor 15 which is transmitted via the pulley 157, the belt 201 and the pulley 211. The plane blades 213, 214 of the cutter head 21 plane the workpiece CM which is fed rearward from the front by the feed rollers 31, 33.

Next, the battery pack mounting unit 50 and the battery pack 60 are described with reference to FIGS. 8 and 11 to 14.

Each of the battery packs 60 has a nominal voltage of 18 volts and is used as a power source for the thickness planer 1. The battery pack 60 can also be used as a power source for power tools other than the thickness planer 1, including an electric drill, an electric driver, an electric wrench, an electric grinder, an electric circular saw, an electric reciprocating saw, an electric jigsaw, an electric hammer, an electric cutter, an electric chainsaw, an electric planer, an electric nailing machine, an electric hedge trimmer, an electric lawn clipper, an electric lawnmower, an electric bush cutter, an electric blower and an electric cleaner.

The battery pack 60 can be referred to as a battery package or an assembled battery. The battery pack 60 has an outer housing formed into a prescribed size and five lithium-ion battery cells which are housed within the outer housing and connected in series. The battery pack 60 is rechargeable and can be recharged with a charger (not shown) after used as a power source for the thickness planer 1 or other power tools. The battery pack 60 is a so-called slide-type battery pack and can be removably attached to the battery pack mounting unit 50 of the thickness planer 1 and the charger.

Figure 12:
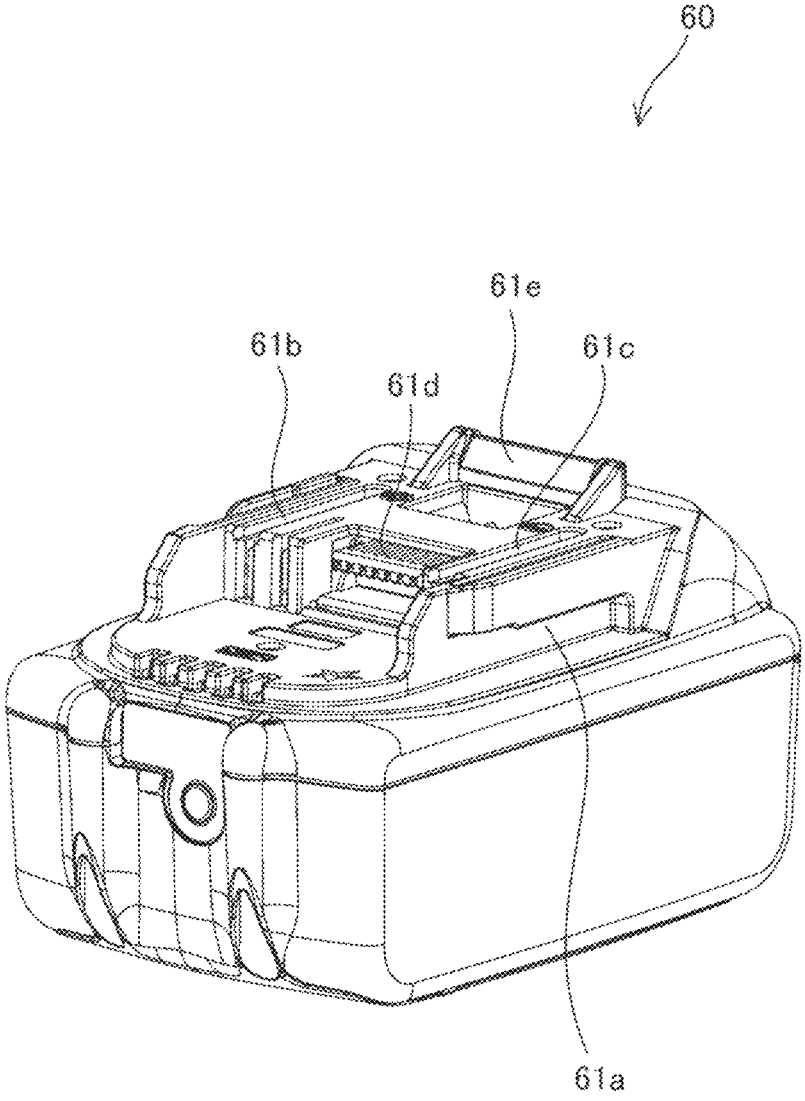
FIG. 12 shows a battery pack.
Figure 13:
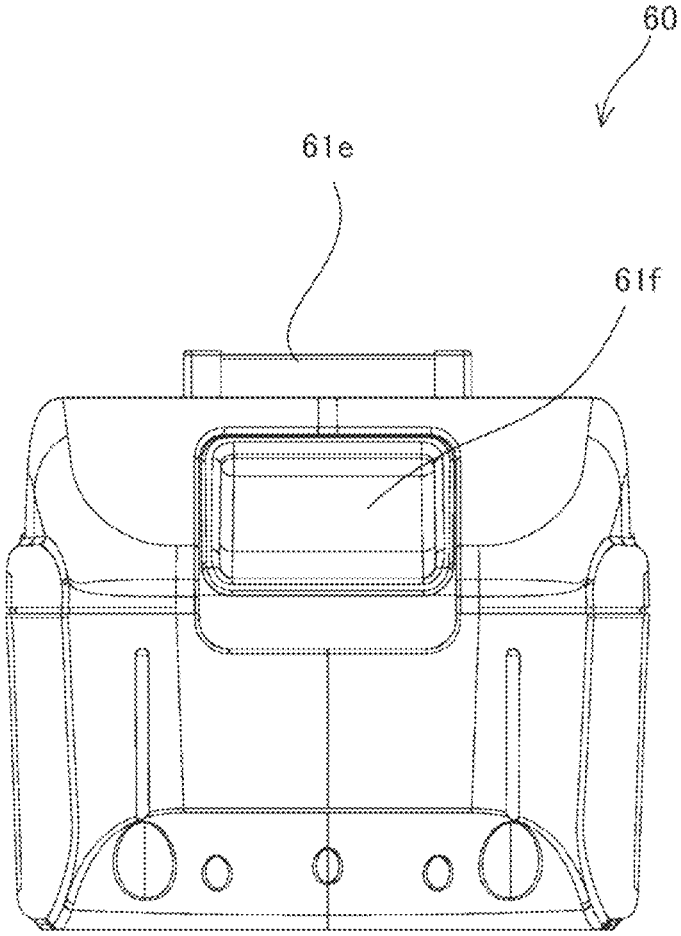
FIG. 13 is a rear view of the battery pack.

As shown in FIG. 12, a pair of left and right rail receiving parts 61*a* are provided in the battery pack 60. In the following description, the side of the battery pack 60 on which the rail receiving parts 61*a* are disposed is defined as an upper side of the battery pack 60 and the side opposite to the upper side of the battery pack 60 is defined as a lower side of the battery pack 60. A positive output terminal 61*b* and a negative output terminal 61*c* are arranged between the left and right rail receiving parts 61*a*. Between the positive output terminal 61*b* and the negative output terminal 61*c*, a connector part 61 is arranged to transmit/receive a control signal to/from the charger when the battery pack 60 is charged by the charger. Further, a lock member 61*e* is provided on an upper part of the battery pack 60 and a spring member (not shown) is arranged below the lock member 61*e* within the housing of the battery pack 60. This spring member biases the lock member 61*e* upward. An unlock button 61*f* is arranged on a back side of the battery pack 60 and the lock member 61*e* moves downward when the unlock button 61*f* (see FIG. 13) is pressed down.

Figure 11:
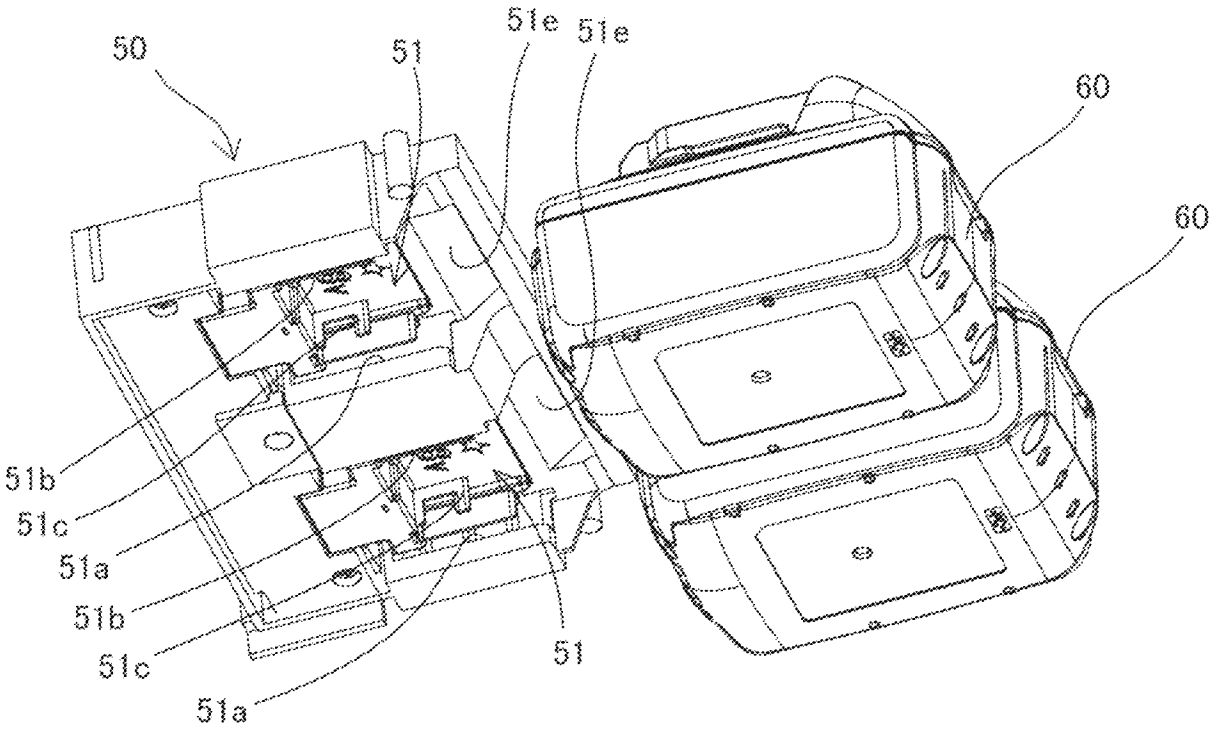
FIG. 11 shows the battery pack mounting unit.

As shown in FIG. 11, the battery pack mounting unit 50 has two mounting parts 51 having the same structure. The mounting parts 51 is electrically connected in series. Therefore, in the battery pack mounting unit 50, the battery packs 60 each having a nominal voltage of 18 volts can be connected in series. As described above, the thickness planer 1 has the rated voltage of 36 volts, and the thickness planer 1 can be driven by power supply from the battery pack mounting unit 50 to which the two battery packs 60 are attached. A pair of left and right rail parts 51*a* are provided in each of the mounting parts 51. A positive input terminal 51*b* and a negative input terminal 51*c* are arranged between the rail parts 51*a*. Further, a lock receiving hole 51*e* is provided in the mounting part 51 to be engaged with the lock member 61*e* of the battery pack 60.

In order to attach the battery pack 60 to the mounting part 51, the battery pack 60 is slid in a mounting direction with respect to the mounting part 51 such that the rail receiving part 61*a* is engaged with the rail part 51*a*. Further, in the following description, a direction along the rail part 51*a* of the battery pack mounting unit 50 is defined as a sliding direction. When the battery pack 60 is attached to the mounting part 51, the positive input terminal 51*b* and the negative input terminal 51*c* of the mounting part 51 are electrically connected to the positive output terminal 61*b* and the negative output terminal 61*c* of the battery pack 60, respectively. Further, when the battery pack 60 is attached to the mounting part 51, the lock member 61*e* is engaged with the lock receiving hole 51*e*, so that the battery pack 60 is fixed and locked so as to be unmovable in the sliding direction.

When the unlock button 61*f* of the battery pack 60 mounted to the mounting part 51 is pressed down by a user, the battery pack 60 is disengaged from the lock receiving hole 51*e* (the battery pack 60 is unlocked). In the unlocked state, the battery pack 60 is removed from the mounting part 51 by being slid in a removing direction with respect to the mounting part 51. In this manner, the battery pack 60 can be removably attached to the mounting part 51 of the battery pack mounting unit 50.

A mounting position of the battery pack mounting unit 50 in the thickness planer 1 of this embodiment is described in detail with reference to FIGS. 8 and 14.

The battery pack mounting unit 50 is arranged in the thickness planer 1 such that the battery pack mounting unit 50 and the battery pack 60 lie in a position avoiding the feeding area TA (see FIG. 2). In this embodiment, the battery pack mounting unit 50 and the battery pack 60 are arranged in the housing upper area HUA (see FIG. 3). Specifically, the battery pack mounting unit 50 is arranged above the main housing 100 and below the top cover 41. As shown in FIG. 14, in the thickness planer 1 of this embodiment, a length HL of the main housing 100 in the front-rear direction is shorter than a length FL of the main frame 30 in the front-rear direction and the main housing 100 is arranged in a front part of an area above the main frame 30. Thus, a free space exists in a rear part of the area above the main frame 30. Therefore, in this embodiment, the battery pack mounting unit 50 is fixed to a rear part of a lower surface of the top cover 41 by a plurality of screw parts. By provision of such a structure, when the body unit 10 is raised up to a highest position with respect to the table 43, the battery pack 60 and the battery pack mounting unit 50 are fitted in this free space and thus avoided from getting into contact with the body unit 10.

In this embodiment, the battery pack mounting unit 50 is mounted to the top cover 41 with the mounting part 51, the rail parts 51*a*, the positive input terminal 51*b* and the negative input terminal 51*c* facing downward. Specifically, the battery pack 60 is attached to the battery pack mounting unit 50 with the rail receiving part 61*a*, the positive output terminal 61*b* and the negative output terminal 61*c* facing upward.

As described above, the battery pack mounting unit 50 and the main housing 100 are connected to each other by an electric cord 52. In this embodiment, the electric cord 52 is extended from the battery pack mounting unit 50 in a direction twisted with respect to the direction in which the electric cord 52 is extended from the main housing 100. Specifically, as shown in FIG. 8, the electric cord 52 is extended from the battery pack mounting unit 50 in the left-right direction, while the electric cord 52 is extended from the main housing 100 in the front-rear direction. In other words, when viewed from above, the direction in which the electric cord 52 is extended from the battery pack mounting unit 50 is substantially perpendicular to the direction in which the electric cord 52 is extended from the main housing 100. By provision of such a structure, when the distance between the main housing 100 and the battery pack mounting unit 50 is shortened as the body unit 10 is raised with respect to the table 43, the surplus length of the electric cord 52 with respect to the distance between the main housing 100 and the battery pack mounting unit 50 escapes into a free space existing behind the main housing 100 and on the left side of the battery pack mounting unit 50 while being gently curved or bent. Thus, when the body unit 10 is raised, the electric cord 52 is avoided from being sharply curved or bent.

Figure 14:
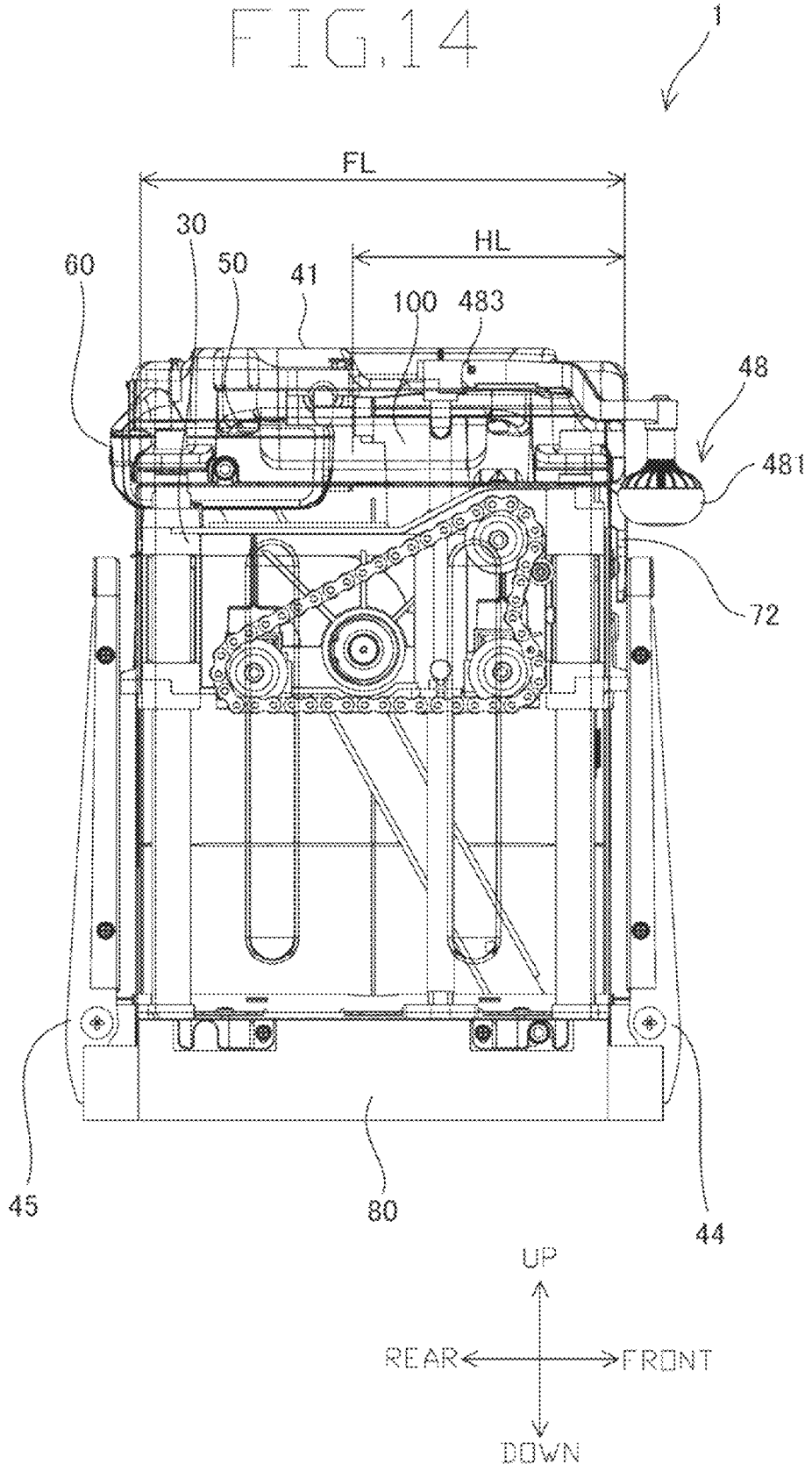
FIG. 14 is a partly cutaway left side view of the thickness planer when stored.

As shown in FIG. 14, when the thickness planer 1 is transported or stored, the front auxiliary table 44 and the rear auxiliary table 45 are turned upward around a pivot axis extending in the left-right direction so as to be folded upward from the front and rear ends of the table 43 (closed). The thickness planer 1 of this embodiment is configured such that rear end parts of the battery pack mounting unit 50 and the battery pack 60 are located forward (inward) of a rear end of the closed rear auxiliary table 45. Therefore, the battery pack mounting unit 50 and the battery pack 60 are avoided from getting into contact with external elements such as a user and surrounding equipment during transportation or storage of the thickness planer 1.

The lifting handle 48 is provided on an upper surface of the top cover 41 and supported by a pivot shaft 483. When the thickness planer 1 is used, as shown in FIG. 4, the lifting handle 48 is turned around the pivot shaft 483 such that an operation part 481 of the lifting handle 48 faces upward. On the other hand, when the thickness planer 1 is transported or stored, as shown in FIG. 14, the lifting handle 48 is turned around the pivot shaft 483 and folded such that the operation part 481 of the lifting handle 48 faces downward. When the lifting handle 48 is folded, an upper end of the lifting handle 48 is located below an upper end of the top cover 41. By provision of such a structure, the lifting handle 48 is avoided from getting into contact with external elements such as a user and surrounding equipment during transportation or storage of the thickness planer 1.

As described above, the thickness planer 1 of this embodiment has the battery pack mounting unit 50 for mounting the battery pack 60. Thus, with the battery pack 60 being attached to the battery pack mounting unit 50, power can be supplied to the motor 15 to drive the thickness planer 1. Therefore, the thickness planer 1 can be driven without an external power source, so that the convenience of the thickness planer 1 is enhanced.

In this embodiment, the battery pack mounting unit 50 is configured such that the battery pack mounting unit 50 and the battery pack 60 attached to the battery pack mounting unit 50 lie in a position avoiding the feeding area TA. Specifically, the battery pack mounting unit 50 and the battery pack 60 are arranged in the housing upper area HUA. Particularly, in this embodiment, the battery pack mounting unit 50 is arranged above the main housing 100. Therefore, during planing operation by a user, the workpiece CM is avoided from getting into contact with the battery pack mounting unit 50 and the battery pack 60 while being fed, so that decrease in working efficiency is avoided. Further, the user's view of the cutter head 21 (or the cutting area CA) is avoided from being obstructed by the battery pack mounting unit 50 and the battery pack 60, so that a user can easily check how the workpiece CM is being planed. As a result, the working efficiency of a user is prevented from lowering due to provision of the battery pack mounting unit 50 and the battery pack 60 in the thickness planer 1.

The battery pack mounting unit 50 and the battery pack 60 are surrounded on the upper and lower sides and the left and right sides by other members. Specifically, the top cover 41, the main housing 100 and the left and right side covers 46, 47 are arranged above and below and on the left and right sides of the battery pack mounting unit 50 and the battery pack 60, respectively. Therefore, the battery pack mounting unit 50 and the battery pack 60 are avoided from getting into contact with external elements such as a user and surrounding equipment during planing operation and transportation.

In this embodiment, the battery pack mounting unit 50 is arranged below the top cover 41. Therefore, the size of a portion of the thickness planer 1 above the top cover 41 (the length of the thickness planer 1 in the vertical direction) is avoided from increasing due to arrangement of the battery pack mounting unit 50. As a result, the thickness planer 1 realizes space saving when stored.

In this embodiment, the battery pack mounting unit 50 is mounted to the lower surface of the top cover 41, so that the battery pack mounting unit 50 and the battery pack 60 are adequately protected from impact and contact from above the top cover 41.

The thickness planer 1 of this embodiment is configured such that the rear end parts of the battery pack mounting unit 50 and the battery pack 60 are located forward (inward) of the rear end of the closed rear auxiliary table 45. Therefore, the battery pack mounting unit 50 and the battery pack 60 are avoided from getting into contact with external elements such as a user and surrounding equipment during transportation or storage of the thickness planer 1. Thus, according to this embodiment, the storability and portability of the thickness planer 1 are improved.

In the thickness planer 1 of this embodiment, the lifting handle 48 is configured to be turned around the pivot shaft 483 and folded such that the operation part 481 of the lifting handle 48 faces downward. When the lifting handle 48 is folded, the upper end of the lifting handle 48 is located below the upper end of the top cover 41. By provision of such a structure, the lifting handle 48 is avoided from getting into contact with external elements such as a user and surrounding equipment during transportation or storage of the thickness planer 1. Therefore, the thickness planer 1 is provided with improved storability and portability.

The battery pack mounting unit 50 is configured such that the battery pack 60 is removably attached thereto. Therefore, when the residual capacity of the battery pack 60 which supplies power to the thickness planer 1 is reduced, this battery pack 60 can be easily replaced with a fully charged battery pack 60. Further, the battery pack 60 is attached with its upper surface facing upward. Therefore, a user can attach and detach the battery pack 60 while supporting the weight of the battery pack 60 by a hand. Particularly, when detaching the battery pack 60, the user can hold the battery pack 60 detached from the battery pack mounting unit 50 on a palm of the user, so that the user does not have to handle the battery pack 60 with too much care.

In this embodiment, the battery pack mounting unit 50 is configured such that the two battery packs 60 can be attached thereto and the battery packs 60 attached to the battery pack mounting unit 50 are electrically connected to the motor 15 in series. Specifically, the two battery packs 60 each having a nominal voltage (18 volts) lower than the rated voltage (36 volts) of the thickness planer 1 are attached to the battery pack mounting unit 50 to drive the thickness planer 1. Therefore, the battery packs 60 having a nominal voltage lower than the rated voltage of the thickness planer 1 are effectively used.

The battery pack 60 can also be used as a power source for other power tools. Therefore, when other power tools are used, a new battery pack need not be prepared and the battery pack 60 to be used for the thickness planer 1 can be further effectively used.

In this embodiment, the main switch 71 and the lever switch 72 are arranged on the front side of the thickness planer 1. During planing operation, the workpiece CM is fed to the cutting area CA from the front of the thickness planer 1. Therefore, a user normally starts an operation in front of the thickness planer 1. In this case, when a user starts the operation, the main switch 71 and the lever switch 72 are located in front of the user. Therefore, according to this embodiment, operability of the thickness planer 1 is improved.

Particularly, in this embodiment, the main switch 71 and the lever switch 72 are arranged adjacent to each other on the front side of the thickness planer 1, so that the operability of the thickness planer 1 is further improved.

Further, in this embodiment, the residual capacity display part 19 is arranged on the front side of the thickness planer 1, so that a user can perform a planing operation while checking the residual capacity of the battery pack 60. Therefore, convenience of the thickness planer 1 is improved.

In this embodiment, the electric cord 52 is extended from the battery pack mounting unit 50 in a direction twisted with respect to the direction in which the electric cord 52 is extended from the main housing 100. Further, in this embodiment, when viewed from above, the direction in which the electric cord 52 is extended from the battery pack mounting unit 50 is substantially perpendicular to the direction in which the electric cord 52 is extended from the main housing 100. Therefore, when the body unit 10 is raised, the electric cord 52 escapes into a free space existing behind the main housing 100 and on the left side of the battery pack mounting unit 50 while being gently curved or bent, thereby being avoided from being sharply curved or bent. Thus, deterioration of the electric cord 52 is suppressed, so that durability of the thickness planer 1 is improved.

Second Embodiment

Figure 15:
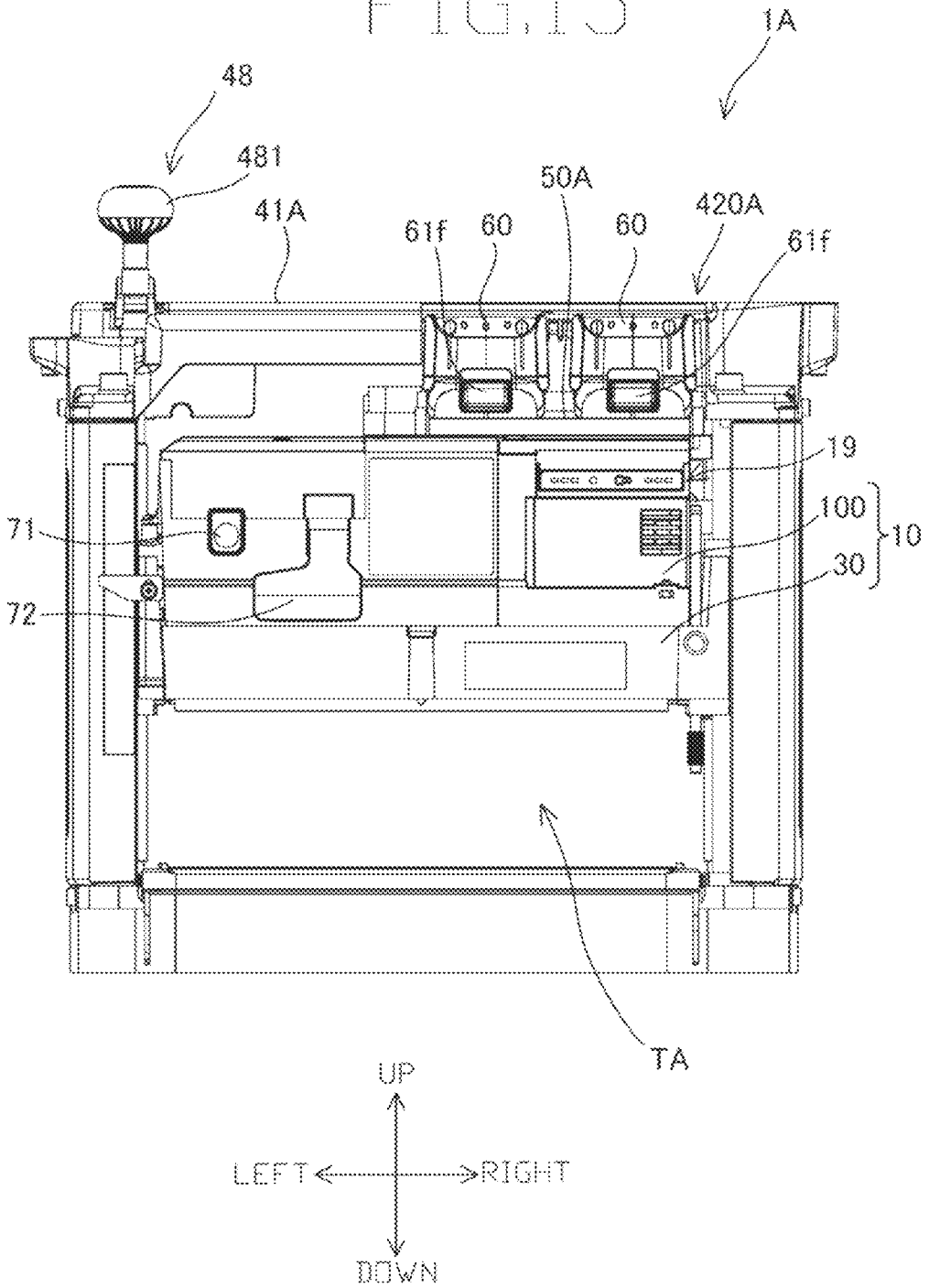
FIG. 15 is a front view of a thickness planer of a second embodiment.
Figure 16:
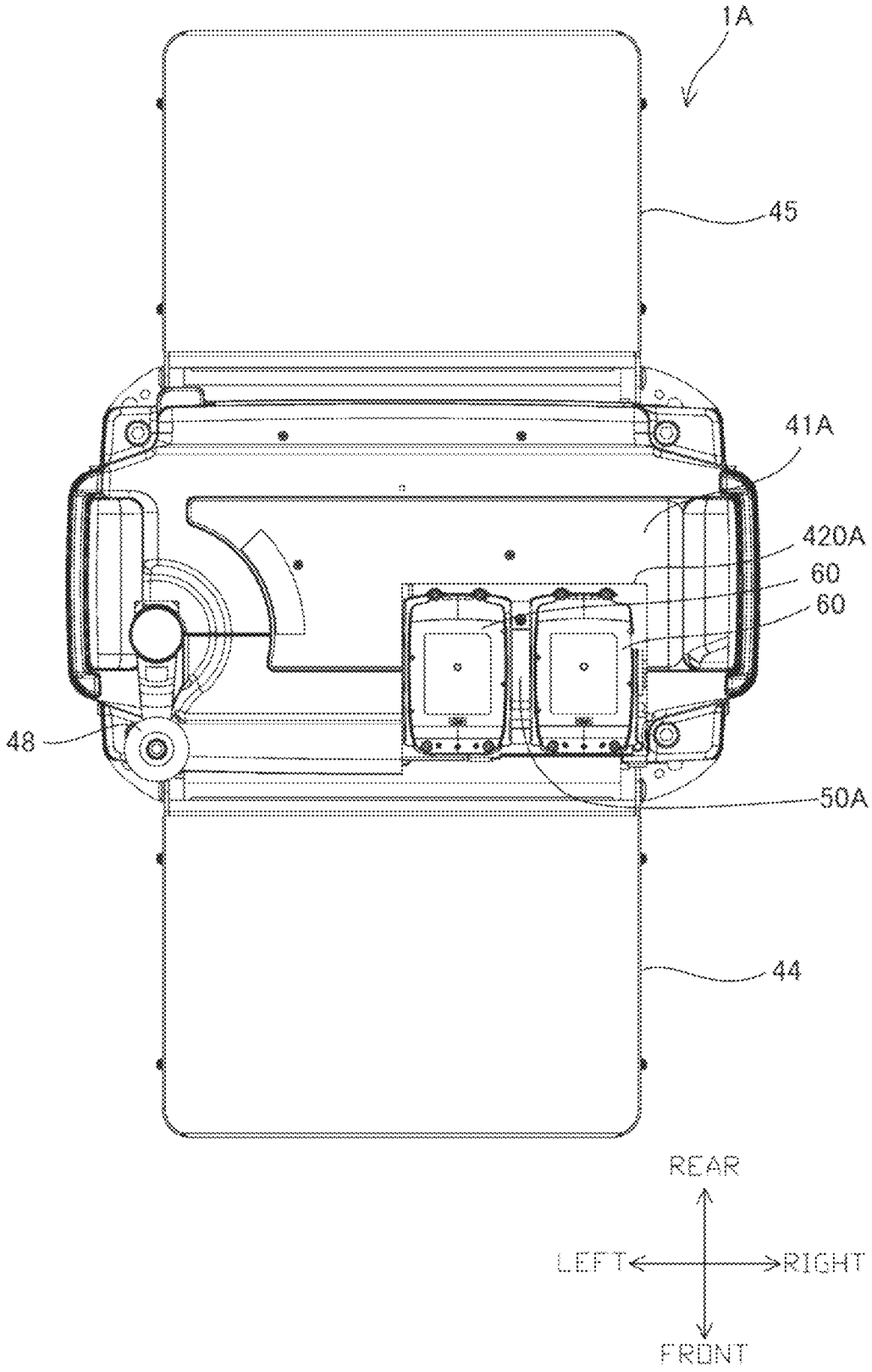
FIG. 16 is a top view of the thickness planer of the second embodiment.

A thickness planer 1A according to a second embodiment of the present disclosure is now described with reference to FIGS. 15 and 16. A main difference between the thickness planer 1A of this embodiment and the thickness planer 1 of the first embodiment is a position where a battery pack mounting unit 50A and the battery pack 60 are arranged.

The thickness planer 1A of this embodiment is configured to plane a workpiece CM like the thickness planer 1 of the first embodiment and includes the same structures as the thickness planer 1. Therefore, in the following description, the same structures as in the thickness planer 1 are given like numerals and are not or briefly described, and different structures are mainly described with reference to the drawings.

In this embodiment, the battery pack mounting unit 50A is arranged on top of the main housing 100. Specifically, the battery pack mounting unit 50A is arranged in the housing upper area HUA. Particularly, in this embodiment, the battery pack mounting unit 50A is fastened to the top of the main housing 100 by a plurality of screw parts. In an upper front part of a top cover 41A arranged on the upper side of the thickness planer 1A, an escape part 420A is formed to be open at an upper front end of the top cover 41A. Specifically, the escape part 420A is formed into a recessed shape such that the whole top surface of the battery pack 60 attached to the battery pack mounting unit 50A is visible when viewed from above. Further, the escape part 420A is formed into such a shape that the whole front surface of the battery pack 60 attached to the battery pack mounting unit 50A is visible when viewed from the front.

The battery pack mounting unit 50A is mounted onto the top of the main housing 100 in such an orientation that the battery pack 60 is attached and detached from the front of the thickness planer 1A. Specifically, the battery pack 60 is attached to the battery pack mounting unit 50A by being slid rearward with respect to the battery pack mounting unit 50A from the front of the thickness planer 1A. Thus, the mounting direction is a direction heading from the front to the rear of the thickness planer 1A. Further, the battery pack 60 is detached from the battery pack mounting unit 50A by being slid forward with respect to the battery pack mounting unit 50A in the thickness planer 1A. Thus, the removing direction is a direction heading from the rear to the front of the thickness planer 1A.

In such a structure, the unlock button 61*f* of the battery pack 60 can be operated from the front of the thickness planer 1A. Therefore, a user can attach and detach the battery pack 60 from the front of the thickness planer 1A like in operating the main switch 71 and the lever switch 72 and in feeding the workpiece CM to the cutting area CA.

The thickness planer 1A of this embodiment is configured such that rear end parts of the battery pack mounting unit 50A and the battery pack 60 are located rearward (inward) of a front end of the closed front auxiliary table 44. Therefore, the battery pack mounting unit 50A and the battery pack 60 are avoided from getting into contact with external elements such as a user and surrounding equipment during transportation or storage of the thickness planer 1A. Thus, the thickness planer 1A is provided with improved storability and portability.

As described above, the thickness planer 1A of this embodiment has the escape part 420A in the upper front part of the top cover 41A, which facilitates attachment and detachment of the battery pack 60.

Further, the battery pack mounting unit 50A is mounted onto the top of the main housing 100 in such an orientation that the battery pack 60 is attached and detached from the front of the thickness planer 1A. Therefore, a user can attach and detach the battery pack 60 from the front of the thickness planer 1A like in operating the main switch 71 and the lever switch 72 and in feeding the workpiece CM to the cutting area CA, so that convenience of the thickness planer 1A is improved.

Further, in the thickness planer 1A of this embodiment, the battery pack mounting unit 50A is fastened to the top of the main housing 100 by the screw parts. Therefore, the battery pack mounting unit 50A and the battery pack 60 are prevented from falling off during transportation of the thickness planer 1A.

In this embodiment, like in the first embodiment, the battery pack mounting unit 50A is configured such that the battery pack mounting unit 50A and the battery pack 60 attached to the battery pack mounting unit 50A lie in a position avoiding the feeding area TA. Specifically, the battery pack mounting unit 50A is arranged in the housing upper area HUA. Particularly, in this embodiment, like in the first embodiment, the battery pack mounting unit 50A is arranged above the main housing 100. Therefore, during planing operation by a user, the workpiece CM is avoided from getting into contact with the battery pack mounting unit 50A and the battery pack 60 while being fed. Further, the user's view of the cutter head 21 (or the cutting area CA) is avoided from being obstructed by the battery pack mounting unit 50A and the battery pack 60, so that a user can easily check how the workpiece CM is being planed. As a result, the working efficiency of a user is prevented from lowering due to provision of the battery pack mounting unit 50A and the battery pack 60 in the thickness planer 1A.

In this embodiment, the battery pack mounting unit 50A is arranged below the top cover 41A. Therefore, the size of a portion of the thickness planer 1A above the top cover 41A (the length of the thickness planer 1A in the vertical direction) is avoided from increasing due to arrangement of the battery pack mounting unit 50A. As a result, the thickness planer 1A realizes space saving when stored or loaded.

In this embodiment, the battery pack mounting unit 50A is mounted to the top of the main housing 100, so that a free space above the main housing 100 is effectively utilized.

In this embodiment, other effects similar to those of the above-described first embodiment are also obtained by provision of the same structures and methods as in the first embodiment.

Further, it may be configured such that the battery pack mounting unit 50A is fixed to the main housing 100 in a different orientation from that in this embodiment. For example, the battery pack mounting unit 50A may be fixed to the main housing 100 in such an orientation that the battery pack 60 is mounted thereto from the rear or the left or right side of the thickness planer 1A.

The direction in which the escape part 420A opens in the top cover 41A may be changed according to the orientation of the battery pack mounting unit 50A mounted to the main housing 100. For example, when the battery pack mounting unit 50A is fixed to the main housing 100 in such an orientation that the battery pack 60 is mounted thereto from the rear of the thickness planer 1A, the escape part 420A may be formed to be open at an upper rear end of the top cover 41A. When the battery pack mounting unit 50A is fixed to the main housing 100 in such an orientation that the battery pack 60 is mounted thereto from the left or right side of the thickness planer 1A, the escape part 420A may be formed to be open at an upper left or right end of the top cover 41A.

The escape part 420A formed in the top cover 41A may be shaped as follows. The escape part may be formed into a recessed shape such that part of the top surface of the battery pack 60 attached to the battery pack mounting unit 50A is visible when viewed from above. Further, the escape part 420A may be formed into such a shape that part of the front surface of the battery pack 60 attached to the battery pack mounting unit 50A is visible when viewed from the front.

In this embodiment, the main housing 100 and the battery pack mounting unit 50A may be integrally formed with each other. In this case, the strengths of the main housing 100 and the battery pack mounting unit 50A are improved.

The structure in which the battery pack mounting unit 50A and the battery pack 60 are arranged on the top of the main housing 100 may be applied to a thickness planer not having the top cover on the top of the main housing. By provision of such a structure, like in this embodiment, a free space above the main housing 100 is effectively utilized.

Third Embodiment

Figure 17:
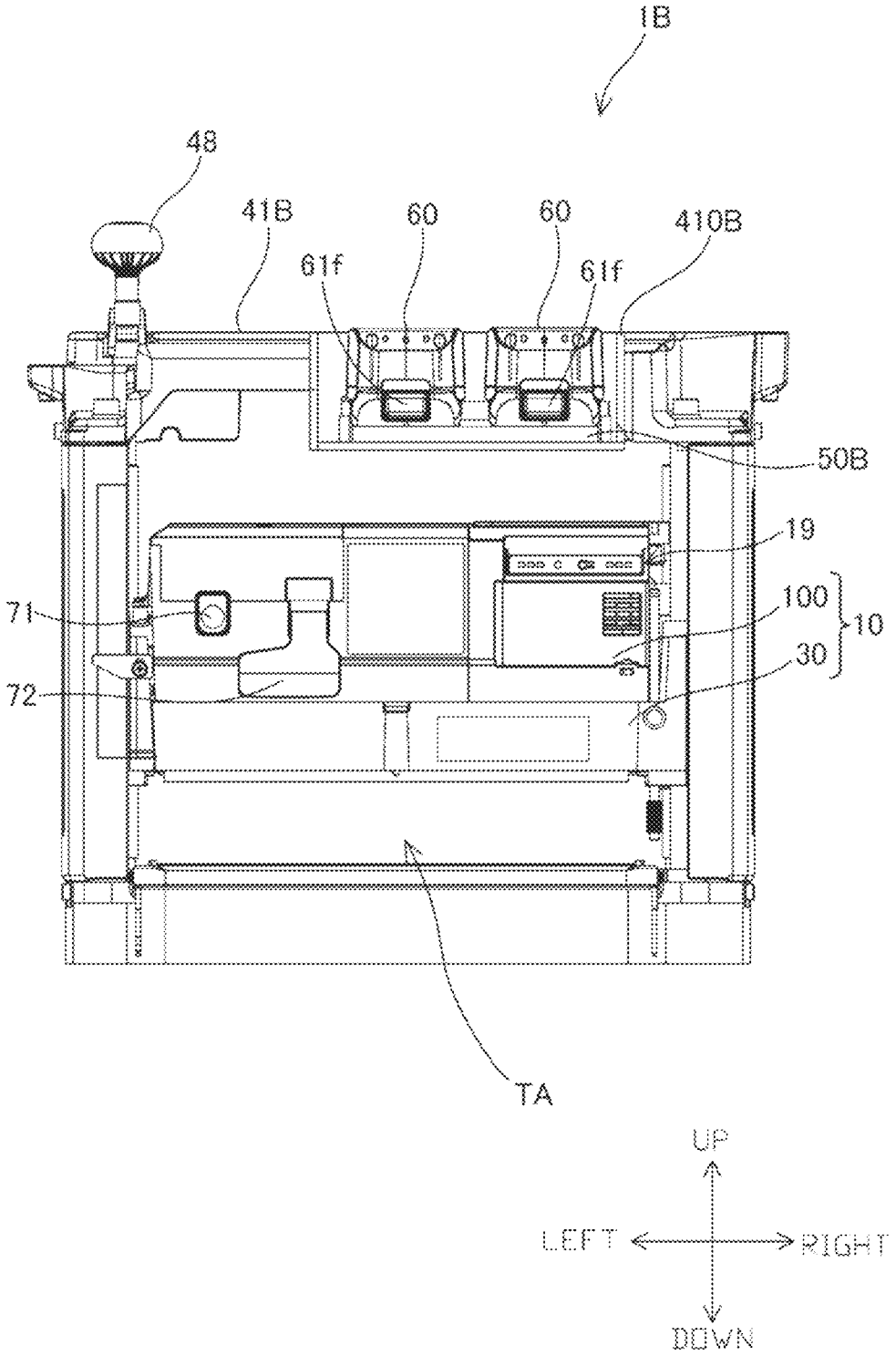
FIG. 17 is a front view of a thickness planer of a third embodiment.
Figure 18:
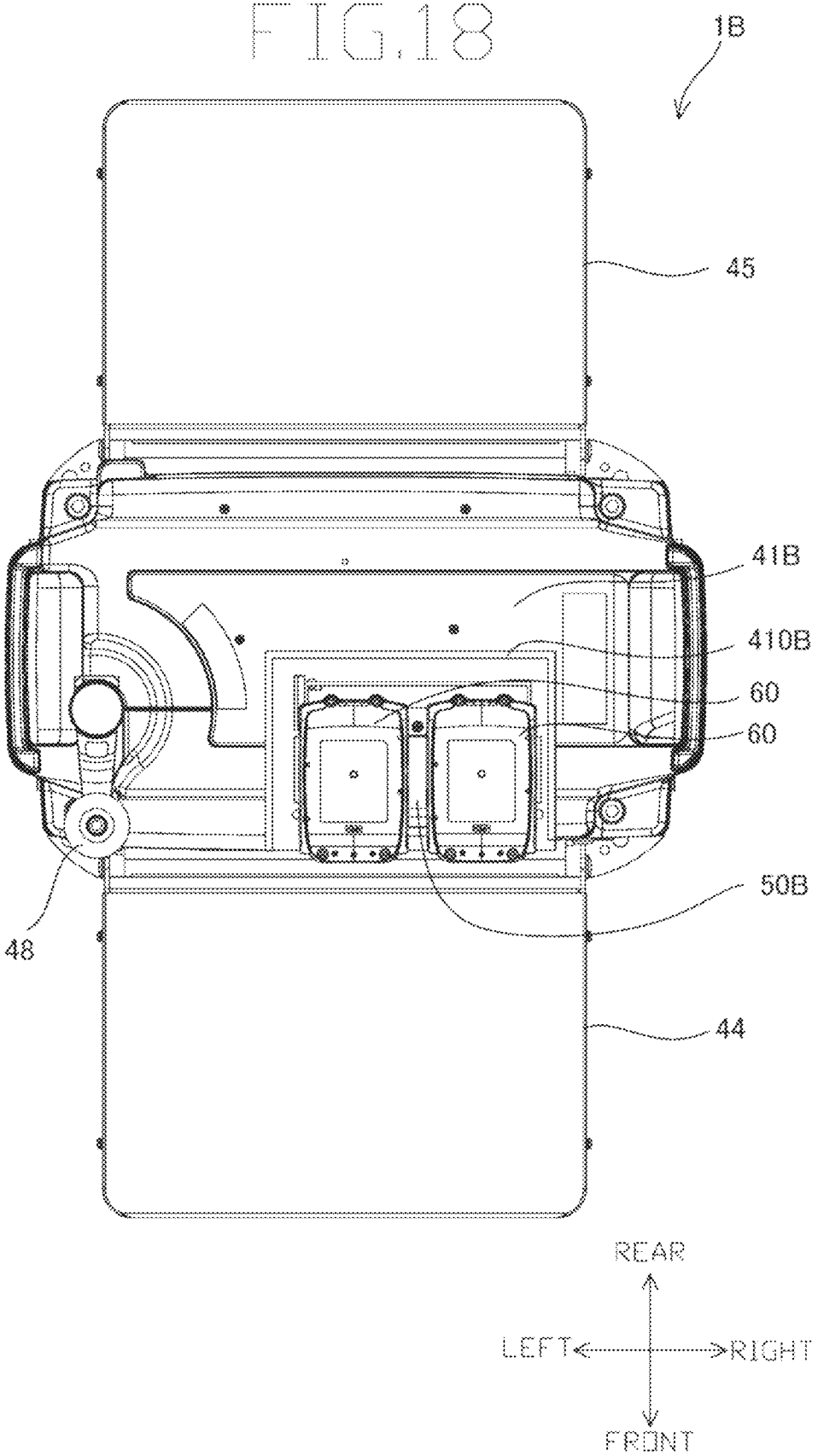
FIG. 18 is a top view of the thickness planer of the third embodiment.

A thickness planer 1B according to a third embodiment of the present disclosure is now described with reference to FIGS. 17 and 18. A main difference between the thickness planer 1B of this embodiment and the thickness planer 1 of the first embodiment is a position where a battery pack mounting unit 50B and the battery pack 60 are arranged.

The thickness planer 1B of this embodiment is configured to plane a workpiece CM like the thickness planer 1 of the first embodiment and includes the same structures as the thickness planer 1. Therefore, in the following description, the same structures as in the thickness planer 1 are given like numerals and are not or briefly described, and different structures are mainly described with reference to the drawings.

In this embodiment, a battery pack housing part 410B is provided on a top cover 41B and houses at least parts of the battery pack mounting unit 50B and the battery pack 60 attached to the battery pack mounting unit 50B. The battery pack housing part 410B is arranged above the main housing 100.

The battery pack housing part 410B is configured to house at least parts of the battery pack mounting unit 50B and the battery pack 60 attached to the battery pack mounting unit 50B below an upper surface of the top cover 41B. More specifically, the battery pack mounting unit 50B is arranged in the housing upper area HUA and the cover upper area CUA.

The battery pack housing part 410B is formed to be open at an upper front end of the top cover 41B. Specifically, the battery pack housing part 410B is formed into a recessed shape such that the whole top surface of the battery pack 60 attached to the battery pack mounting unit 50B is visible when viewed from above. Further, the battery pack housing part 410B is formed into a recessed shape such that the whole front surface of the battery pack 60 attached to the battery pack mounting unit 50B is visible when viewed from the front.

The battery pack mounting unit 50B is fastened to a bottom of the battery pack housing part 410B by a plurality of screw parts. The battery pack mounting unit 50B is mounted to the bottom of the battery pack housing part 410B in such an orientation that the battery pack 60 is attached and detached from the front of the thickness planer 1B. Specifically, the battery pack 60 is attached to the battery pack mounting unit 50B by being slid rearward with respect to the battery pack mounting unit 50B from the front of the thickness planer 1B. Thus, the mounting direction is a direction heading from the front to the rear of the thickness planer 1B. Further, the battery pack 60 is detached from the battery pack mounting unit 50B by being slid forward with respect to the battery pack mounting unit 50B in the thickness planer 1B. Thus, the removing direction is a direction heading from the rear to the front of the thickness planer 1B.

In such a structure, the unlock button 61*f* of the battery pack 60 can be operated from the front of the thickness planer 1B. Therefore, a user can attach and detach the battery pack 60 from the front of the thickness planer 1B like in operating the main switch 71 and the lever switch 72 and in feeding the workpiece CM to the cutting area CA.

The thickness planer 1B of this embodiment is configured such that rear end parts of the battery pack mounting unit 50B and the battery pack 60 are located rearward (inward) of the front end of the closed front auxiliary table 44. Therefore, the battery pack mounting unit 50B and the battery pack 60 are avoided from getting into contact with external elements such as a user and surrounding equipment during transportation or storage of the thickness planer 1B. Thus, the thickness planer 1B is provided with improved storability and portability.

As described above, in the thickness planer 1B according to this embodiment, the battery pack housing part 410B is provided on the top cover 41B and houses at least parts of the battery pack mounting unit 50B and the battery pack 60 attached to the battery pack mounting unit 50B. Therefore, at least parts of the battery pack mounting unit 50B and the battery pack 60 attached to the battery pack mounting unit 50B are protected. For example, the battery pack mounting unit 50B and the battery pack 60 are avoided from getting into contact with external elements such as a user and surrounding equipment.

Further, the battery pack housing part 410B is formed to be open at the upper front end of the top cover 41B, which facilitates attachment and detachment of the battery pack 60.

Further, the battery pack mounting unit 50B is mounted to the bottom of the battery pack housing part 410B in such an orientation that the battery pack 60 is attached and detached from the front of the thickness planer 1B. Therefore, a user can attach and detach the battery pack 60 from the front of the thickness planer 1B like in operating the main switch 71 and the lever switch 72 and in feeding the workpiece CM to the cutting area CA, so that convenience of the thickness planer 1B is improved.

In the thickness planer 1B according to this embodiment, the battery pack mounting unit 50B is fastened to the bottom of the battery pack housing part 410B by a plurality of the screw parts. Therefore, the battery pack mounting unit 50B and the battery pack 60 are prevented from falling off during transportation of the thickness planer 1B.

In the thickness planer 1B according to this embodiment, like in the first embodiment, the battery pack mounting unit 50B is configured such that the battery pack mounting unit 50B and the battery pack 60 attached to the battery pack mounting unit 50B lie in a position avoiding the feeding area TA. Specifically, the battery pack mounting unit 50B is arranged in the housing upper area HUA and the cover upper area CUA. Particularly, in this embodiment, like in the first embodiment, the battery pack mounting unit 50B is arranged above the main housing 100. Therefore, the workpiece CM is avoided from getting into contact with the battery pack mounting unit 50B and the battery pack 60 during planing operation. Further, the user's view of the cutter head 21 (or the cutting area CA) is avoided from being obstructed by the battery pack mounting unit 50B and the battery pack 60, so that a user can easily check how the workpiece CM is being planed. As a result, the working efficiency of a user is prevented from lowering due to provision of the battery pack mounting unit 50B and the battery pack 60 in the thickness planer 1B.

In this embodiment, other effects similar to those of the above-described first embodiment are also obtained by provision of the same structures and methods as in the first embodiment.

Further, it may be configured such that the battery pack mounting unit 50B is fixed to the bottom of the battery pack housing part 410B in a different orientation from that in this embodiment. For example, the battery pack mounting unit 50B may be fixed to the bottom of the battery pack housing part 410B in such an orientation that the battery pack 60 is mounted thereto from the rear or the left or right side of the thickness planer 1B.

The direction in which the battery pack housing part 410B opens in the top cover 41B may be changed according to the orientation of the battery pack mounting unit 50B mounted to the bottom of the battery pack housing part 410B. For example, when the battery pack mounting unit 50B is fixed to the bottom of the battery pack housing part 410B in such an orientation that the battery pack 60 is mounted thereto from the rear of the thickness planer 1B, the battery pack housing part 410B may be formed to be open at an upper rear end of the top cover 41B. When the battery pack mounting unit 50B is fixed to the bottom of the battery pack housing part 410B in such an orientation that the battery pack 60 is mounted thereto from the left or right side of the thickness planer 1B, the battery pack housing part 410B may be formed to be open at an upper left or right end of the top cover 41B.

The battery pack housing part 410B may be configured as follows. The battery pack housing part 410B may be formed into a recessed shape such that part of the top surface of the battery pack 60 attached to the battery pack mounting unit 50B is visible when viewed from above. Further, the battery pack housing part 410B may be formed into a recessed shape such that part of the front surface of the battery pack 60 attached to the battery pack mounting unit 50B is visible when viewed from the front.

In this embodiment, the top cover 41B and the battery pack housing part 410B may be integrally formed with each other. In this case, the strengths of the top cover 41B and the battery pack housing part 410B are improved. Further, in this embodiment, the battery pack housing part 410B and the battery pack mounting unit 50B may be integrally formed with each other. In this case, the strengths of the battery pack housing part 410B and the battery pack mounting unit 50B are improved. Furthermore, in this embodiment, the top cover 41B, the battery pack housing part 410B and the battery pack mounting unit 50B may be integrally formed with each other. In this case, the strengths of the top cover 41B, the battery pack housing part 410B and the battery pack mounting unit 50B are improved.

In this embodiment, it may be configured such that an upper end part of the battery pack 60 attached to the battery pack mounting unit 50B and housed in the battery pack housing part 410B does not protrude upward from the upper surface of the top cover 41B. Thus, the size of a portion of the thickness planer 1B above the top cover 41B (the length of the thickness planer 1B in the vertical direction) is avoided from increasing due to the battery pack mounting unit 50B and the battery pack 60 being housed in the battery pack housing part 410B. As a result, the thickness planer 1B realizes space saving when stored or loaded.

Fourth Embodiment

Figure 19:
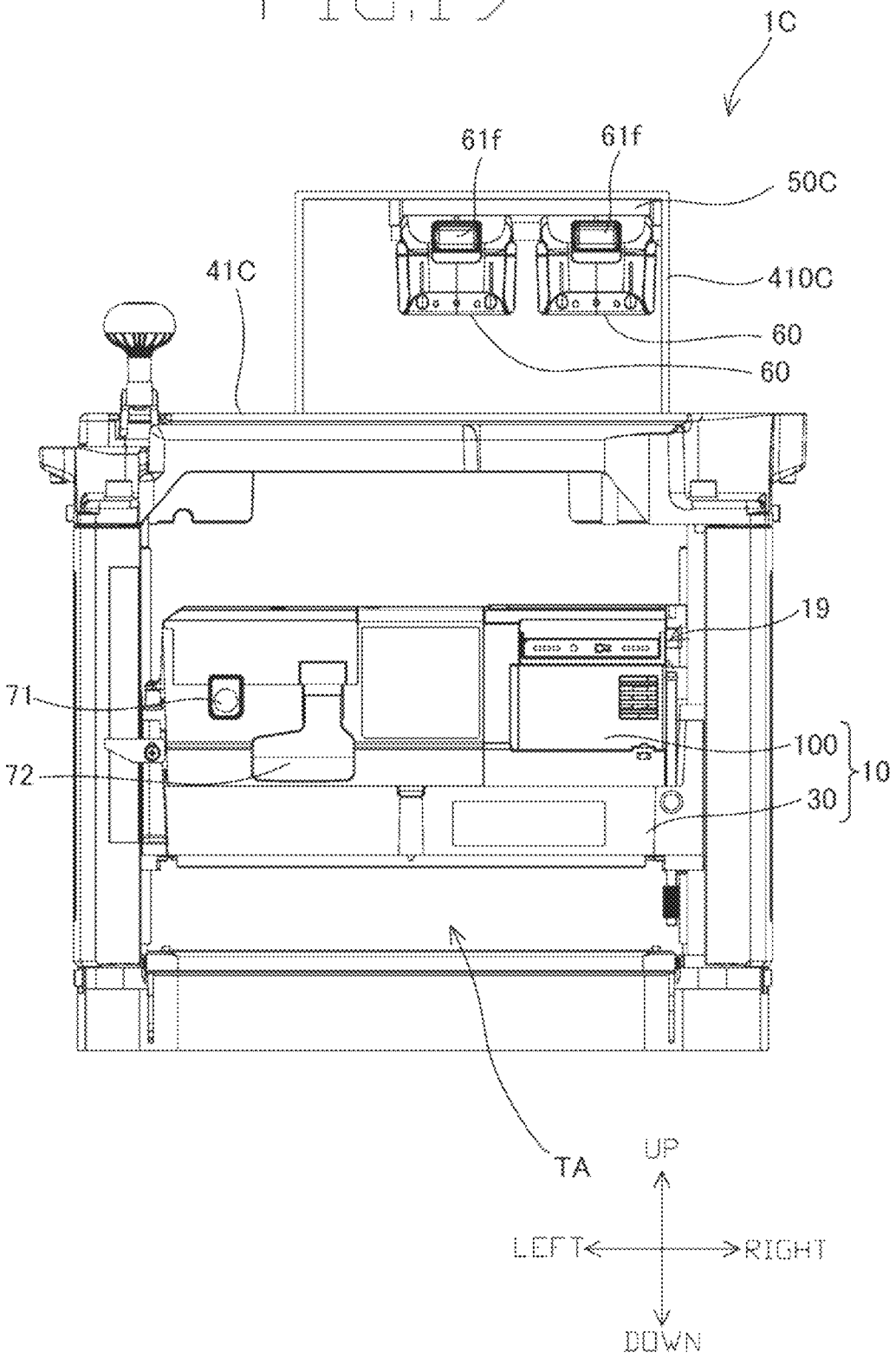
FIG. 19 is a front view of a thickness planer of a fourth embodiment.
Figure 20:
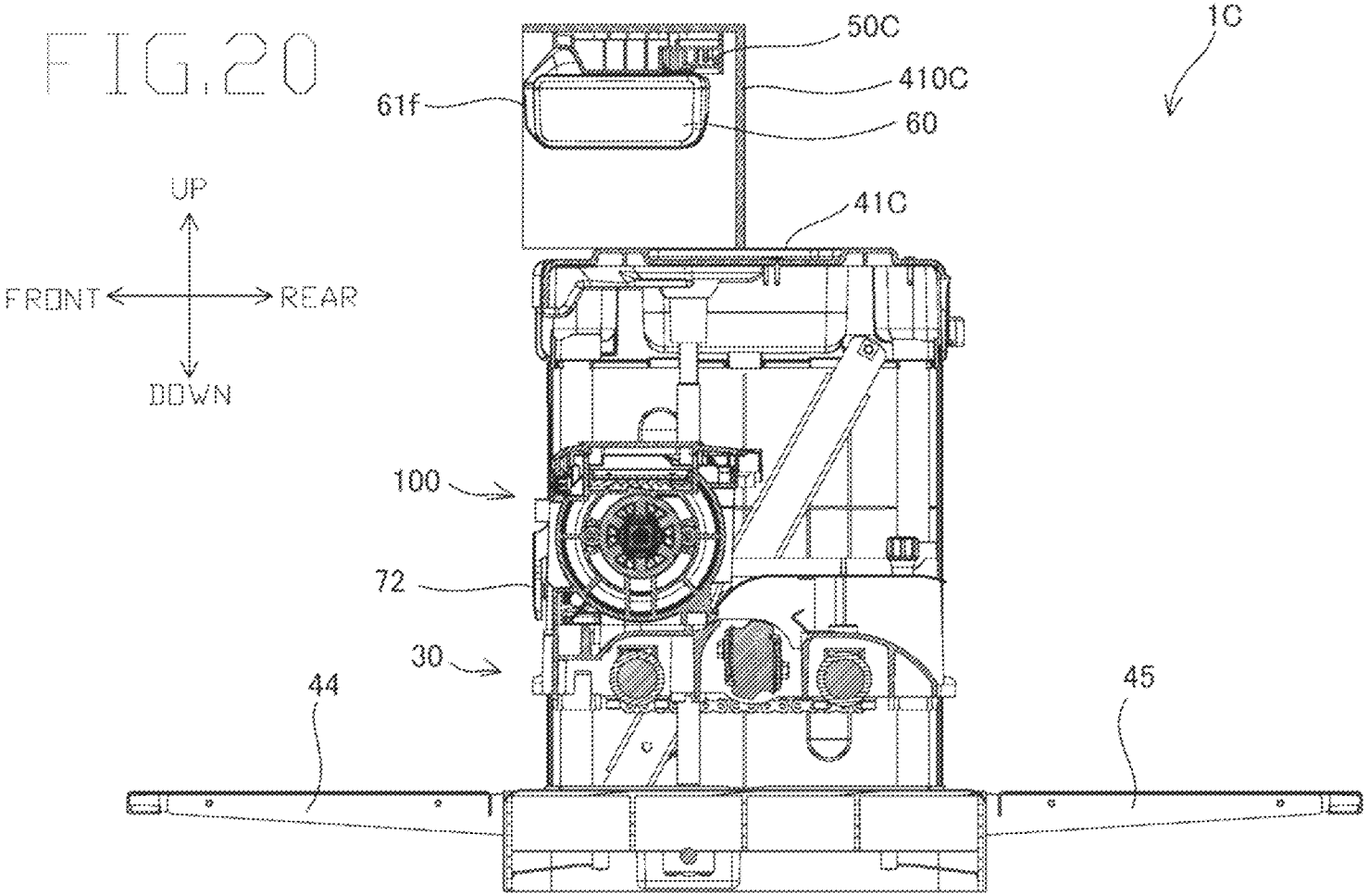
FIG. 20 is a partly cutaway right side view of the thickness planer of the fourth embodiment.

A thickness planer 1C according to a fourth embodiment of the present disclosure is now described with reference to FIGS. 19 and 20. A main difference between the thickness planer 1C of this embodiment and the thickness planer 1 of the first embodiment is a position where a battery pack mounting unit 50C and the battery pack 60 are arranged.

The thickness planer 1C of this embodiment is configured to plane a workpiece CM like the thickness planer 1 of the first embodiment and includes the same structures as the thickness planer 1. Therefore, in the following description, the same structures as in the thickness planer 1 are given like numerals and are not or briefly described, and different structures are mainly described with reference to the drawings.

In this embodiment, the battery pack mounting unit 50C is arranged in the cover upper area CUA. Further, in this embodiment, a battery pack housing part 410C is provided on a top cover 41C and houses at least parts of the battery pack mounting unit 50C and the battery pack 60 attached to the battery pack mounting unit 50C. The battery pack housing part 410C is arranged above the main housing 100.

The battery pack housing part 410C is formed by a box-like member provided on a top of the top cover 41C. Further, the battery pack housing part 410C is formed with an open front end. Specifically, the battery pack housing part 410C is formed such that the whole front surface of the battery pack 60 attached to the battery pack mounting unit 50C is visible when viewed from the front.

The battery pack mounting unit 50C is fastened to an upper inner wall of the battery pack housing part 410C by a plurality of screw parts. The battery pack mounting unit 50C is mounted to the upper inner wall of the battery pack housing part 410C in such an orientation that the battery pack 60 is attached and detached from the front of the thickness planer 1C. Specifically, the battery pack 60 is attached to the battery pack mounting unit 50C by being slid rearward with respect to the battery pack mounting unit 50C from the front of the thickness planer 1C. Thus, the mounting direction is a direction heading from the front to the rear of the thickness planer 1C. Further, the battery pack 60 is detached from the battery pack mounting unit 50C by being slid forward with respect to the battery pack mounting unit 50C in the thickness planer 1C. Thus, the removing direction is a direction heading from the rear to the front of the thickness planer 1C.

In such a structure, the unlock button 61*f* of the battery pack 60 can be operated from the front of the thickness planer 1C. Therefore, a user can attach and detach the battery pack 60 from the front of the thickness planer 1C like in operating the main switch 71 and the lever switch 72 and in feeding the workpiece CM to the cutting area CA.

The thickness planer 1C of this embodiment is configured such that rear end parts of the battery pack mounting unit 50C and the battery pack 60 are located rearward (inward) of the front end of the closed front auxiliary table 44. Therefore, the battery pack mounting unit 50C and the battery pack 60 are avoided from getting into contact with external elements such as a user and surrounding equipment during transportation or storage of the thickness planer 1C. Thus, the thickness planer 1C is provided with improved storability and portability.

As described above, in the thickness planer 1C according to this embodiment, the battery pack housing part 410C is provided on the top of the top cover 41C and houses at least parts of the battery pack mounting unit 50C and the battery pack 60 attached to the battery pack mounting unit 50C. Therefore, at least parts of the battery pack mounting unit 50C and the battery pack 60 attached to the battery pack mounting unit 50C are protected. For example, the battery pack mounting unit 50C and the battery pack 60 are avoided from getting into contact with external elements such as a user and surrounding equipment.

Further, the battery pack housing part 410C has the open front end, which facilitates attachment and detachment of the battery pack 60.

Further, the battery pack mounting unit 50C is fixed to the upper inner wall of the battery pack housing part 410C in such an orientation that the battery pack 60 is attached and detached from the front of the thickness planer 1C. Therefore, a user can attach and detach the battery pack 60 from the front of the thickness planer 1C like in operating the main switch 71 and the lever switch 72 and in feeding the workpiece CM to the cutting area CA, so that convenience of the thickness planer 1C is improved.

In the thickness planer 1C of this embodiment, the battery pack mounting unit 50C is fastened to the upper inner wall of the battery pack housing part 410C by the screw parts. Therefore, the battery pack mounting unit 50C and the battery pack 60 are prevented from falling off during transportation of the thickness planer 1C.

In the thickness planer 1C according to this embodiment, like in the first embodiment, the battery pack mounting unit 50C is configured such that the battery pack mounting unit 50C and the battery pack 60 attached to the battery pack mounting unit 50C lie in a position avoiding the feeding area TA. Specifically, the battery pack mounting unit 50C is arranged in the cover upper area CUA. Particularly, in the thickness planer 1C according to this embodiment, like in the first embodiment, the battery pack mounting unit 50C is arranged above the main housing 100. Therefore, during planing operation, the workpiece CM is avoided from getting into contact with the battery pack mounting unit 50C and the battery pack 60. Further, the user's view of the cutter head 21 (or the cutting area CA) is avoided from being obstructed by the battery pack mounting unit 50C and the battery pack 60, so that a user can easily check how the workpiece CM is being planed. As a result, the working efficiency of a user is prevented from lowering due to provision of the battery pack mounting unit 50C and the battery pack 60 in the thickness planer 1C.

Further, the battery pack mounting unit 50C and the battery pack 60 are surrounded on the upper and lower sides and the left and right sides by the battery pack housing part 410C. Therefore, the battery pack mounting unit 50C and the battery pack 60 are avoided from getting into contact with external elements such as a user and surrounding equipment during planing operation or transportation.

In this embodiment, other effects similar to those of the above-described first embodiment are also obtained by provision of the same structures and methods as in the first embodiment.

Further, it may be configured such that the battery pack mounting unit 50C is fixed to the upper inner wall of the battery pack housing part 410C in a different orientation from that in this embodiment. For example, the battery pack mounting unit 50C may be fixed to the upper inner wall of the battery pack housing part 410C in such an orientation that the battery pack 60 is mounted thereto from the rear or the left or right side of the thickness planer 1C.

The direction in which the battery pack housing part 410C opens may be changed according to the orientation of the battery pack mounting unit 50C mounted to the upper inner wall of the battery pack housing part 410C. For example, when the battery pack mounting unit 50C is fixed to the upper inner wall of the battery pack housing part 410C in such an orientation that the battery pack 60 is mounted thereto from the rear of the thickness planer 1C, the battery pack housing part 410C may be formed to have an open rear end. When the battery pack mounting unit 50C is fixed to the upper inner wall of the battery pack housing part 410C in such an orientation that the battery pack 60 is mounted thereto from the left or right side of the thickness planer 1C, the battery pack housing part 410C may be formed to have an open left or right end.

The battery pack mounting unit 50C may be arranged on a lower inner wall of the battery pack housing part 410C, that is, on top of the top cover 41C. Alternatively, the battery pack mounting unit 50C may be arranged on a left or right inner wall of the battery pack housing part 410C.

In this embodiment, the top cover 41C and the battery pack housing part 410C may be integrally formed with each other. In this case, the strengths of the top cover 41C and the battery pack housing part 410C are improved. Further, in this embodiment, the battery pack housing part 410C and the battery pack mounting unit 50C may be integrally formed with each other. In this case, the strengths of the battery pack housing part 410C and the battery pack mounting unit 50C are improved. Furthermore, in this embodiment, the top cover 41C, the battery pack housing part 410C and the battery pack mounting unit 50C may be integrally formed with each other. In this case, the strengths of the top cover 41C, the battery pack housing part 410C and the battery pack mounting unit 50C are improved.

Fifth Embodiment

Figure 21:
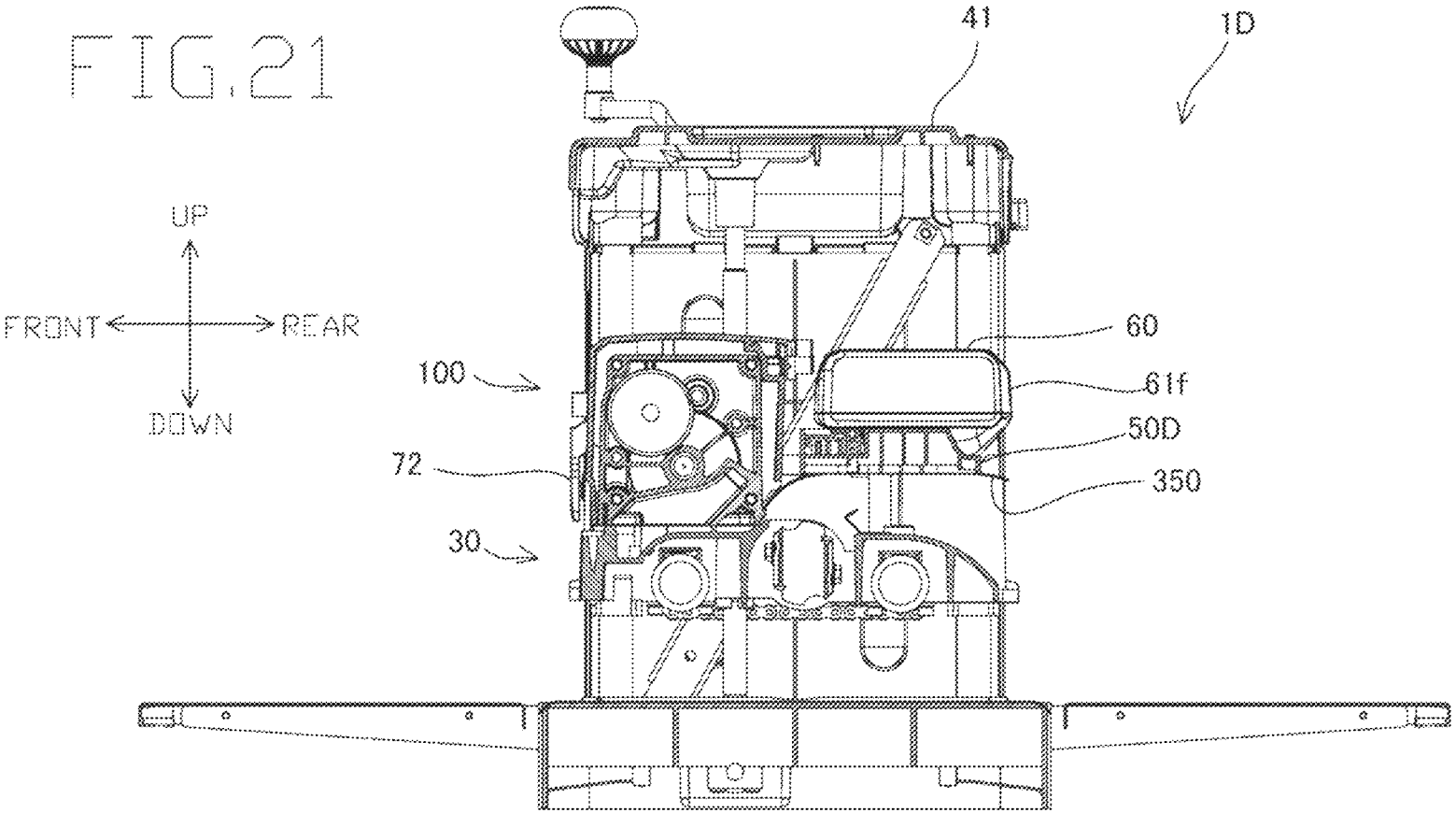
FIG. 21 shows a thickness planer of a fifth embodiment.
Figure 22:
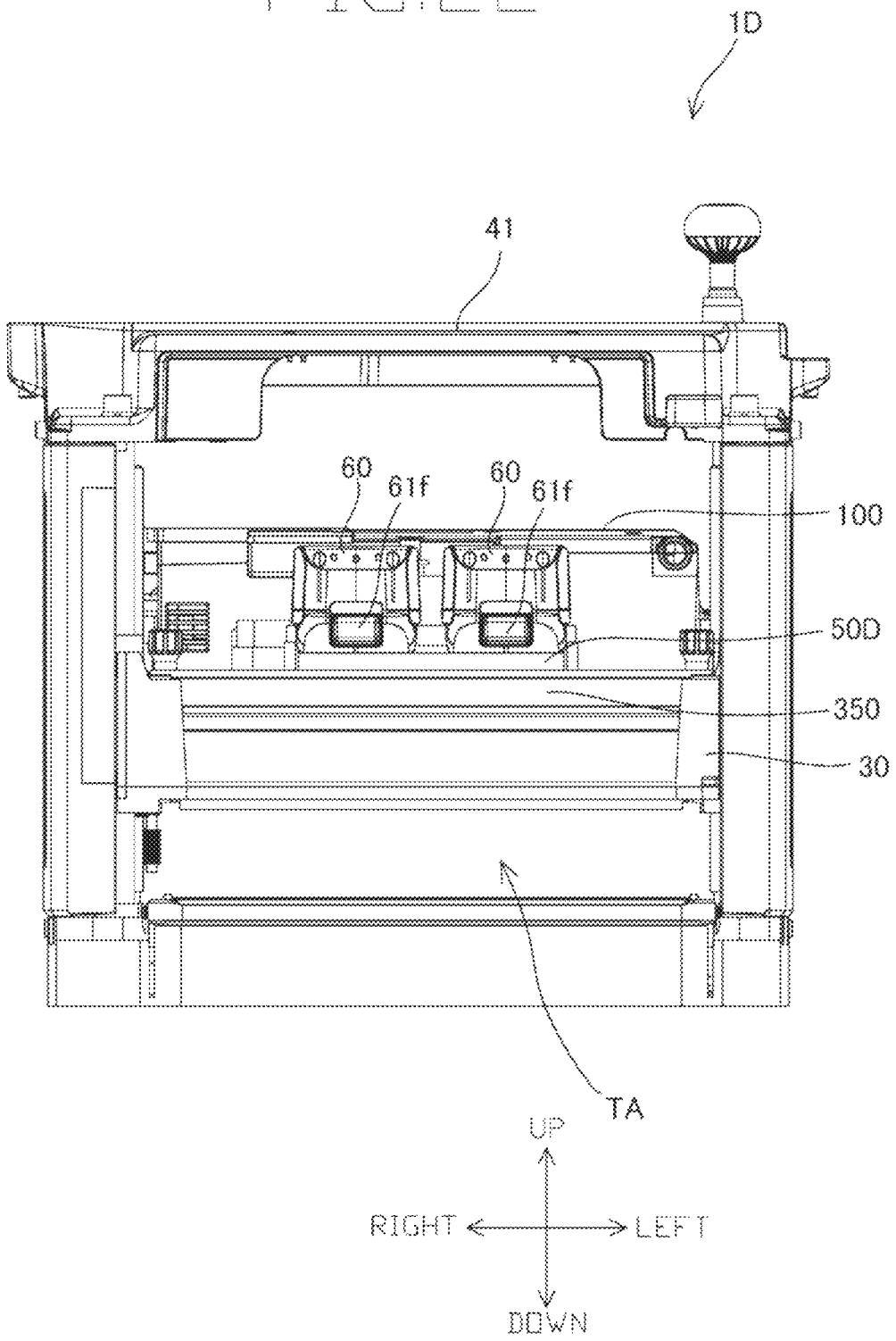
FIG. 22 is a rear view of the thickness planer of the fifth embodiment.

A thickness planer 1D according to a fifth embodiment of the present disclosure is now described with reference to FIGS. 21 and 22. A main difference between the thickness planer 1D of this embodiment and the thickness planer 1 of the first embodiment is a position where a battery pack mounting unit 50D and the battery pack 60 are arranged.

The thickness planer 1D of this embodiment is configured to plane a workpiece CM like the thickness planer 1 of the first embodiment and includes the same structures as the thickness planer 1. Therefore, in the following description, the same structures as in the thickness planer 1 are given like numerals and are not or briefly described, and different structures are mainly described with reference to the drawings.

In this embodiment, the battery pack mounting unit 50D is fastened to a top of the chip cover 350 behind the main housing 100 by a plurality of screw parts. Specifically, the battery pack mounting unit 50D is arranged in the driving mechanism arrangement area DMA (see FIG. 3). Particularly, in this embodiment, the battery pack mounting unit 50D is mounted to the top of the chip cover 350 in such an orientation that the battery pack 60 is attached and detached from the rear of the thickness planer 1D. The battery pack 60 is attached to the battery pack mounting unit 50D by being slid forward with respect to the battery pack mounting unit 50D from the rear of the thickness planer 1D. Thus, the mounting direction is a direction heading from the rear to the front of the thickness planer 1D. Further, the battery pack 60 is detached from the battery pack mounting unit 50D by being slid rearward with respect to the battery pack mounting unit 50D in the thickness planer 1D. Thus, the removing direction is a direction heading from the front to the rear of the thickness planer 1D. In such a structure, the unlock button 61*f* of the battery pack 60 can be operated from the rear of the thickness planer 1D.

In this embodiment, an upper end part of the battery pack 60 attached to the battery pack mounting unit 50D is located below an upper end of the main housing 100. Therefore, when the body unit 10 is raised up to the highest position, the battery pack 60 can be avoided from getting into contact with a lower surface of a top cover 41D.

The thickness planer 1D of this embodiment is configured such that rear end parts of the battery pack mounting unit 50D and the battery pack 60 are located forward (inward) of the rear end of the closed rear auxiliary table 45. Therefore, the battery pack mounting unit 50D and the battery pack 60 are avoided from getting into contact with external elements such as a user and surrounding equipment during transportation or storage of the thickness planer 1D. Thus, the thickness planer 1D is provided with improved storability and portability.

As described above, in the thickness planer 1D according to this embodiment, the battery pack mounting unit 50D is fastened to the top of the chip cover 350 behind the main housing 100 by a plurality of screw parts. Therefore, the battery pack mounting unit 50D and the battery pack 60 are prevented from falling off during transportation of the thickness planer 1D.

A free space exists above the chip cover 350 behind the main housing 100. In the thickness planer 1D according to this embodiment, the battery pack mounting unit 50D is arranged on the top of the chip cover 350, so that the free space existing above the chip cover 350 behind the main housing 100 is effectively utilized.

In the thickness planer 1D according to this embodiment, like in the first embodiment, the battery pack mounting unit 50D is configured such that the battery pack mounting unit 50D and the battery pack 60 attached to the battery pack mounting unit 50D lie in a position avoiding the feeding area TA. Specifically, the battery pack mounting unit 50D is arranged in the driving mechanism arrangement area DMA. Therefore, during planing operation, the workpiece CM is avoided from getting into contact with the battery pack mounting unit 50D and the battery pack 60. Further, the user's view of the cutter head 21 (or the cutting area CA) is avoided from being obstructed by the battery pack mounting unit 50D and the battery pack 60, so that a user can easily check how the workpiece CM is being planed. As a result, the working efficiency of a user is prevented from lowering due to provision of the battery pack mounting unit 50D and the battery pack 60 in the thickness planer 1D.

In the thickness planer 1D according to this embodiment, the battery pack mounting unit 50D is arranged below the top cover 41. Therefore, the size of a portion of the thickness planer 1D above the top cover 41 (the length of the thickness planer 1D in the vertical direction) is avoided from increasing due to arrangement of the battery pack mounting unit 50D. As a result, the thickness planer 1D realizes space saving when stored or loaded.

In this embodiment, other effects similar to those of the above-described first embodiment are also obtained by provision of the same structures and methods as in the first embodiment.

Further, it may be configured such that the battery pack mounting unit 50D is fixed to the chip cover 350 in a different orientation from that in this embodiment. For example, the battery pack mounting unit 50D may be fixed to the chip cover 350 in such an orientation that the battery pack 60 is mounted thereto from the left or right side of the thickness planer 1D.

In this embodiment, the chip cover 350 and the battery pack mounting unit 50D may be integrally formed with each other. In this case, the strengths of the chip cover 350 and the battery pack mounting unit 50D are improved.

The structure in which the battery pack mounting unit 50D and the battery pack 60 are arranged on the top of the chip cover 350 may be applied to a thickness planer not having the top cover on the top of the main housing 100. By provision of such a structure, like in this embodiment, a free space above the chip cover 350 is effectively utilized.

Sixth Embodiment

Figure 23:
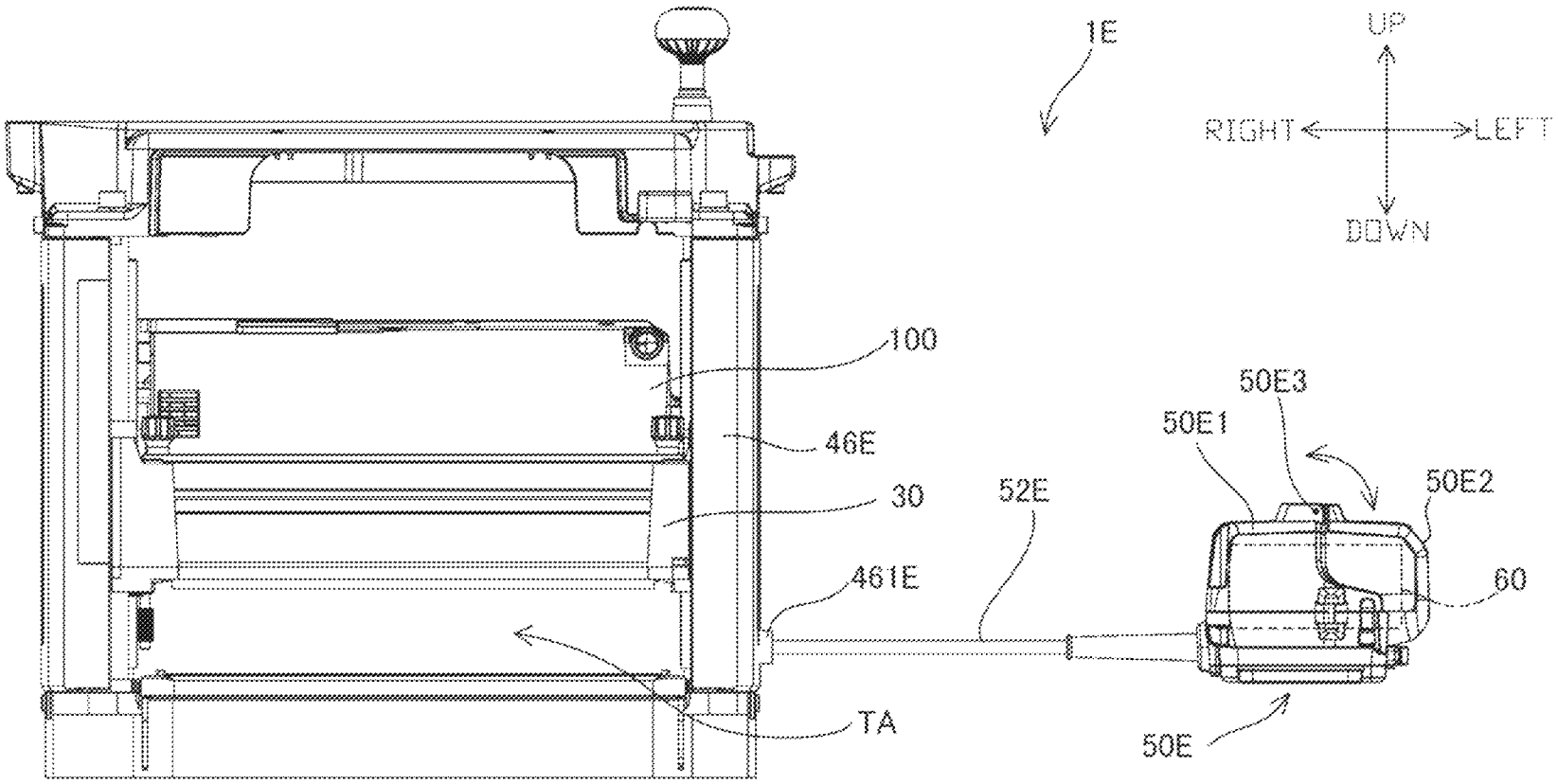
FIG. 23 is a rear view of a thickness planer of a sixth embodiment.
Figure 24:
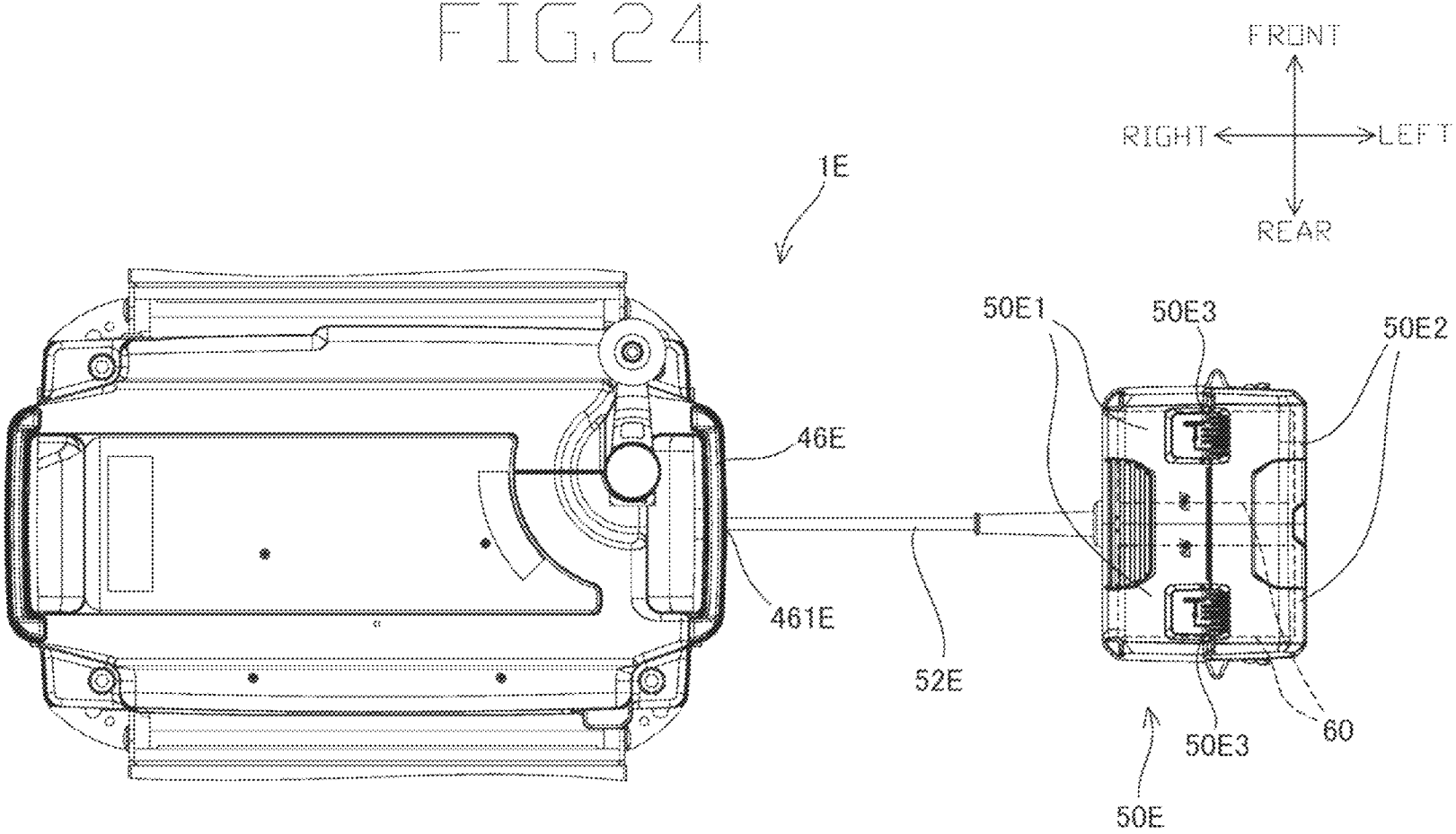
FIG. 24 is a top view of the thickness planer of the sixth embodiment.

A thickness planer 1E according to a sixth embodiment of the present disclosure is now described with reference to FIGS. 23 and 24. A main difference between the thickness planer 1E of this embodiment and the thickness planer 1 of the first embodiment is the structure and arrangement position of a battery pack mounting unit 50E.

The thickness planer 1E of this embodiment is configured to plane a workpiece CM like the thickness planer 1 of the first embodiment and includes the same structures as the thickness planer 1. Therefore, in the following description, the same structures as in the thickness planer 1 are given like numerals and are not or briefly described, and different structures are mainly described with reference to the drawings.

In this embodiment, the battery pack mounting unit 50E is arranged in the left side area LSA. Specifically, a connection terminal 461E is provided in a lower part of a left side cover 46E and electrically connected to the motor 15, and one end of an electric cord 52E is electrically connected to the connection terminal 461E. The electric cord 52E is removably connected to the connection terminal 461E. The other end of the electric cord 52E is electrically connected to the battery pack mounting unit 50E. The battery pack mounting unit 50E includes a body part 50E1 and a lid part 50E2. The lid part 50E2 is supported by the body part 50E1 so as to be turnable around a pivot shaft 50E3, and can be opened and closed with respect to the body part 50E1. In order to attach and detach the battery pack 60 with respect the battery pack mounting unit 50E, the lid part 50E2 is opened and the battery pack 60 is slid with respect to the body part 50E1. When the lid part 50E2 is closed with the battery pack 60 attached to the body part 50E1, the whole battery pack 60 is covered by the body part 50E1 and the lid part 50E2 Like in the first embodiment, the battery pack mounting unit 50E is configured such that the battery pack 60 is removably attached thereto. In this embodiment, the battery pack mounting unit 50E is configured such that two battery packs 60 can be attached thereto so as to be electrically connected in series.

In use of the thickness planer 1E, the battery pack mounting unit 50E is connected to the connection terminal 461E via the electric cord 52E, and the two battery packs 60 are attached to the battery pack mounting unit 50E.

When the thickness planer 1E is not in use, the electric cord 52E is removed from the connection terminal 461E, so that the thickness planer 1E and the battery pack mounting unit 50E can be separately stored.

In this embodiment, the electric cord 52E and the battery pack mounting unit 50E are inseparably connected to each other, but they may be separably connected to each other.

As described above, in the thickness planer 1E according to this embodiment, the battery pack mounting unit 50E is arranged outside the housing of the thickness planer 1E, so that the battery pack 60 can be easily attached and detached.

The battery pack mounting unit 50E is arranged in a position avoiding the feeding area TA. More specifically, the battery pack mounting unit 50E is arranged in the left side area LSA outside the housing of the thickness planer 1E. Therefore, when the cutter head 21 is taken out of and into the thickness planer 1E for replacement of the plane blades 213, 214, the battery pack mounting unit 50E and the battery pack 60 are prevented from interfering with the replacement work, so that the efficiency of the replacement work is improved. Further, the battery pack mounting unit 50E is separable from the thickness planer 1E. Therefore, when the battery pack mounting unit 50E is separated from the thickness planer 1E, the battery pack mounting unit 50E and the battery pack 60 do not interfere with the replacement work of replacing the plane blades 213, 214. Thus, the efficiency of the replacement work is further improved.

Further, with the structure in which the battery pack mounting unit 50E is separable from the thickness planer 1E, the thickness planer 1E is provided with improved storability and portability.

In this embodiment, other effects similar to those of the above-described first embodiment are also obtained by provision of the same structures and methods as in the first embodiment.

The electric cord 52E and the battery pack mounting unit 50E may be integrally formed with each other. Further, the electric cord 52E, the battery pack mounting unit 50E and the battery pack 60 may be integrally formed with each other as one battery unit.

The structure in which the thickness planer 1E is connected to the battery pack mounting unit 50E disposed outside the thickness planer 1E via the electric cord 52E may be applied to a thickness planer not having the top cover on the top of the main housing. In such a case, the same effects as this embodiment can be obtained.

Seventh Embodiment

Figure 25:
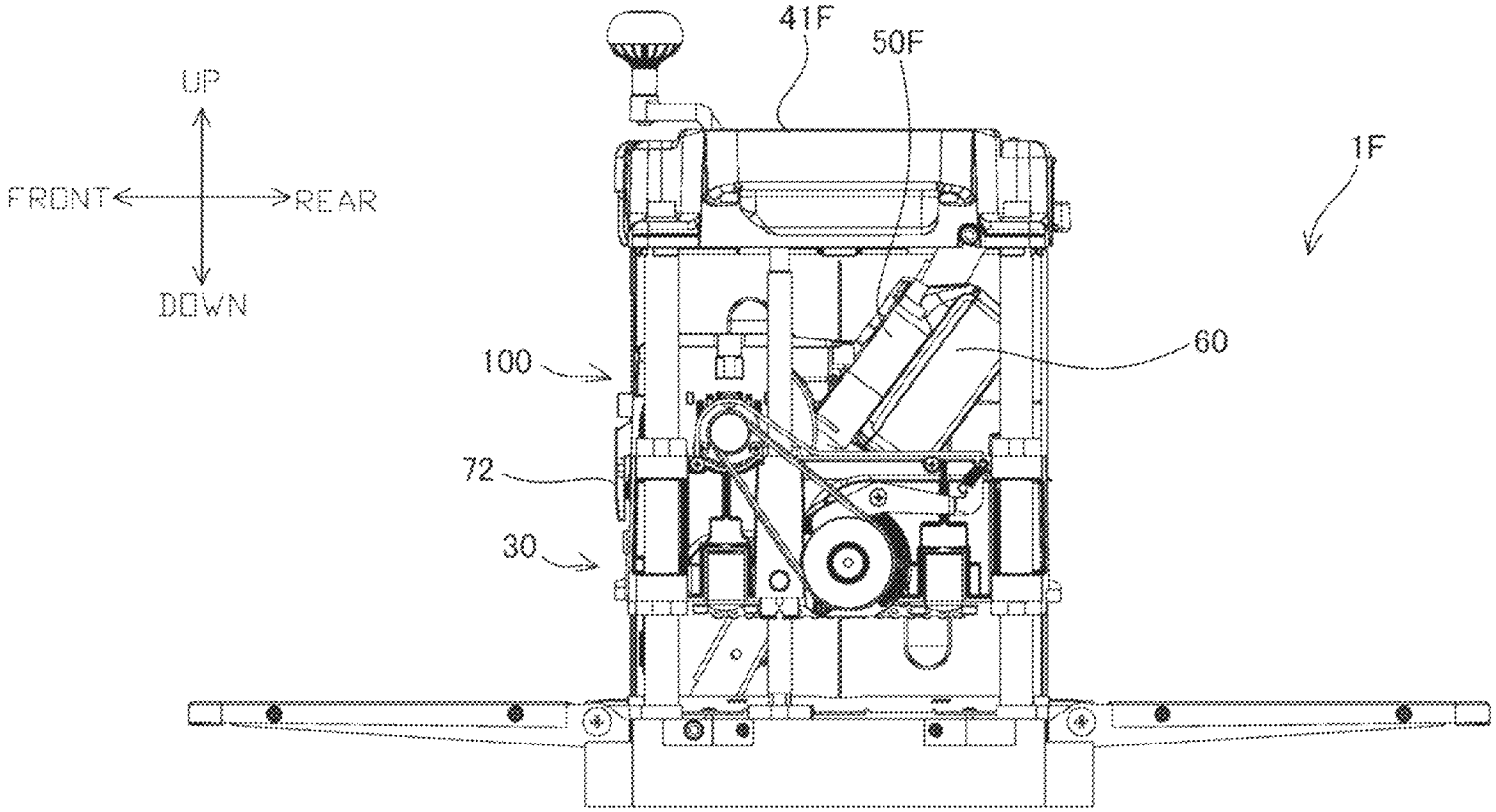
FIG. 25 shows a thickness planer of a seventh embodiment.
Figure 26:
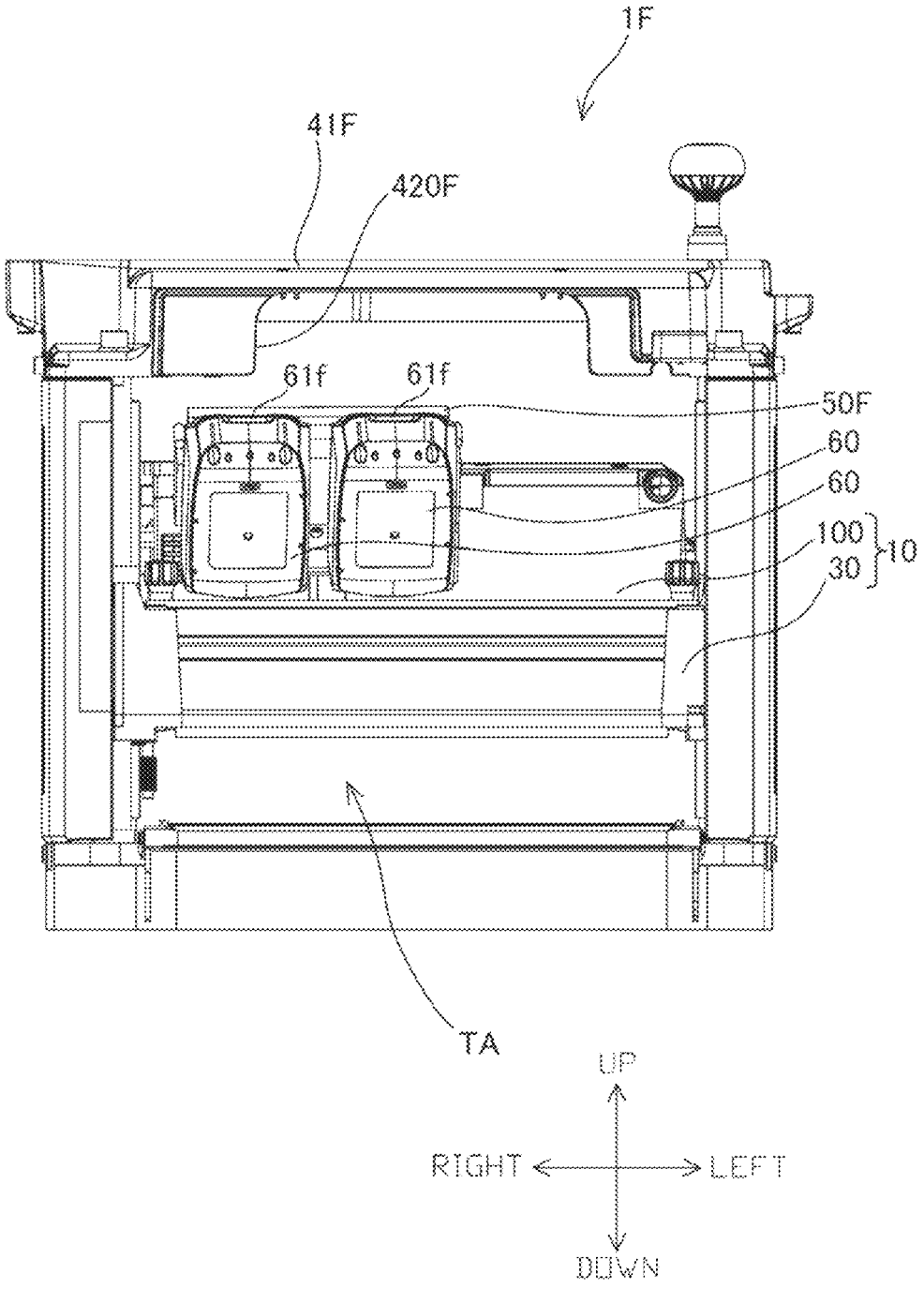
FIG. 26 is a rear view of the thickness planer of the seventh embodiment.

A thickness planer 1F according to a seventh embodiment of the present disclosure is now described with reference to FIGS. 25 and 26. A main difference between the thickness planer 1F of this embodiment and the thickness planer 1 of the first embodiment is a position where a battery pack mounting unit 50F and the battery pack 60 are arranged.

The thickness planer 1F of this embodiment is configured to plane a workpiece CM like the thickness planer 1 of the first embodiment and includes the same structures as the thickness planer 1. Therefore, in the following description, the same structures as in the thickness planer 1 are given like numerals and are not or briefly described, and different structures are mainly described with reference to the drawings.

In this embodiment, the battery pack mounting unit 50F is arranged in the driving mechanism arrangement area DMA and the housing upper area HUA. Specifically, the battery pack mounting unit 50F is mounted to the main housing 100. Further, the battery pack mounting unit 50F is configured such that the battery pack 60 moves in the vertical direction as moving in the front-rear direction when the battery pack 60 is slid in a direction (sliding direction) along the rail parts 51*a* of the battery pack mounting unit 50F. Specifically, the battery pack mounting unit 50F is mounted to the main housing 100 such that the battery pack 60 slides in an oblique direction with respect to the vertical direction and the front-rear direction. Particularly, in this embodiment, the battery pack mounting unit 50F is mounted to a rear side of the main housing 100 such that the battery pack 60 is mounted thereto in an obliquely downward direction from the rear to the front. Further, a connection surface of the battery pack mounting unit 50F for connection to the battery pack 60 faces downward.

In the thickness planer 1F according to this embodiment, the battery pack 60 is attached to the battery pack mounting unit 50F by being slid forward in the obliquely downward direction from the rear of the thickness planer 1F, while the battery pack 60 is detached from the battery pack mounting unit 50F by being slid rearward in an obliquely upward direction in the thickness planer 1F.

In the thickness planer 1F according to this embodiment, an arch-shaped escape part 420F is formed in a rear part of a top cover 41F and facilitates user's operation of attaching and detaching the battery pack 60.

As described above, in the thickness planer 1F according to this embodiment, the battery pack mounting unit 50F is mounted such that the battery pack 60 is mounted thereto in the obliquely downward direction from the rear to the front. The battery pack 60 is attached to the battery pack mounting unit 50F by being slid forward in the obliquely downward direction from the rear of the thickness planer 1F. Therefore, a user can attach the battery pack 60 to the battery pack mounting unit 50F by a natural action of moving a hand in the obliquely downward direction from the user's front side to the inner depth side. Further, the battery pack 60 is detached from the battery pack mounting unit 50F by being slid rearward in the obliquely upward direction from the rear of the thickness planer 1F. Therefore, a user can detach the battery pack 60 from the battery pack mounting unit 50F by a natural motion of moving a hand in the obliquely upward direction from the inner depth side to the user's front side. Thus, in the thickness planer 1F according to this embodiment, attachment and detachment of the battery pack 60 are facilitated.

Further, in the thickness planer 1F according to this embodiment, when the battery pack 60 is detached from the battery pack mounting unit 50F, the battery pack 60 needs to be slid rearward in the obliquely upward direction from the rear of the thickness planer 1F. Therefore, the battery pack 60 is avoided from falling off the battery pack mounting unit 50F during transportation of the thickness planer 1F.

Further, the arch-shaped escape part 420F is formed in the rear part of the top cover 41F. Therefore, this embodiment is configured to facilitate the user's operation of attaching and detaching the battery pack 60.

In this embodiment, the battery pack mounting unit 50F is configured such that the battery pack mounting unit 50F and the battery pack 60 attached to the battery pack mounting unit 50F lie in a position avoiding the feeding area TA. Specifically, the battery pack mounting unit 50F and the battery pack 60 are arranged in the driving mechanism arrangement area DMA and the housing upper area HUA. Therefore, during planing operation by a user, the workpiece CM is avoided from getting into contact with the battery pack mounting unit 50F and the battery pack 60 while being fed, so that decrease in working efficiency is avoided.

In this embodiment, other effects similar to those of the above-described first embodiment are also obtained by provision of the same structures and methods as in the first embodiment.

Further, it may be configured such that the battery pack mounting unit 50F is mounted to the main housing 100 such that the battery pack 60 is mounted thereto in the obliquely upward direction from the rear to the front. Further, the connection surface of the battery pack mounting unit 50F for connection to the battery pack 60 may be configured to face upward. Furthermore, the battery pack mounting unit 50F may be mounted to a front side of the main housing 100.

The structure of the battery pack mounting unit 50F in this embodiment may be applied to a thickness planer not having the top cover on the top of the main housing. In such a case, the same effects as this embodiment can be obtained.

Eighth Embodiment

Figure 27:
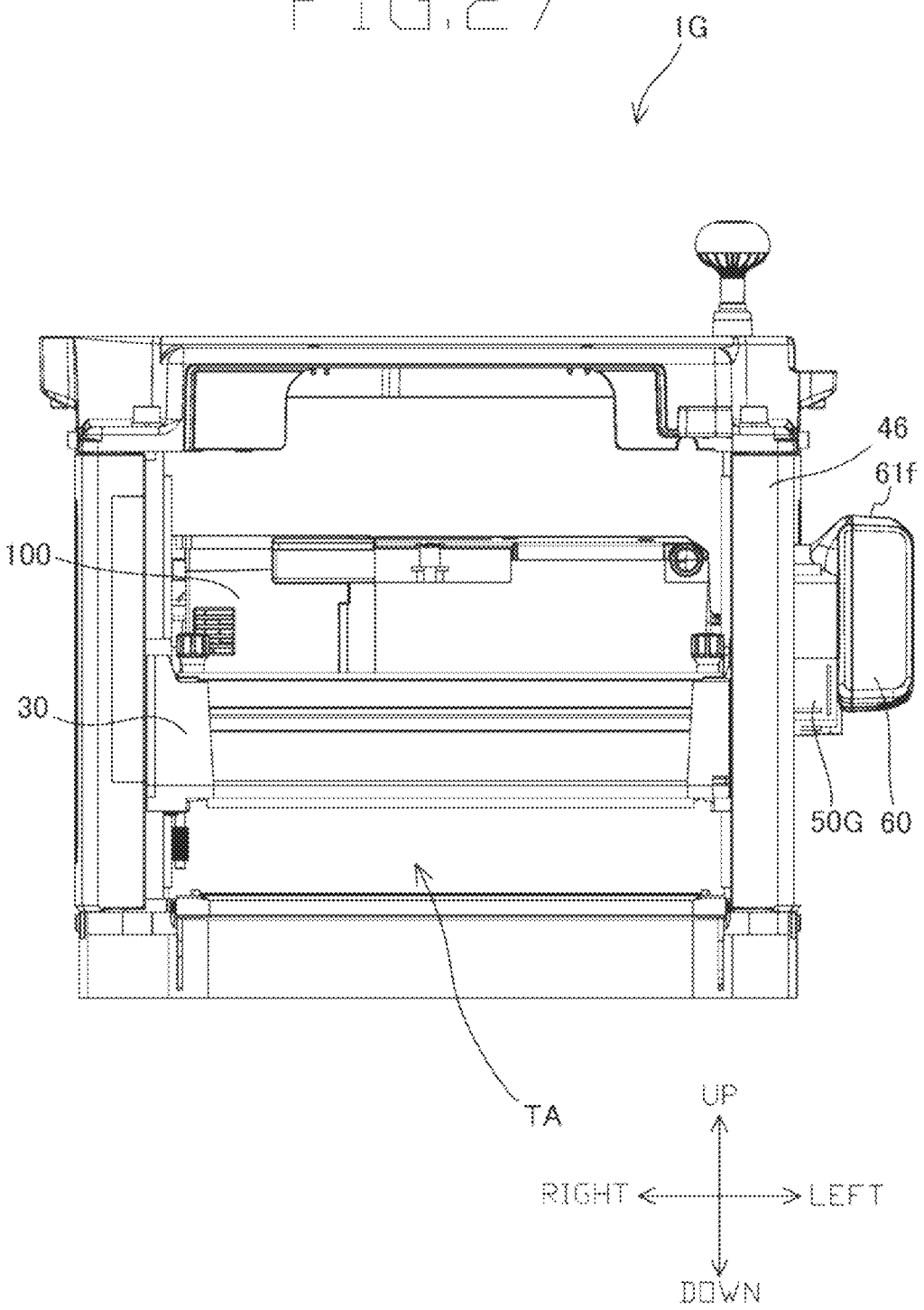
FIG. 27 is a rear view of a thickness planer of an eighth embodiment.

A thickness planer 1G according to an eighth embodiment of the present disclosure is now described with reference to FIG. 27. A main difference between the thickness planer 1G of this embodiment and the thickness planer 1 of the first embodiment is a position where a battery pack mounting unit 50G and the battery pack 60 are arranged.

The thickness planer 1G of this embodiment is configured to plane a workpiece CM like the thickness planer 1 of the first embodiment and includes the same structures as the thickness planer 1. Therefore, in the following description, the same structures as in the thickness planer 1 are given like numerals and are not or briefly described, and different structures are mainly described with reference to the drawing.

In this embodiment, the battery pack mounting unit 50G is arranged on the left or right side of the main housing 100. Particularly, in this embodiment, the battery pack mounting unit 50G is arranged on a left side surface of the left side cover 46. In other words, the battery pack mounting unit 50G is arranged in the left side area LSA. Specifically, the battery pack mounting unit 50G is fastened to the left side surface of the left side cover 46 by a plurality of screw parts.

The battery pack mounting unit 50G is mounted to the left side surface of the left side cover 46 in such an orientation that the battery pack 60 is attached and detached from above on the left side of the thickness planer 1G. Specifically, the battery pack 60 is attached to the battery pack mounting unit 50G by being slid downward with respect to the battery pack mounting unit 50G from above the thickness planer 1G. Thus, the mounting direction is a direction heading from the upper side to the lower side of the thickness planer 1G. Further, the battery pack 60 is detached from the battery pack mounting unit 50G by being slid upward with respect to the battery pack mounting unit 50G in the thickness planer 1G. Thus, the removing direction is a direction heading from the lower side to the upper side of the thickness planer 1G. In such a structure, the unlock button 61*f* of the battery pack 60 is operated from the left side of the thickness planer 1G.

As described above, in the thickness planer 1G according to this embodiment, the battery pack mounting unit 50G is arranged on the left side surface of the left side cover 46, so that a user can easily attach and detach the battery pack 60.

In the thickness planer 1G of this embodiment, the battery pack mounting unit 50G is fastened to the left side surface of the left side cover 46 by the screw parts. Therefore, the battery pack mounting unit 50G and the battery pack 60 are prevented from falling off during transportation of the thickness planer 1G.

Further, when the battery pack 60 is detached from the battery pack mounting unit 50G, the battery pack 60 needs to be slid upward with respect to the battery pack mounting unit 50G in the thickness planer 1G. Therefore, the battery pack 60 is prevented from falling off the battery pack mounting unit 50G during transportation of the thickness planer 1G.

In the thickness planer 1G according to this embodiment, the battery pack 60 is attached and detached by a user on the outside of the left side cover 46, so that a user's hand is prevented from approaching the vicinity of the area of the body unit 10 and the vicinity of the cutting area CA.

With the structure in which the battery pack mounting unit 50G is arranged on the left side surface of the left side cover 46, when the cutter head 21 is taken out of and into the thickness planer 1G for replacement of the plane blades 213, 214, the battery pack mounting unit 50G and the battery pack 60 are prevented from interfering with the replacement work, so that the efficiency of the replacement work is improved.

In the thickness planer 1G according to this embodiment, like in the first embodiment, the battery pack mounting unit 50G is configured such that the battery pack mounting unit 50G and the battery pack 60 attached to the battery pack mounting unit 50G lie in a position avoiding the feeding area TA. Particularly, in the thickness planer 1G according to this embodiment, the battery pack mounting unit 50G is mounted to the left side surface of the left side cover 46. Specifically, the battery pack mounting unit 50G is arranged in the left side area LSA. Therefore, during planing operation, the workpiece CM is avoided from getting into contact with the battery pack mounting unit 50G and the battery pack 60. Further, the user's view of the cutter head 21 (or the cutting area CA) is avoided from being obstructed by the battery pack mounting unit 50G and the battery pack 60, so that a user can easily check how the workpiece CM is being planed. As a result, the working efficiency of a user is prevented from lowering due to provision of the battery pack mounting unit 50G and the battery pack 60 in the thickness planer 1G.

In the thickness planer 1G according to this embodiment, with the structure in which the battery pack mounting unit 50G is mounted to the left side surface of the left side cover 46, a free space on the left side of the left side cover 46 is effectively utilized.

In this embodiment, other effects similar to those of the above-described first embodiment are also obtained by provision of the same structures and methods as in the first embodiment.

The battery pack mounting unit 50G may be arranged on a right side surface of the right side cover 47. Further, the battery pack mounting unit 50G may be arranged on the left side surface of the left side cover 46 or the right side surface of the right side cover 47 such that the battery pack 60 is attached to and detached from the battery pack mounting unit 50G from the front-rear direction. Particularly, the battery pack mounting unit 50G may be arranged on the left side surface of the left side cover 46 or the right side surface of the right side cover 47 such that the battery pack 60 is attached to the battery pack mounting unit 50G from the front to rear.

In this embodiment, the left side cover 46 or the right side cover 47 and the battery pack mounting unit 50G may be integrally formed with each other. With this structure, the strengths of the left side cover 46 or the right side cover 47 and the battery pack mounting unit 50G are improved.

The structure in which the battery pack mounting unit 50G is arranged on the left or right side of the main housing 100 may be applied to a thickness planer not having the top cover on the top of the main housing 100, or it may be applied to a thickness planer not having the left side cover 46 and the right side cover 47. In this case, for example, the battery pack mounting unit 50G may be arranged on the left or right side surface of the main housing 100. By provision of such a structure, a free space on the left or right side of the main housing 100 is effectively utilized.

Ninth Embodiment

Figure 28:
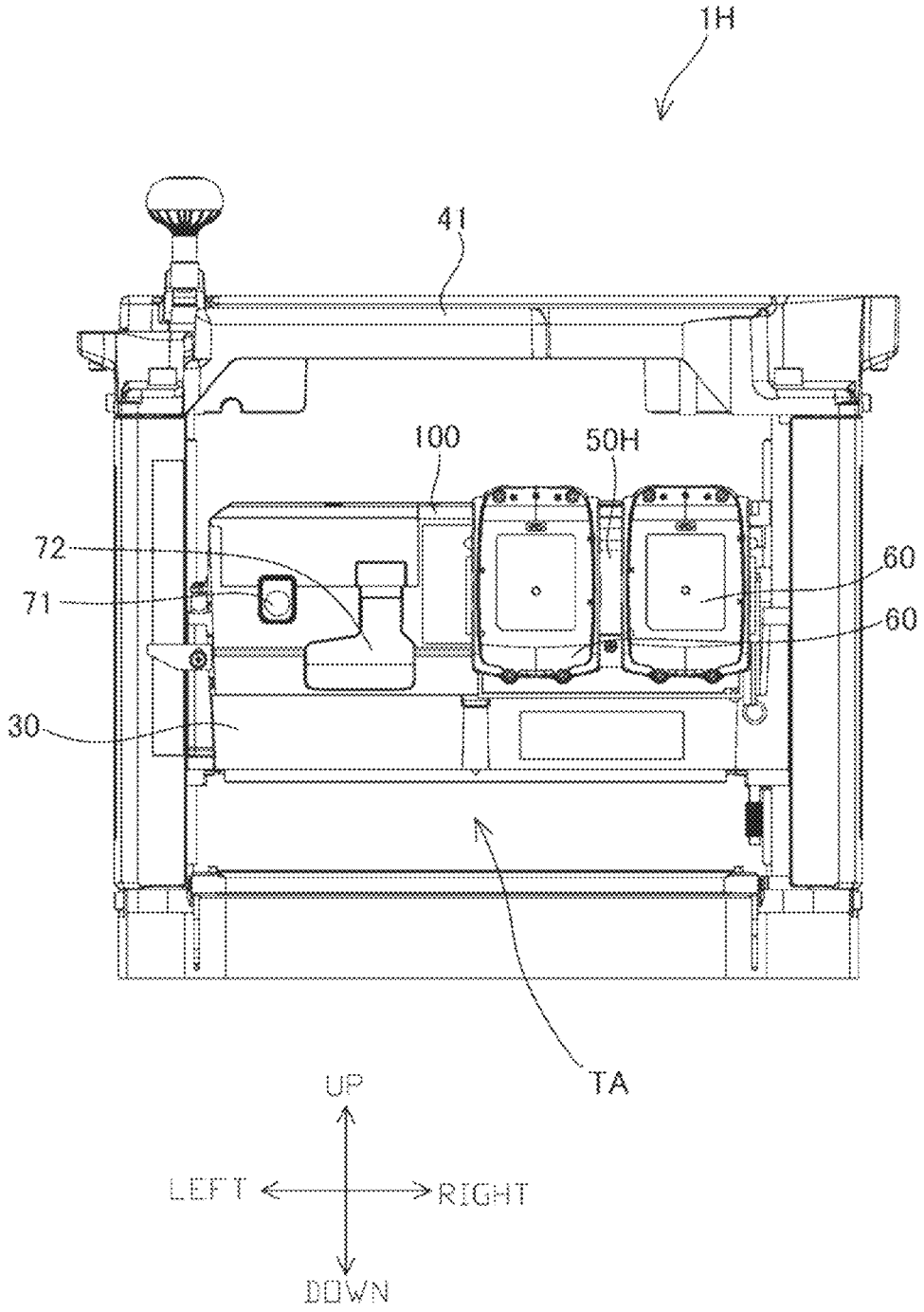
FIG. 28 is a front view of a thickness planer of a ninth embodiment.
Figure 29:
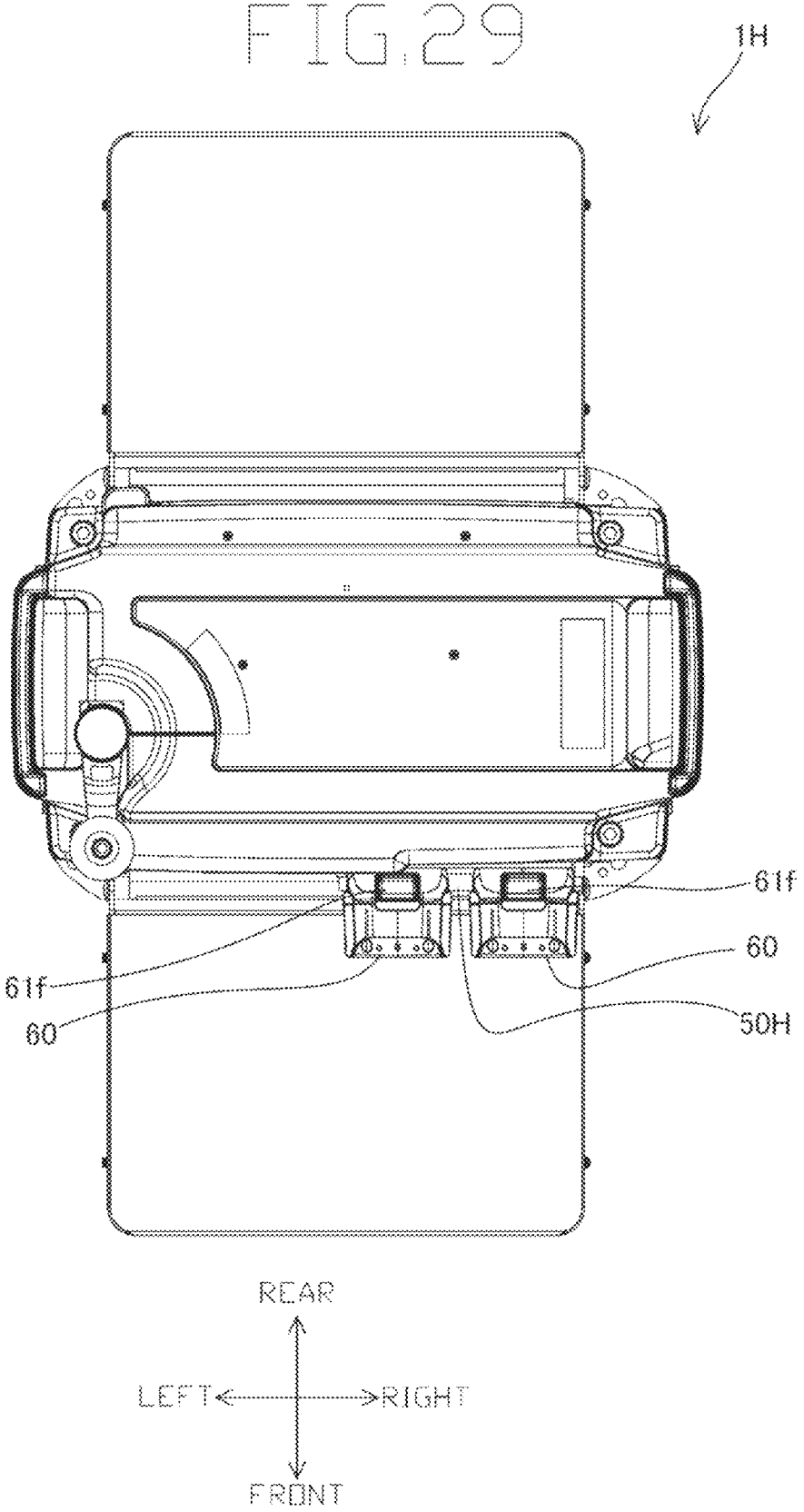
FIG. 29 is a top view of the thickness planer of the ninth embodiment.

A thickness planer 1H according to a ninth embodiment of the present disclosure is now described with reference to FIGS. 28 and 29. A main difference between the thickness planer 1H of this embodiment and the thickness planer 1 of the first embodiment is a position where a battery pack mounting unit 50H and the battery pack 60 are arranged.

The thickness planer 1H of this embodiment is configured to plane a workpiece CM like the thickness planer 1 of the first embodiment and includes the same structures as the thickness planer 1. Therefore, in the following description, the same structures as the thickness planer 1 are given like numerals and are not or briefly described, and different structures are mainly described with reference to the drawings.

In this embodiment, the battery pack mounting unit 50H is mounted to a front or rear part of the main housing 100. In other words, the battery pack mounting unit 50H is arranged in the driving mechanism arrangement area DMA and the housing upper area HUA. Particularly, in the thickness planer 1H of this embodiment, the battery pack mounting unit 50H is arranged on the front of the main housing 100. Specifically, the battery pack mounting unit 50H is fastened to the front of the main housing 100 by a plurality of screw parts.

The battery pack mounting unit 50H is mounted to the front of the main housing 100 in such an orientation that the battery pack 60 is attached and detached from above in front of the thickness planer 1H. Specifically, the battery pack 60 is attached to the battery pack mounting unit 50H by being slid downward from above with respect to the battery pack mounting unit 50H in front of the thickness planer 1H. Thus, the mounting direction is a direction heading from the upper side to the lower side of the thickness planer 1H. Further, the battery pack 60 is detached from the battery pack mounting unit 50H by being slid upward with respect to the battery pack mounting unit 50H in the thickness planer 1H. Thus, the removing direction is a direction heading from the lower side to the upper side of the thickness planer 1H.

In such a structure, the unlock button 61*f* of the battery pack 60 is operated from the front of the thickness planer 1H. Therefore, a user can attach and detach the battery pack 60 from the front of the thickness planer 1H like in operating the main switch 71 and the lever switch 72 and in feeding the workpiece CM to the cutting area CA.

As described above, in the thickness planer 1H according to this embodiment, the battery pack mounting unit 50H is arranged on the front of the main housing 100. Therefore, a user can easily attach and detach the battery pack 60. Further, a user can attach and detach the battery pack 60 from the front of the thickness planer 1H like in operating the main switch 71 and the lever switch 72 and in feeding the workpiece CM to the cutting area CA. Therefore, the thickness planer 1H according to this embodiment is provided with improved convenience.

In the thickness planer 1H of this embodiment, the battery pack mounting unit 50H is fastened to the front of the main housing 100 by a plurality of screw parts. Therefore, the battery pack mounting unit 50H and the battery pack 60 are prevented from falling off during transportation of the thickness planer 1H.

Further, when the battery pack 60 is detached from the battery pack mounting unit 50H, the battery pack 60 needs to be slid upward with respect to the battery pack mounting unit 50H in the thickness planer 1H. Therefore, the battery pack 60 is prevented from falling off the battery pack mounting unit 50H during transportation of the thickness planer 1H.

With the structure in which the battery pack mounting unit 50H is arranged on the front of the main housing 100, when the cutter head 21 is taken out of and into the thickness planer 1H for replacement of the plane blades 213, 214, the battery pack mounting unit 50H and the battery pack 60 are prevented from interfering with the replacement work, so that the efficiency of the replacement work is improved.

In the thickness planer 1H according to this embodiment, like in the first embodiment, the battery pack mounting unit 50H is configured such that the battery pack mounting unit 50H and the battery pack 60 attached to the battery pack mounting unit 50H lie in a position avoiding the feeding area TA. Specifically, the battery pack mounting unit 50H and the battery pack 60 are arranged in the driving mechanism arrangement area DMA and the housing upper area HUA. Particularly, in the thickness planer 1H according to this embodiment, the battery pack mounting unit 50H is mounted to the front of the main housing 100. Therefore, during planing operation, the workpiece CM is avoided from getting into contact with the battery pack mounting unit 50H and the battery pack 60. Further, the user's view of the cutter head 21 (or the cutting area CA) is avoided from being obstructed by the battery pack mounting unit 50H and the battery pack 60, so that a user can easily check how the workpiece CM is being planed. As a result, the working efficiency of a user is prevented from lowering due to provision of the battery pack mounting unit 50H and the battery pack 60 in the thickness planer 1H.

In the thickness planer 1H according to this embodiment, with the structure in which the battery pack mounting unit 50H is mounted to the front of the main housing 100, a free space in front of the main housing 100 is effectively utilized.

The battery pack mounting unit 50H may be arranged on the rear of the main housing 100. Further, in this embodiment, the main housing 100 and the battery pack mounting unit 50H may be integrally formed with each other. With this structure, the strengths of the main housing 100 and the battery pack mounting unit 50H are improved.

The structure in which the battery pack mounting unit 50H is arranged on the front or rear of the main housing 100 may be applied to a thickness planer not having the top cover on the top of the main housing 100. By provision of such a structure, a free space in front of or behind the main housing 100 is effectively utilized.

Tenth Embodiment

Figure 31:
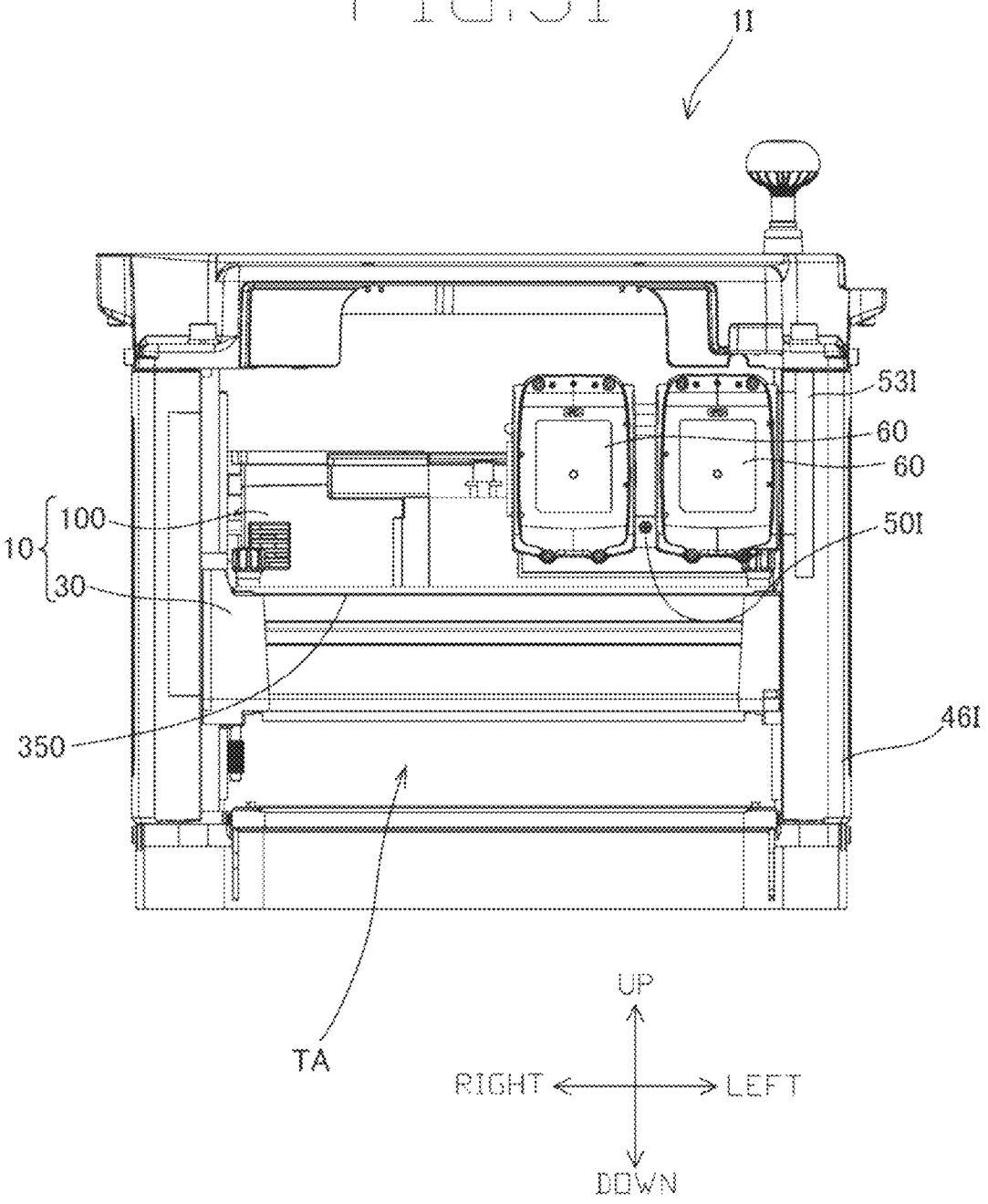
FIG. 31 shows a battery pack mounting unit in a first turning state in the thickness planer of the tenth embodiment.
Figure 32:
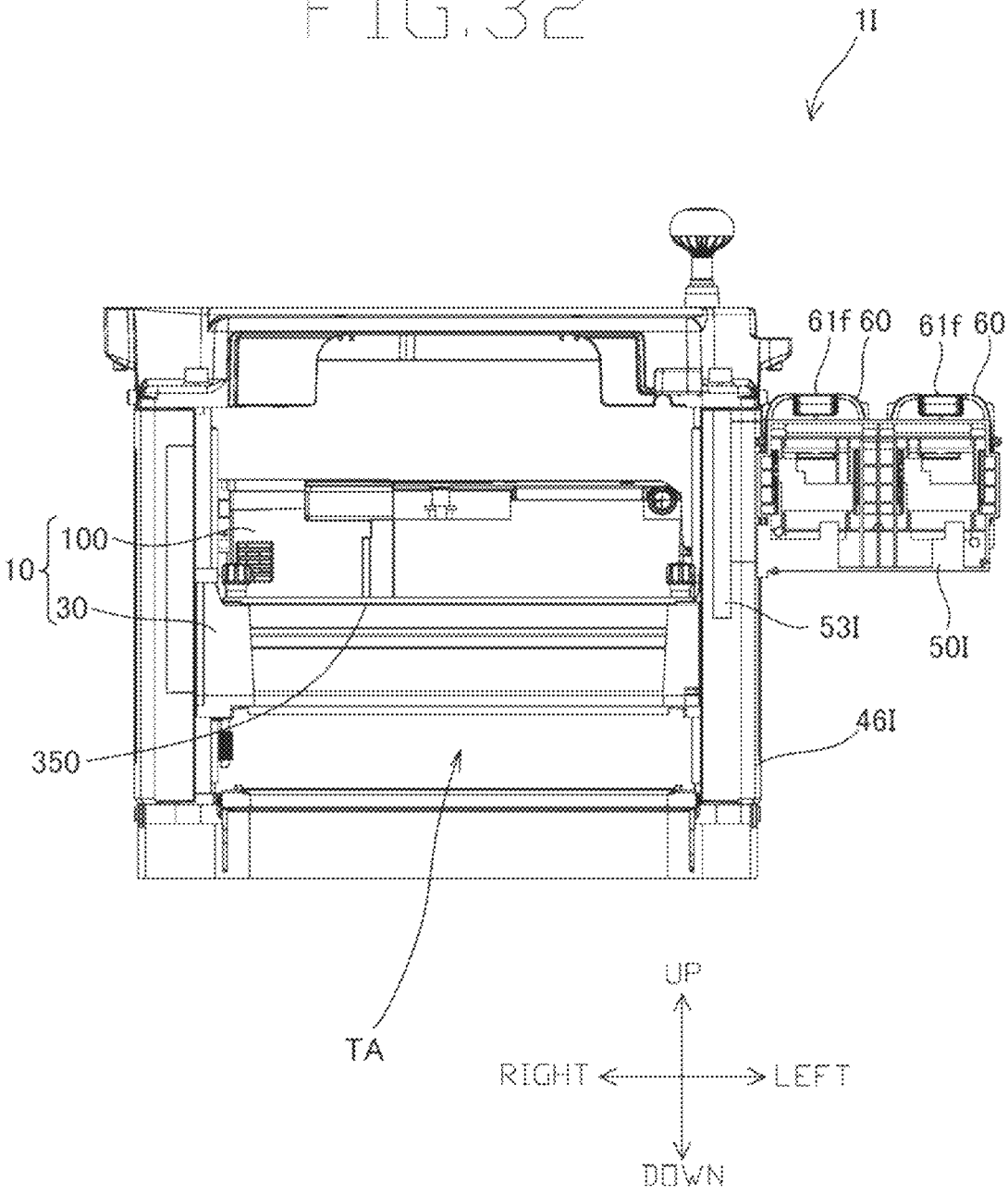
FIG. 32 shows the battery pack mounting unit in a second turning state in the thickness planer of the tenth embodiment.

A thickness planer 1I according to a tenth embodiment of the present disclosure is now described with reference to FIGS. 30 to 32. A main difference between the thickness planer 1I of this embodiment and the thickness planer 1 of the first embodiment is a position where a battery pack mounting unit 50I and the battery pack 60 are arranged.

The thickness planer 1I of this embodiment is configured to plane a workpiece CM like the thickness planer 1 of the first embodiment and includes the same structures as thickness planer 1. Therefore, in the following description, the same structures as the thickness planer 1 are given like numerals and are not or briefly described, and different structures are mainly described with reference to the drawings.

In this embodiment, the battery pack mounting unit 50I is supported by the left side cover 461 so as to be turnable around a pivot shaft 53I extending in the vertical direction. The battery pack mounting unit 50I is configured to be turned between a first side area (inner area) of the left side cover 461 which faces the main housing 100 and a second side area (outer area) on the opposite side to the first side area. Specifically, the battery pack mounting unit 50I is arranged in the driving mechanism arrangement area DMA and the housing upper area HUA, or in the left side area LSA.

In the following description, a state (shown in FIG. 31) in which the battery pack mounting unit 50I is located in the first side area (the driving mechanism arrangement area DMA and the housing upper area HUA) by turning around the pivot shaft 53I is defined as a first turning state, while a state (shown in FIG. 32) in which the battery pack mounting unit 50I is located in the second side area (the left side area LSA) by turning around the pivot shaft 53I is defined as a second turning state.

When transporting or storing the thickness planer 1I, a user places the battery pack mounting unit 50I in the first turning state, while, when using the thickness planer 1I or attaching and detaching the battery pack 60, the user places the battery pack mounting unit 50I in the second turning state.

In the second turning state, the battery pack mounting unit 50I is supported on the left side cover 461 by the pivot shaft 53I such that the rail parts 51*a*, the positive input terminal 51*b* and the negative input terminal 51*c* face forward. Therefore, a user can attach and detach the battery pack 60 from the front of the thickness planer 1I.

In the second turning state, the battery pack mounting unit 50I is supported on the left side cover 461 by the pivot shaft 53I in such an orientation that the battery pack 60 is attached and detached from above the thickness planer 1I. Specifically, the battery pack 60 is attached to the battery pack mounting unit 50I by being slid downward from above the thickness planer 1I with respect to the battery pack mounting unit 50I. Thus, the mounting direction is a direction heading from the upper side to the lower side of the thickness planer 1I. Further, the battery pack 60 is detached from the battery pack mounting unit 50I by being slid upward with respect to the battery pack mounting unit 50I in the thickness planer 1I. Thus, the removing direction is a direction heading from the lower side to the upper side of the thickness planer 1I.

Figure 30:
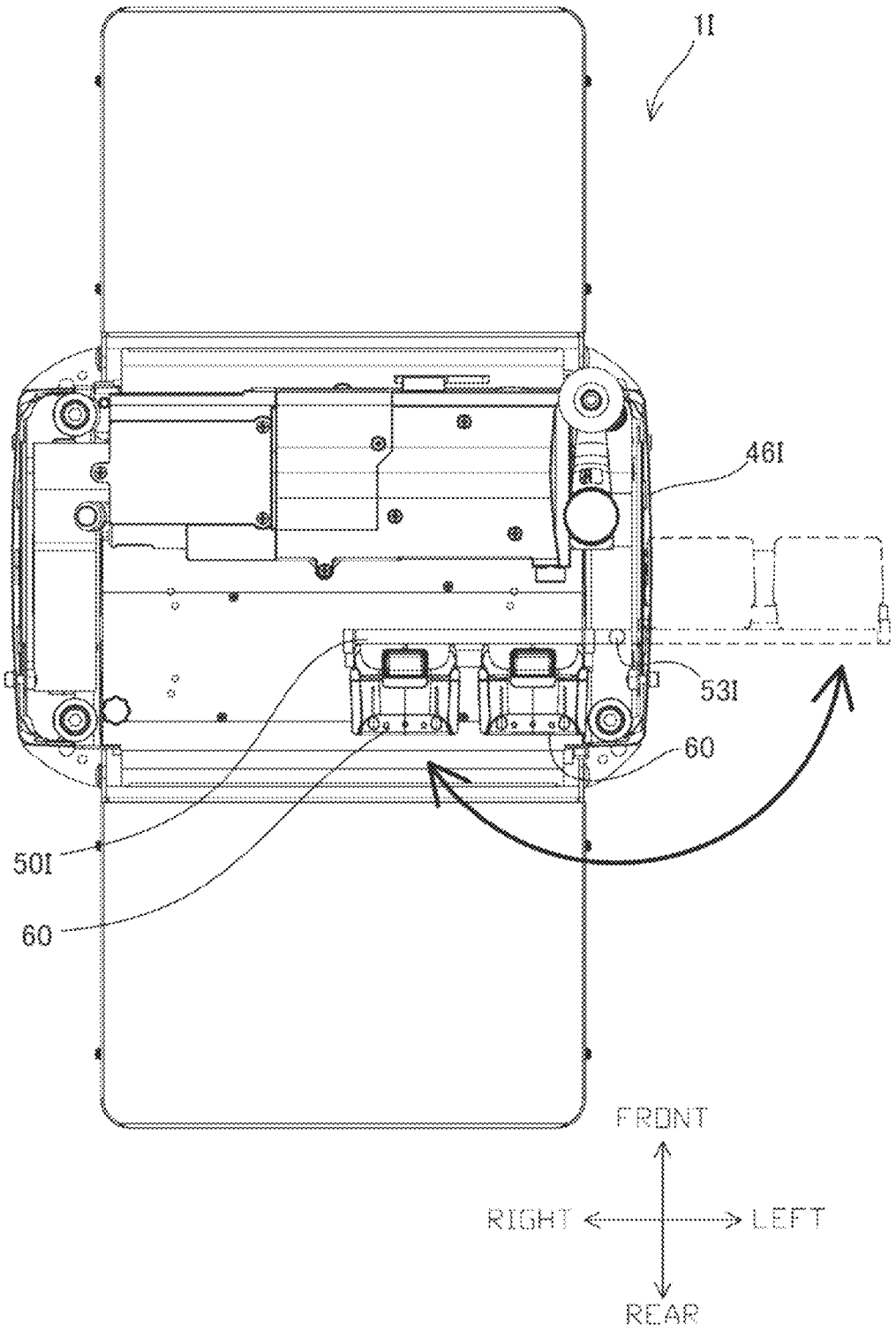
FIG. 30 shows a thickness planer of a tenth embodiment.

As shown in FIG. 30, in the first turning state, the battery pack mounting unit 50I is located behind the main housing 100 above the chip cover 350. Further, in this embodiment, it is configured such that rear end parts of the battery pack mounting unit 50I and the battery pack 60 in the first turning state are located forward (inward) of the rear end of the closed rear auxiliary table 45. Therefore, the battery pack mounting unit 50I and the battery pack 60 are avoided from getting into contact with external elements such as a user and surrounding equipment during transportation or storage of the thickness planer 1I.

As described above, in the thickness planer 1I according to this embodiment, the battery pack mounting unit 50I in the second turning state is supported on the left side cover 461 by the pivot shaft 53I such that the rail parts 51*a*, the positive input terminal 51*b* and the negative input terminal 51*c* face forward. Therefore, a user can easily attach and detach the battery pack 60 from the front of the thickness planer 1I. Further, a user can attach and detach the battery pack 60 from the front of the thickness planer 1I like in operating the main switch 71 and the lever switch 72 and in feeding the workpiece CM to the cutting area CM. Therefore, the thickness planer 1I according to this embodiment is provided with improved convenience.

Like in the first embodiment, the battery pack mounting unit 50I in the second turning state is configured such that the battery pack mounting unit 50I and the battery pack 60 attached to the battery pack mounting unit 50I lie in a position avoiding the feeding area TA. Specifically, the battery pack mounting unit 50I is arranged in the left side area LSA. Particularly, in the thickness planer 1I according to this embodiment, the battery pack mounting unit 50I in the second turning state is located on the left side of the left side cover 461. Therefore, during planing operation by a user, the workpiece CM is avoided from getting into contact with the battery pack mounting unit 50I and the battery pack 60 while being fed, so that decrease in working efficiency is avoided. Further, the user's view of the cutter head 21 (or the cutting area CA) is avoided from being obstructed by the battery pack mounting unit 50I and the battery pack 60, so that a user can easily check how the workpiece CM is being planed. As a result, the working efficiency of a user is prevented from lowering due to provision of the battery pack mounting unit 50I and the battery pack 60 in the thickness planer 1I.

With the structure in which the battery pack mounting unit 50I in the second turning state is located on the left side of the left side cover 461, when the cutter head 21 is taken out of and into the thickness planer 1I for replacement of the plane blades 213, 214, the battery pack mounting unit 50I and the battery pack 60 are prevented from interfering with the replacement work, so that the efficiency of the replacement work is improved.

In the thickness planer 1I according to this embodiment, it is configured such that the rear end parts of the battery pack mounting unit 50I and the battery pack 60 in the first turning state are located forward (inward) of the rear end of the closed rear auxiliary table 45. Therefore, the battery pack mounting unit 50I and the battery pack 60 are avoided from getting into contact with external elements such as a user and surrounding equipment during transportation or storage of the thickness planer 1I. Thus, the thickness planer 1I of this embodiment is provided with improved storability and portability.

In the thickness planer 1I according to this embodiment, with the structure in which the battery pack mounting unit 50I is supported on the left side cover 461 by the pivot shaft 53I, the battery pack mounting unit 50I and the battery pack 60 are prevented from falling off during transportation of the thickness planer 1I.

In this embodiment, other effects similar to those of the above-described first embodiment are also obtained by provision of the same structures and methods as in the first embodiment.

Further, the battery pack mounting unit 50I may be supported on the right side cover 471 so as to be turnable around the pivot shaft 53I.

Eleventh Embodiment

Figure 33:
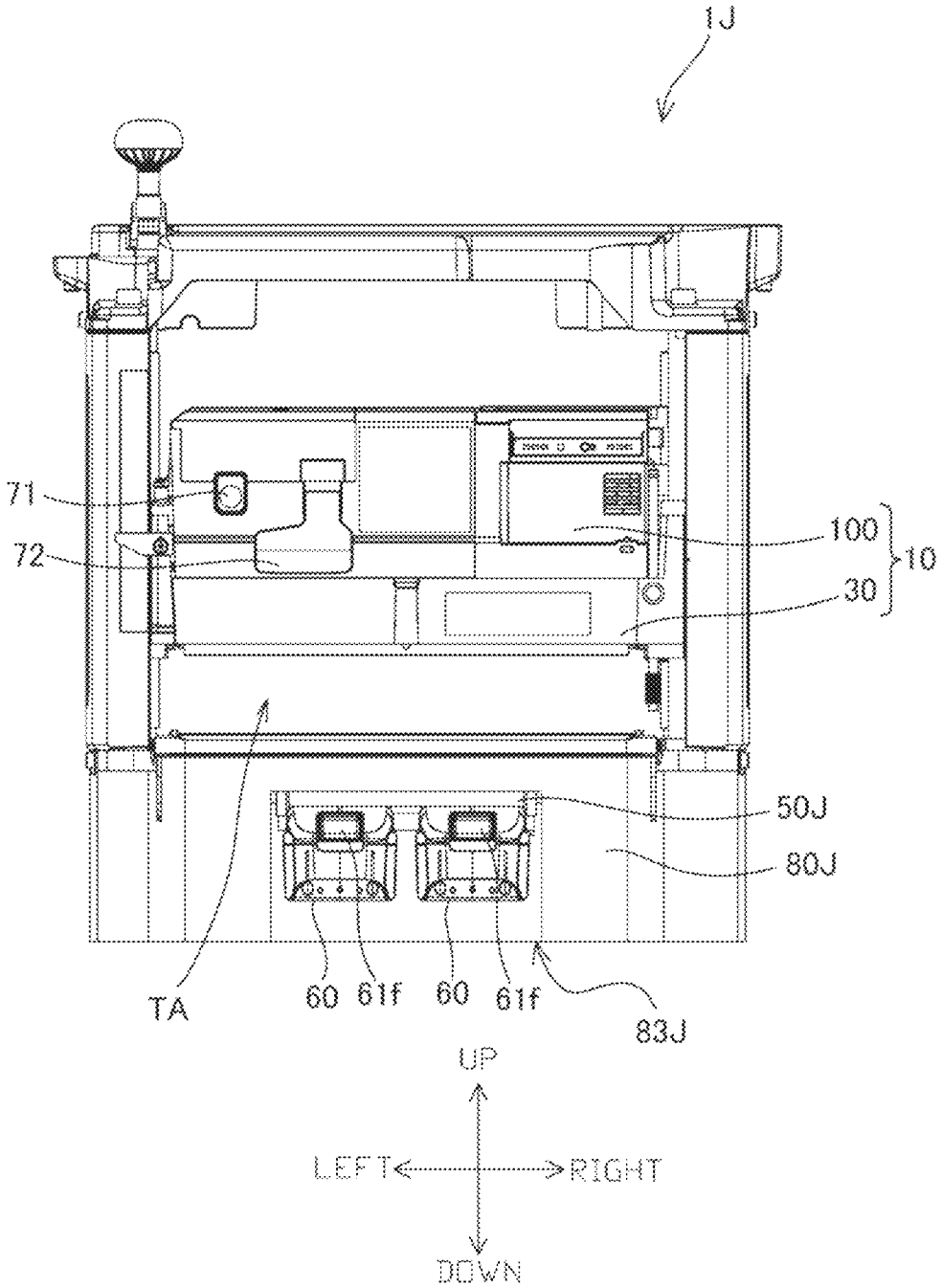
FIG. 33 is a front view of a thickness planer of an eleventh embodiment.
Figure 34:
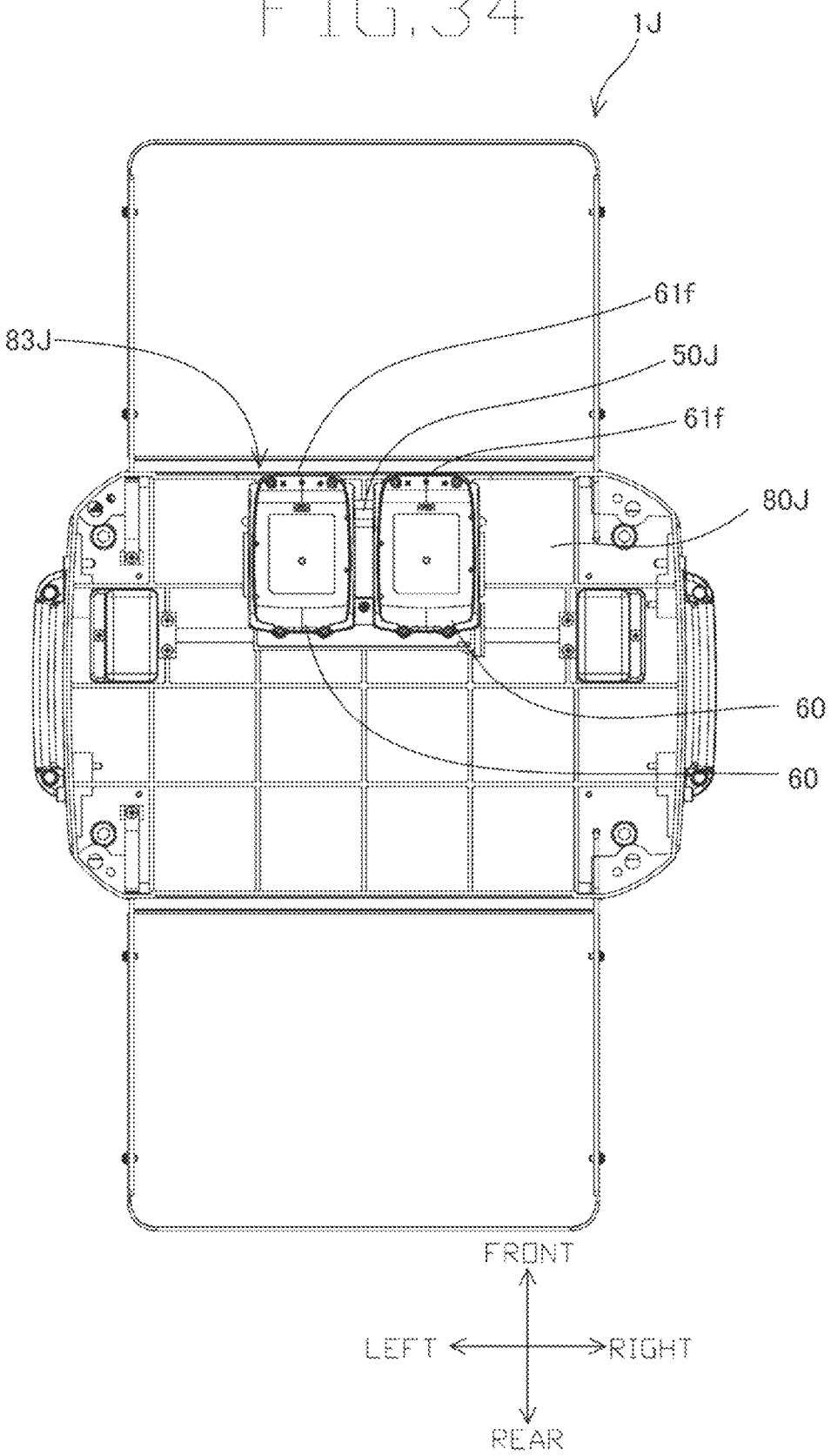
FIG. 34 is a bottom view of the thickness planer of the eleventh embodiment.

A thickness planer 1J according to an eleventh embodiment of the present disclosure is now described with reference to FIGS. 33 and 34. A main difference between the thickness planer 1J of this embodiment and the thickness planer 1 of the first embodiment is a position where a battery pack mounting unit 50J and the battery pack 60 are arranged.

The thickness planer 1J of this embodiment is configured to plane a workpiece CM like the thickness planer 1 of the first embodiment and includes the same structures as the thickness planer 1. Therefore, in the following description, the same structures as the thickness planer 1 are given like numerals and are not or briefly described, and different structures are mainly described with reference to the drawings.

In this embodiment, the battery pack mounting unit 50J is arranged below the table 43, that is, in the base area BSA. Specifically, the battery pack mounting unit 50J is arranged in a front part of a lower side area of a base 80J. Particularly, in this embodiment, the battery pack mounting unit 50J is fastened to a lower surface of the base 80J by a plurality of screw parts. An opening 83J is formed in a front side of the base 80J. The battery pack mounting unit 50J is mounted to the lower surface of the base 80J in such an orientation that the battery pack 60 is attached and detached from the front of the thickness planer 1J. Specifically, the battery pack 60 is attached to the battery pack mounting unit 50J by being slid rearward from the front of the thickness planer 1J with respect to the battery pack mounting unit 50J. Thus, the mounting direction is a direction heading from the front to the rear of the thickness planer 1J. Further, the battery pack 60 is detached from the battery pack mounting unit 50J by being slid forward with respect to the battery pack mounting unit 50J in the thickness planer 1J. Thus, the removing direction is a direction heading from the rear to the front of the thickness planer 1J.

In such a structure, the unlock button 61*f* of the battery pack 60 is operated from the front of the thickness planer 1J. Therefore, a user can attach and detach the battery pack 60 from the front of the thickness planer 1J like in operating the main switch 71 and the lever switch 72 and in feeding the workpiece CM to the cutting area CA.

In this embodiment, it is configured such that rear end parts of the battery pack mounting unit 50J and the battery pack 60 are located rearward (inward) of the rear end of the closed front auxiliary table 44. Therefore, the battery pack mounting unit 50J and the battery pack 60 are avoided from getting into contact with external elements such as a user and surrounding equipment during transportation or storage of the thickness planer 1J.

As described above, in the thickness planer 1J according to this embodiment, a user can easily attach and detach the battery pack 60 from the front of the thickness planer 1J. Further, a user can attach and detach the battery pack 60 from the front of the thickness planer 1J like in operating the main switch 71 and the lever switch 72 and in feeding the workpiece CM to the cutting area CA. Therefore, the thickness planer 1J according to this embodiment is provided with improved convenience.

Like in the first embodiment, the battery pack mounting unit 50J is configured such that the battery pack mounting unit 50J and the battery pack 60 attached to the battery pack mounting unit 50J lie in a position avoiding the feeding area TA. Specifically, the battery pack mounting unit 50J is arranged in the base area BSA. Particularly, in this embodiment, the battery pack mounting unit 50J is arranged in the lower side area of the base 80J. Therefore, during planing operation by a user, the workpiece CM is avoided from getting into contact with the battery pack mounting unit 50J and the battery pack 60 while being fed, so that decrease in working efficiency is avoided. Further, the user's view of the cutter head 21 (or the cutting area CA) is avoided from being obstructed by the battery pack mounting unit 50J and the battery pack 60, so that a user can easily check how the workpiece CM is being planed. As a result, the working efficiency of a user is prevented from lowering due to provision of the battery pack mounting unit 50J and the battery pack 60 in the thickness planer 1J.

With the structure in which the battery pack mounting unit 50J is arranged in the lower side area of the base 80J, when the cutter head 21 is taken out of and into the thickness planer 1J for replacement of the plane blades 213, 214, the battery pack mounting unit 50J and the battery pack 60 are prevented from interfering with the replacement work, so that the efficiency of the replacement work is improved.

It is configured such that rear end parts of the battery pack mounting unit 50J and the battery pack 60 are located forward (inward) of the front end of the closed front auxiliary table 44. Therefore, the battery pack mounting unit 50J and the battery pack 60 are avoided from getting into contact with external elements such as a user and surrounding equipment during transportation or storage of the thickness planer 1J. Thus, the thickness planer 1J of this embodiment is provided with improved storability and portability.

In the thickness planer 1J according to this embodiment, with the structure in which the battery pack mounting unit 50J is fastened to the lower surface of the base 80J by the screw parts, the battery pack mounting unit 50J and the battery pack 60 are prevented from falling off during transportation of the thickness planer 1J.

Further, in this embodiment, the battery pack mounting unit 50J is arranged below the table 43, so that a free space below the table 43 is effectively utilized.

In this embodiment, other effects similar to those of the above-described first embodiment are also obtained by provision of the same structures and methods as in the first embodiment.

The battery pack mounting unit 50J may be arranged in a rear part of the lower side area of the base 80J. Further, the battery pack mounting unit 50J may be mounted to the lower surface of the base 80J in such an orientation that the battery pack 60 is attached and detached from the rear of the thickness planer 1J.

The structure in which the battery pack mounting unit 50J is arranged below the table 43 may be applied to a thickness planer in which the table can be raised and lowered in the vertical direction respect to the base, or it may be applied to a thickness planer not having the top cover on the top of the main housing. In this case, the same effects as in this embodiment can also be obtained by arranging the battery pack mounting unit in the lower side area of the base like in this embodiment.

According to the above-described embodiments, the thickness planer is configured such that the battery pack 60 is removably attached thereto, but it may be configured otherwise. For example, the thickness planer may be configured such that the battery pack 60 is unremovably attached thereto. Specifically, the thickness planer may be provided with a built-in battery pack. The battery pack mounting unit may include a fixing metal fitting and a screw part for unremovably attaching the battery pack to the thickness planer, or other members necessary to attach the battery pack to the thickness planer. Further, in this case, the thickness planer may be configured such that the battery pack mounting unit and the battery pack attached to the battery pack mounting unit lie in a position avoiding the feeding area TA through which the workpiece CM passes when fed to a planing part by a feeding part.

According to the above-described embodiments, the battery pack mounting unit is configured such that two battery packs can be attached thereto, but it may be configured otherwise. The battery pack mounting unit may be configured such that one or three or more battery packs can be attached thereto.

According to the above-described embodiments, the thickness planer is configured such that a plurality of battery packs attached to the battery pack mounting unit are electrically connected in series to the motor, but it may be configured otherwise. For example, it may be configured such that the battery packs attached to the battery pack mounting unit are electrically connected in parallel to the motor.

According to the above-described embodiments, the thickness planer is configured such that the workpiece is fed in one direction, but it may be configured otherwise. For example, the thickness planer may be configured such that the workpiece is fed in both directions.

(Correspondences)

Correspondences between the features of the above-described embodiments and the features of the invention are as follows. The thickness planer 1, 1A, 1B, 1C, 1D, 1E, 1F, 1G, 1H, 1I, 1J is an example embodiment that corresponds to the "thickness planer" according to the present invention. The workpiece CM is an example embodiment that corresponds to the "workpiece" according to the present invention. The motor 15 is an example embodiment that corresponds to the "motor" according to the present invention. The cutter head 21 is an example embodiment that corresponds to the "planing part" according to the present invention. The table 43, the front auxiliary table 44 and the rear auxiliary table 45 are example embodiments that correspond to the "placing part" according to the present invention. The feed roller 31, 33 is an example embodiment that corresponds to the "feeding part" according to the present invention. The battery pack 60 is an example embodiment that corresponds to the "battery pack" according to the present invention. The battery pack mounting unit 50, 50A, 50B, 50C, 50D, 50E, 50F, 50G, 50H, 50I, 50J and the members necessary to unremovably attach the battery pack to the thickness planer are example embodiments that correspond to the "battery pack mounting unit" according to the present invention. The feeding area TA is an example embodiment that corresponds to the "feeding area" according to the present invention. The main housing 100 is an example embodiment that corresponds to the "motor housing" according to the present invention. The top cover 41, 41A, 41B, 41F is an example embodiment that corresponds to the "cover part" according to the present invention. The battery pack housing part 410B, 410C is an example embodiment that corresponds to the "battery pack housing part" according to the present invention. The chip cover 350 is an example embodiment that corresponds to the "scattering prevention part" according to the present invention. The top cover 41, the left side cover 46, the right side cover 47 and the base 80 are example embodiments that correspond to the "housing forming the thickness planer" according to the present invention. The electric cord 52, 52E is an example embodiment that correspond to the "energizing member" according to the present invention. The left side cover 46, 46E and the right side cover 47 are example embodiments that correspond to the "side member" according to the present invention. The first side area (inner area) is an example embodiment that corresponds to the "first side area" according to the present invention. The second side area (outer area) is an example embodiment that corresponds to the "second side area" according to the present invention. The pivot shaft 53I is an example embodiment that corresponds to the "pivot shaft around which the battery pack mounting unit is configured to be turnable between a first side area and a second side area on the opposite side to the first side area" according to the present invention.

DESCRIPTION OF THE NUMERALS

1, 1A to 1J: thickness planer, 10: body unit, 15: motor, 19: residual capacity display part, 21: cutter head, 30: main frame, 31, 33: feed roller, 41, 41A to 41D, 41F: top cover, 43: table, 44: front auxiliary table, 45: rear auxiliary table, 46, 46E, 461: left side cover, 47, 471: right side cover, 48: lifting handle, 50, 50A to 50J: battery pack mounting unit, 51: mounting part, 51*a*: rail part, 51*b*: positive input terminal, 51*c*: negative input terminal, 51*e*: lock receiving hole, 52, 52E: electric cord, 53I: pivot shaft, 60: battery pack, 61*a*: rail receiving part, 61*b*: positive output terminal, 61*c*: negative output terminal, 61*d*: connector part, 61*e*: lock member, 61*f*: unlock button, 71: main switch, 72: lever switch, 80: base, 80J: base, 83J: opening, 100: main housing, 110: first housing, 112: controller, 114: control board, 115: transistor, 118: right end wall part, 121: intake port, 125: outlet port, 145: chip discharge port, 151: stator, 152: rotor, 153: motor shaft, 154, 155: bearing, 156: fan, 157: pulley, 160: second housing, 161, 162, 163: gear, 164: drive shaft, 166: gear, 180: third housing, 191, 192: residual capacity gauge, 201: belt, 211: pulley, 213, 214: planer blade, 215: screw part, 301: chain, 311: shaft, 312: gear, 313: roller part, 331: shaft, 332: gear, 333: roller part, 341, 342, 343, 344: slide part, 345, 346: lifting screw hole part, 350: chip cover, 351: screw part, 352: screw part, 410B, 410C: battery pack housing part, 411, 412, 413, 414: column, 415, 416, 417, 418: screw part, 420: escape part, 420A: escape part, 420F: escape part, 431: placing surface, 441: placing surface, 451: placing surface, 461E: connection terminal, 481: operation part, 483: pivot shaft, 485, 486: lifting screw shaft, CM: workpiece, CA: cutting area, TA: feeding area, CUA: cover upper area, HUA: housing upper area, DMA: driving mechanism arrangement area, BSA: base area, LSA: left side area, RSA: right side area

What is claimed is:

1. A thickness planer, comprising:

a motor;

a planing part that is configured to be driven by the motor and plane a workpiece;

a placing part on which the workpiece is placeable;

a feeding part that is configured to feed the workpiece placed on the placing part to the planing part; and a battery pack mounting unit to which a battery pack for supplying power to the motor is attachable.

2. The thickness planer as defined in claim 1, wherein, when an area through which the workpiece passes while being fed by the feeding part is defined as a feeding area, the battery pack mounting unit is configured such that the battery pack mounting unit and the battery pack attached to the battery pack mounting unit lie in a position avoiding the feeding area.

3. The thickness planer as defined in claim 1, wherein the battery pack mounting unit is configured such that the battery pack is removably attached thereto.

4. The thickness planer as defined in claim 1, wherein the battery pack is usable as a power source for other power tools.

5. The thickness planer as defined in claim 1, further comprising:

a motor housing that houses the motor, wherein:

the placing part has a placing surface on which the workpiece is placeable, when a direction in which the feeding part feeds the workpiece is defined as a front-rear direction, a direction perpendicular to the placing surface is defined as a vertical direction, and in the vertical direction, a direction from the placing part toward the workpiece is defined as an upper direction and a direction opposite to the upper direction is defined as a lower direction, the battery pack mounting unit is arranged above the motor housing.

6. The thickness planer as defined in claim 5, further comprising:

a cover part that is provided above the motor housing and covers at least part of the motor housing when the thickness planer is viewed from above, wherein:

the battery pack mounting unit is arranged above the motor housing and below the cover part.

7. The thickness planer as defined in claim 6, further comprising:

a left side member and a right side member that are provided on left and right sides of the motor housing, respectively, when a direction perpendicular to the front-rear direction and the vertical direction is defined as a left-right direction, wherein:

the battery pack mounting unit is arranged in an area surrounded by the motor housing, the cover part and the left and right side members.

8. The thickness planer as defined in claim 7, wherein the battery pack mounting unit is mounted to a lower surface of the cover part.

9. The thickness planer as defined in claim 8, wherein:

the battery pack mounting unit is configured such that a plurality of battery packs can be attached thereto, and the plurality of battery packs attached to the battery pack mounting unit are electrically connected to the motor in series.

10. The thickness planer as defined in claim 5, wherein the battery pack mounting unit is mounted on top of the motor housing.

11. The thickness planer as defined in claim 5, further comprising:

a battery pack housing part that houses at least parts of the battery pack mounting unit and the battery pack attached to the battery pack mounting unit, wherein:

the battery pack housing part is arranged above the motor housing.

12. The thickness planer as defined in claim 5, further comprising:

a cover part that is provided above the motor housing and covers at least part of the motor housing when the thickness planer is viewed from above, and a battery pack housing part that houses at least parts of the battery pack mounting unit and the battery pack attached to the battery pack mounting unit, wherein:

the battery pack housing part is configured to house at least parts of the battery pack mounting unit and the battery pack attached to the battery pack mounting unit below an upper surface of the cover part.

13. The thickness planer as defined in claim 1, further comprising:

a scattering prevention part that is configured to prevent scattering of shavings generated and discharged by planing operation of the planing part, wherein:

the placing part has a placing surface on which the workpiece is placeable, when a direction in which the feeding part feeds the workpiece is defined as a front-rear direction, a direction perpendicular to the placing surface is defined as a vertical direction, and in the vertical direction, a direction from the placing part toward the workpiece is defined as an upper direction, the battery pack mounting unit is mounted on top of the scattering prevention part.

14. The thickness planer as defined in claim 1, further comprising:

a housing; and an energizing member that is electrically connected to the motor and extends to an outside of the housing, wherein:

the battery pack mounting unit is electrically connected to the motor via the energizing member.

15. The thickness planer as defined in claim 1, further comprising:

a motor housing that houses the motor, wherein:

the placing part has a placing surface on which the workpiece is placeable, when a direction in which the feeding part feeds the workpiece is defined as a front-rear direction, a direction perpendicular to the placing surface is defined as a vertical direction, and in the vertical direction, a direction from the placing part toward the workpiece is defined as an upper direction and a direction opposite to the upper direction is defined as a lower direction, the battery pack mounting unit is mounted to the motor housing and configured such that the battery pack is attached thereto by being slid in a prescribed sliding direction, and configured such that the battery pack is moved in the vertical direction as being moved in the front-rear direction when the battery pack is slid in the sliding direction.

16. The thickness planer as defined in claim 1, further comprising:

a motor housing that houses the motor, wherein:

the placing part has a placing surface on which the workpiece is placeable, when a direction in which the feeding part feeds the workpiece is defined as a front-rear direction, a direction perpendicular to the placing surface is defined as a vertical direction, and a direction perpendicular to the front-rear direction and the vertical direction is defined as a left-right direction, the battery pack mounting unit is arranged on a left side or a right side of the motor housing.

17. The thickness planer as defined in claim 1, wherein:

the placing part has a placing surface on which the workpiece is placeable, when a direction in which the feeding part feeds the workpiece is defined as a front-rear direction, a direction perpendicular to the placing surface is defined as a vertical direction, and a direction perpendicular to the front-rear direction and the vertical direction is defined as a left-right direction, the thickness planer further comprises:

a motor housing that houses the motor;

at least one side member that is provided on at least one of a left side and a right side of the motor housing; and a pivot shaft around which the battery pack mounting unit is configured to be turnable between a first side area of the side member which faces the motor housing and a second side area on the opposite side to the first side area.

18. The thickness planer as defined in claim 1, further comprising:

a motor housing that houses the motor, wherein:

when a direction in which the feeding part feeds the workpiece is defined as a front-rear direction, the battery pack mounting unit is arranged on a front or rear of the motor housing.

19. The thickness planer as defined in claim 1, wherein:

the placing part has a placing surface on which the workpiece is placeable, when a direction in which the feeding part feeds the workpiece is defined as a front-rear direction, a direction perpendicular to the placing surface is defined as a vertical direction, and in the vertical direction, a direction from the placing part toward the workpiece is defined as an upper direction and a direction opposite to the upper direction is defined as a lower direction, the battery pack mounting unit is arranged below the placing part.

20. The thickness planer as defined in claim 1, wherein:

the battery pack mounting unit is configured such that a plurality of battery packs can be attached thereto, and the plurality of battery packs attached to the battery pack mounting unit are electrically connected to the motor in series.

* * * * *